US010195489B2

(12) United States Patent
Isogawa et al.

(10) Patent No.: US 10,195,489 B2
(45) Date of Patent: Feb. 5, 2019

(54) GOLF BALL

(71) Applicant: Dunlop Sports Co., Ltd., Kobe-shi, Hyogo (JP)

(72) Inventors: Kazuhiko Isogawa, Kobe (JP); Kosuke Tachibana, Kobe (JP); Takahiro Shigemitsu, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 568 days.

(21) Appl. No.: 13/906,564

(22) Filed: May 31, 2013

(65) Prior Publication Data

US 2013/0324320 A1 Dec. 5, 2013

(30) Foreign Application Priority Data

Jun. 1, 2012 (JP) ..... 2012-126599
Jun. 1, 2012 (JP) ..... 2012-126600

(51) Int. Cl.
*A63B 37/00* (2006.01)

(52) U.S. Cl.
CPC ..... *A63B 37/0054* (2013.01); *A63B 37/0003* (2013.01); *A63B 37/0033* (2013.01);
(Continued)

(58) Field of Classification Search
CPC ..... A63B 37/0039; A63B 37/0044; A63B 37/0062; A63B 37/0063; A63B 37/0064;
(Continued)

(56) References Cited

U.S. PATENT DOCUMENTS 5,403,010 A 4/1995 Yabuki et al.
5,562,287 A 10/1996 Endo et al.
(Continued)

FOREIGN PATENT DOCUMENTS

JP 61-37178 A 2/1986
JP 6-154357 A 6/1994
(Continued)

OTHER PUBLICATIONS

English translation of the Chinese Office Action dated Nov. 17, 2015, for Chinese Application No. 201310215072.3.
(Continued)

*Primary Examiner* — John E Simms, Jr.
(74) *Attorney, Agent, or Firm* — Birch, Stewart, Kolasch & Birch, LLP

(57) ABSTRACT

The present invention provides a golf ball comprising a spherical core composed of a spherical inner core layer and an outer core layer, an intermediate layer and a cover, wherein the inner core layer has a hardness difference (Hs1−Ho) between a surface hardness (Hs1) and a center hardness (Ho) of 5 or less in JIS-C hardness, the outer core is such that $R^2$ of a linearly approximated curve obtained from a least square method is 0.95 or higher, when JIS-C hardness, measured at nine points obtained by dividing a thickness of the outer core in a radius direction of the spherical core into equal parts having 12.5% intervals therebetween, is plotted against distance (%) from a border point between the outer core layer and the inner core layer, and the intermediate layer has a slab hardness which is greater than a slab hardness of the cover.

24 Claims, 42 Drawing Sheets

(52) U.S. Cl.
CPC ..... *A63B 37/0038* (2013.01); *A63B 37/0039* (2013.01); *A63B 37/0043* (2013.01); *A63B 37/0044* (2013.01); *A63B 37/0045* (2013.01); *A63B 37/0062* (2013.01); *A63B 37/0063* (2013.01); *A63B 37/0064* (2013.01); *A63B 37/0076* (2013.01); *A63B 37/0092* (2013.01)

(58) Field of Classification Search
CPC ..... A63B 37/0043; A63B 37/0076; A63B 37/0092; C08K 5/0025; C08K 5/09; C08K 5/098
See application file for complete search history.

(56) References Cited

U.S. PATENT DOCUMENTS

| | | | | |
|---|---|---|---|---|
| 5,779,562 | A * | 7/1998 | Melvin et al. | 473/373 |
| 6,248,027 | B1 * | 6/2001 | Hayashi et al. | 473/371 |
| 2002/0065151 | A1 * | 5/2002 | Ohama | A63B 37/0003 473/371 |
| 2006/0017201 | A1 | 1/2006 | Wu et al. | |
| 2006/0135287 | A1 | 6/2006 | Kennedy, III et al. | |
| 2006/0229143 | A1 * | 10/2006 | Watanabe et al. | 473/378 |
| 2007/0173607 | A1 | 7/2007 | Kennedy, III et al. | |
| 2007/0202965 | A1 | 8/2007 | Shindo et al. | |
| 2007/0265113 | A1 * | 11/2007 | Hirau et al. | 473/376 |
| 2007/0281802 | A1 | 12/2007 | Watanabe et al. | |
| 2008/0194357 | A1 | 8/2008 | Higuchi | |
| 2008/0194359 | A1 | 8/2008 | Higuchi et al. | |
| 2008/0214324 | A1 | 9/2008 | Nanba et al. | |
| 2009/0011859 | A1 * | 1/2009 | Bulpett | A63B 37/0051 473/373 |
| 2009/0111609 | A1 * | 4/2009 | Watanabe et al. | 473/373 |
| 2009/0124757 | A1 | 5/2009 | Shindo et al. | |
| 2009/0227394 | A1 | 9/2009 | Bulpett et al. | |
| 2009/0258730 | A1 * | 10/2009 | Nakamura et al. | 473/376 |
| 2009/0258731 | A1 * | 10/2009 | Kamino et al. | 473/376 |
| 2010/0075778 | A1 * | 3/2010 | Kamino et al. | 473/376 |
| 2010/0093466 | A1 | 4/2010 | Ohama et al. | |
| 2010/0160087 | A1 * | 6/2010 | Nakamura et al. | 473/375 |
| 2010/0273575 | A1 * | 10/2010 | Watanabe | 473/373 |
| 2011/0092315 | A1 * | 4/2011 | Nakamura et al. | 473/376 |
| 2011/0159998 | A1 * | 6/2011 | Ohama et al. | 473/374 |
| 2011/0319193 | A1 | 12/2011 | Isogawa et al. | |
| 2012/0088604 | A1 * | 4/2012 | Matsuyama et al. | 473/376 |
| 2012/0100932 | A1 * | 4/2012 | Watanabe et al. | 473/373 |
| 2012/0252604 | A1 * | 10/2012 | Okabe et al. | 473/376 |

FOREIGN PATENT DOCUMENTS

| | | | |
|---|---|---|---|
| JP | 7-112036 | A | 5/1995 |
| JP | 3762505 | B2 | 4/2006 |
| JP | 2007-222622 | A | 9/2007 |
| JP | 2007-319660 | A | 12/2007 |
| JP | 2008-523952 | A | 7/2008 |
| JP | 2008-194471 | A | 8/2008 |
| JP | 2008-194473 | A | 8/2008 |
| JP | 2008-194532 | A | 8/2008 |
| JP | 2008-212681 | A | 9/2008 |
| JP | 2009-119256 | A | 6/2009 |
| JP | 2010-253268 | A | 11/2010 |
| JP | 2012-10726 | A | 1/2012 |

OTHER PUBLICATIONS

Office Action dated Oct. 6, 2015 for corresponding European Application No. 13 169 592.6.
Chinese Office Action for Application No. 201310215072.3, dated May 11, 2016, with English language translation. Tif.
Translation of Office Action issued in Korean Application No. 10-2013-0060290 dated Feb. 25, 2016.
English translation of the Chinese Decision of Refusal, dated Sep. 5, 2016, for corresponding Chinese Application No. 201310215072.3.
European Search Report, dated Aug. 1, 2014, for European Application No. 13169592.6.

* cited by examiner

GOLF BALL

FIELD OF THE INVENTION

The present invention relates to a golf ball, in particular, a golf ball traveling a great flight distance and having an excellent approach performance and durability.

DESCRIPTION OF THE RELATED ART

As a method for improving a flight distance on driver shots, for example, there are methods of using a core having high resilience and using a core having a hardness distribution in which the hardness increases toward the surface of the core from the center thereof. The former method has an effect of enhancing an initial speed, and the latter method has an effect of a higher launch angle and a lower spin rate. A golf ball having a higher launch angle and a low spin rate travels a great distance.

For example, Japanese Patent Publications Nos. S61-37178 A, 2008-212681 A, 2008-523952 T and 2009-119256 A disclose a technique of enhancing resilience of the core. Japanese Patent Publications Nos. S61-37178 A and S61-113475 A disclose a solid golf ball having an inner core where zinc acrylate as a co-crosslinking agent, palmitic acid, stearic acid, or myristic acid as a co-crosslinking activator, zinc oxide as another co-crosslinking activator, and a reaction rate retarder are blended, with respect to 100 parts by weight of a rubber.

Japanese Patent Publication No. 2008-212681 A discloses a golf ball comprising, as a component, a molded and crosslinked product obtained from a rubber composition essentially comprising a base rubber, a filler, an organic peroxide, an α,β-unsaturated carboxylic acid and/or a metal salt thereof, a copper salt of a saturated or unsaturated fatty acid.

Japanese Patent Publication No. 2008-523952 T discloses a golf ball, or a component thereof, molded from a composition comprising a base elastomer selected from the group consisting of polybutadiene and mixtures of polybutadiene with other elastomers, at least one metallic salt of an unsaturated monocarboxylic acid, a free radical initiator, and a non-conjugated diene monomer.

Japanese Patent Publication No. 2009-119256 A discloses a method of manufacturing a golf ball, comprising preparing a masterbatch of an unsaturated carboxylic acid and/or a metal salt thereof by mixing the unsaturated carboxylic acid and/or the metal salt thereof with a rubber material ahead, using the masterbatch to prepare a rubber composition containing the rubber material, and employing a heated and molded product of the rubber composition as a golf ball component, wherein the masterbatch of the unsaturated carboxylic acid and/or the metal salt thereof comprises; (A) from 20 wt % to 100 wt % of a modified polybutadiene obtained by modifying a polybutadiene having a vinyl content of from 0 to 2%, a cis-1,4 bond content of at least 80% and active terminals, the active terminal being modified with at least one type of alkoxysilane compound, and (B) from 80 wt % to 0 wt % of a diene rubber other than (A) the above rubber component [the figures are represented by wt % in the case that a total amount of (A) and (B) equal to 100 wt %] and (C) an unsaturated carboxylic acid and/or a metal salt thereof.

For example, Japanese Patent Publications Nos. H6-154357 A, 2008-194471 A, 2008-194473 A and 2010-253268 A disclose a core having a hardness distribution. Japanese Patent Publication No. H6-154357 A discloses a two-piece golf ball comprising a core formed of a rubber composition containing a base rubber, a co-crosslinking agent, and an organic peroxide, and a cover covering said core, wherein the core has the following hardness distribution according to JIS-C type hardness meter readings: (1) hardness at center: 58-73, (2) hardness at 5 to 10 mm from center: 65-75, (3) hardness at 15 mm from center: 74-82, (4) surface hardness: 76-84, wherein hardness (2) is almost constant within the above range, and the relation (1)<(2)<(3)≤(4) is satisfied. Japanese Patent Publication No. 2008-194471 A discloses a solid golf ball comprising a solid core and a cover layer that encases the core, wherein the solid core is formed of a rubber composition composed of 100 parts by weight of a base rubber that includes from 60 to 100 parts by weight of a polybutadiene rubber having a cis-1,4 bond content of at least 60% and synthesized using a rare-earth catalyst, from 0.1 to 5 parts by weight of an organic sulfur compound, an unsaturated carboxylic acid or a metal salt thereof, an inorganic filler, and an antioxidant; the solid core has a deformation from 2.0 mm to 4.0 mm, when applying a load from an initial load of 10 kgf to a final load of 130 kgf and has the hardness distribution shown in the following table.

TABLE 1

| Hardness distribution in solid core | Shore D harness |
|---|---|
| Center | 30 to 48 |
| Region located 4 mm from center | 34 to 52 |
| Region located 8 mm from center | 40 to 58 |
| Region located 12 mm from center (Q) | 43 to 61 |
| Region located 2 to 3 mm inside of surface (R) | 36 to 54 |
| Surface (S) | 41 to 59 |
| Hardness difference [(Q) − (S)] | 1 to 10 |
| Hardness difference [(S) − (R)] | 3 to 10 |

Japanese Patent Publication No. 2008-194473 A discloses a solid golf ball comprising a solid core and a cover layer that encases the core, wherein the solid core is formed of a rubber composition composed of 100 parts by weight of a base rubber that includes from 60 to 100 parts by weight of a polybutadiene rubber having a cis-1,4 bond content of at least 60% and synthesized using a rare-earth catalyst, from 0.1 part to 5 parts by weight of an organic sulfur compound, an unsaturated carboxylic acid or a metal salt thereof, and an inorganic filler; the solid core has a deformation from 2.0 mm to 4.0 mm, when applying a load from an initial load of 10 kgf to a final load of 130 kgf and has the hardness distribution shown in the following table.

TABLE 2

| Hardness distribution in solid core | Shore D harness |
|---|---|
| Center | 25 to 45 |
| Region located 5 to 10 mm from center | 39 to 58 |
| Region located 15 mm from center | 36 to 55 |
| Surface (S) | 55 to 75 |
| Hardness difference between center and surface | 20 to 50 |

Japanese Patent Publication No. 2010-253268 A discloses a multi-piece solid golf ball comprising a core, an envelope layer encasing the core, an intermediate layer encasing the envelope layer, and a cover which encases the intermediate layer and has formed on a surface thereof a plurality of dimples, wherein the core is formed primarily of a rubber material and has a hardness which gradually increases from a center to a surface thereof, the hardness difference in JIS-C hardness units between the core center and the core surface being at least 15 and, letting (I) be the average value for cross-sectional hardness at a position about 15 mm from the core center and at the core center and letting (II) be the cross-sectional hardness at a position about 7.5 mm from the core center, the hardness difference (I)-(II) in JIS-C units being within ±2; and the envelope layer, intermediate layer and cover have hardness which satisfy the condition: cover hardness>intermediate layer hardness>envelope layer hardness.

SUMMARY OF THE INVENTION

The present invention provides a golf ball traveling a great flight distance and having an excellent approach performance and durability.

The present invention provides a golf ball comprising a spherical core composed of a spherical inner core layer and an outer core layer, an intermediate layer disposed outside the spherical core, and a cover disposed outside the intermediate layer, wherein a hardness difference (Hs1−Ho) between a center hardness (Ho) of the spherical inner core layer and a surface hardness (Hs1) thereof is 5 or less in JIS-C hardness; the outer core layer is such that $R^2$ of a linear approximation curve obtained from a least square method is 0.95 or higher, when JIS-C hardness, which is measured at nine points obtained by dividing a thickness of the outer core layer into equal parts having 12.5% intervals in a radius direction of the spherical core, is plotted against distance (%) from a border point between the spherical inner core layer and the outer core layer; and the intermediate layer has a slab hardness (Hm) which is higher than a slab hardness (Hc) of the cover.

That is, the gist of the golf ball of the present invention is that the golf ball comprises the spherical core composed of the spherical inner core layer and the outer core layer disposed outside the spherical inner core layer; and an intermediate layer disposed outside the spherical core; and a cover disposed outside the intermediate layer; wherein the spherical inner core has a low degree of an outer-hard inner-soft structure, and the outer core layer is such that the hardness thereof increases linearly or almost linearly from a boundary point between the inner core layer and outer core layer toward the surface thereof, and the intermediate layer has a slab hardness (Hm) which is higher than the slab hardness (Hc) of the cover. The present invention is configured as described above, the present invention provides the golf ball traveling a great flight distance and having an excellent approach performance and durability.

According to the present invention, it is possible to provide a golf ball traveling a great flight distance and having an excellent approach performance and durability.

DESCRIPTION OF THE PREFERRED EMBODIMENT

Figure 1:
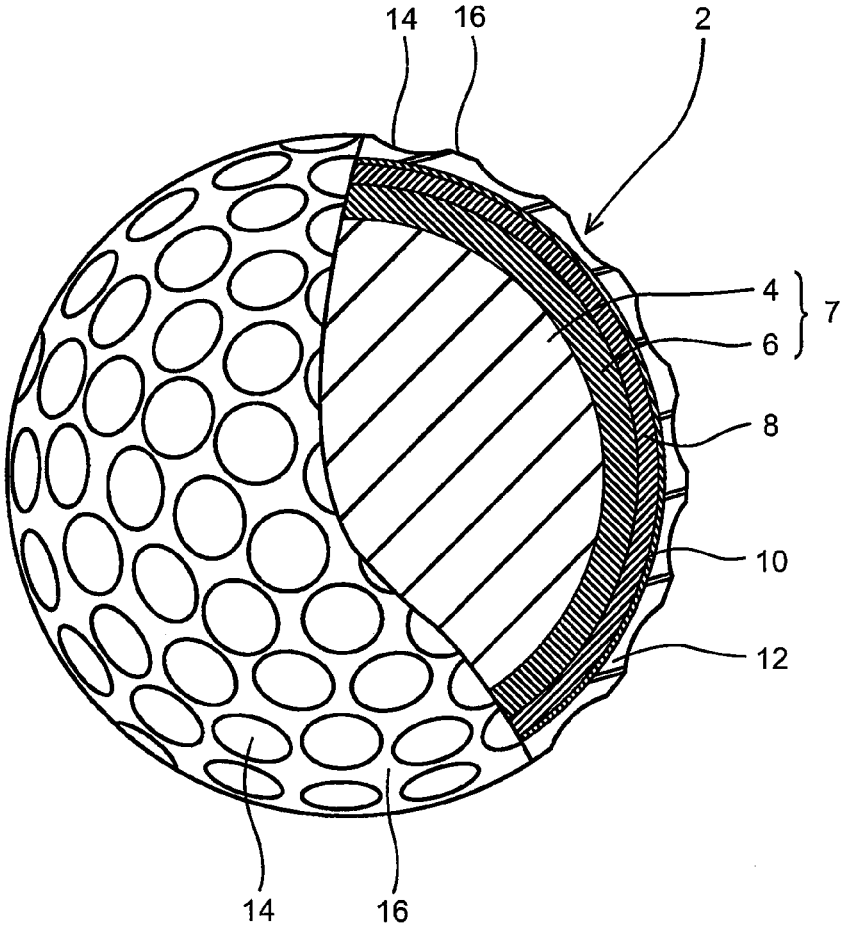
FIG. 1 is a partially cutaway sectional view showing the golf ball according to a preferable embodiment of the present invention.

The present invention provides a golf ball comprising a spherical core composed of a spherical inner core layer and an outer core layer, an intermediate layer disposed outside the spherical core, and a cover disposed outside the intermediate layer, wherein a hardness difference (Hs1−Ho) between a center hardness (Ho) of the spherical inner core layer and a surface hardness (Hs1) thereof is 5 or less in JIS-C hardness; the outer core layer is such that $R^2$ of a linear approximation curve obtained from a least square method is 0.95 or higher, when JIS-C hardness, which is measured at nine points obtained by dividing a thickness of the outer core layer into equal parts having 12.5% intervals in a radius direction of the spherical core, is plotted against distance (%) from a border point between the spherical inner core layer and the outer core layer; and the intermediate layer has a slab hardness (Hm) which is higher than a slab hardness (Hc) of the cover.

(1) Golf Ball Construction

The golf ball of the present invention is not limited, as long as it comprises a spherical core composed of a spherical inner core layer and an outer core layer, an intermediate layer disposed outside the spherical core, and a cover disposed outside the intermediate layer. Hereinafter, the golf ball of the present invention will be described based on preferred embodiments, referring to the accompanying drawings appropriately.

The inner core layer has a spherical shape. The inner core layer preferably has a hardness difference (Hs1−Ho) between a surface hardness (Hs1) thereof and a center hardness (Ho) thereof of 5 or less, more preferably 4 or less, and even more preferably 2 or less in JIS-C hardness. If the hardness difference (Hs1−Ho) is more than 5 in JIS-C hardness, the resilience of the golf ball deteriorates, and thus the initial velocity of the golf ball when hit is decreased. The lower limit of the above hardness difference is not limited, but the hardness difference is preferably 0 or more, and more preferably 1 or more JIS-C hardness.

The inner core layer preferably has the center hardness (Ho) of 40 or more, more preferably 50 or more, and even more preferably 60 or more in JIS-C hardness. If the center hardness is 40 or more in JIS-C hardness, the resilience improves. Further, from the aspect of suppression of the spin upon driver shots, the inner core layer preferably has the center hardness (Ho) of 80 or less, more preferably 76 or less, and even more preferably 72 or less in JIS-C hardness.

The inner core layer preferably has a surface hardness (Hs1) of 50 or more, more preferably 55 or more, and even more preferably 60 or more in JIS-C hardness. If the surface hardness is 50 or more in JIS-C hardness, the resilience improves. From the aspect of reducing the spin rate upon driver shots, the inner core layer preferably has the surface hardness (Hs1) of 80 or less, more preferably 75 or less, and even more preferably 70 or less in JIS-C hardness.

The inner core layer preferably has a diameter of 10.0 mm or more, more preferably 12.0 mm or more, and even more preferably 14.0 mm or more. If the inner core layer has the diameter of 10.0 mm or more, the spin rate on driver shots is reduced. The inner core layer preferably has a diameter of 25.0 mm or less, more preferably 22.0 mm or less, and even more preferably 19.0 mm or less. If the inner core layer has the diameter of 25.0 mm or less, the golf ball has the improved resilience performance.

The outer core layer is disposed outside the inner core layer. The outer core layer is preferably formed to cover the whole inner core layer.

The outer core layer is such that $R^2$ of a linear approximation curve obtained from a least square method is 0.95 or higher, when JIS-C hardness, which is measured at nine points obtained by dividing a thickness of the outer core layer in a radius direction of the spherical core into equal parts having 12.5% intervals therebetween, is plotted against distance (%) from the boundary point between the inner core layer and the outer core layer. If $R^2$ is 0.95 or more, the linearity of the hardness distribution of the outer core layer is enhanced, the spin rate on driver shots is reduced, thereby providing a great flight distance.

The hardness of the outer core layer is JIS-C hardness measured at nine points obtained by dividing a thickness of the outer core layer in a radius direction of the spherical core into equal parts having 12.5% intervals. That is, JIS-C hardness is measured at nine points, namely at the innermost point of the outer core layer (0%: the border point between the inner core layer and the outer core layer), and at distances of 12.5%, 25%, 37.5%, 50%, 62.5%, 75%, 87.5%, 100% (surface hardness Hs2 of the spherical core) from the border point between the inner core layer and the outer core layer. Next, the measurement results are plotted to make a graph having JIS-C hardness as a vertical axis and distances (%) from the border point as a horizontal axis. In the present invention, $R^2$ of a linear approximation curve obtained from this graph by the least square method is preferably 0.95 or higher. $R^2$ of the linear approximation curve obtained by the least square method indicates the linearity of the obtained plot. In the present invention, $R^2$ of 0.95 or more means that the outer core layer has the hardness distribution where the hardness increases linearly or almost linearly. If the outer core layer having the hardness distribution where the hardness increases linearly or almost linearly is used for the golf ball, the spin rate on driver shots decrease. As a result, the flight distance on driver shots increases. $R^2$ of the linear approximation curve is preferably 0.96 or more, more preferably 0.97 or more. The higher linearity provides a greater flight distance on driver shots.

The hardness difference (Hs2−Hb) between the surface hardness (Hs2) of the outer core layer and the hardness (Hb) at the border point between the outer core layer and the inner core layer is preferably 20 or more, more preferably 22 or more, and even more preferably 24 or more, and is preferably 45 or less, more preferably 40 or less, even more preferably 35 or less in JIS-C hardness. If the hardness difference (Hs2−Hb) is 20 or more in JIS-C hardness, it is possible to further reduce the spin rate on driver shots. If the hardness difference (Hs2−Hb) is 45 or less, the durability does not deteriorate. In the present invention, it is noted that the surface hardness (Hs2) of the spherical core is same as the surface hardness of the outer core layer.

The surface hardness (Hs2) of the outer core layer is preferably 80 or more, more preferably 82 or more, and even more preferably 84 or more in JIS-C hardness. If the surface hardness (Hs2) of the outer core layer is 80 or more in JIS-C hardness, the spin rate on driver shots are further reduced. From the aspect of the durability, the surface hardness (Hs2) of the outer core layer is preferably 96 or less, more preferably 94 or less, and even more preferably 92 or less in JIS-C hardness.

The hardness (Hb) at the innermost point (a border point between the outer core layer and the inner core layer) of the outer core layer is preferably 50 or more, more preferably 55 or more, and even more preferably 60 or more in JIS-C hardness. If the hardness at the innermost point of the outer core layer is 50 or more in JIS-C hardness, the ball speed when hit improves. From the aspect of lowering the spin rate on driver shots, the hardness (Hb) at the innermost point of the outer core layer is preferably 80 or less, more preferably 75 or less, and even more preferably 70 or less in JIS-C hardness.

The outer core layer preferably has a thickness of 6 mm or more, more preferably 8 mm or more, and even more preferably 11 mm or more, and preferably has a thickness of 16 mm or less, more preferably 15 mm or less, and even more preferably 13 mm or less. If the thickness is 6 mm or more, it is possible to suppress the decrease in the ball speed when hit. If the thickness is 16 mm or less, it is possible to enhance the effect of lowering the spin rate.

The spherical core preferably has a hardness difference (Hs2−Ho) between a surface hardness thereof (Hs2) (which is same as the surface hardness of the outer core layer) and a center hardness thereof (Ho) (same as the center hardness of the inner core layer) of 20 or more, more preferably 21 or more, even more preferably 22 or more, and preferably has a hardness difference of 45 or less, more preferably 40 or less, even more preferably 35 or less in JIS-C hardness. If the hardness difference between the center hardness of the spherical core and the surface hardness thereof is within the above range, the golf ball having a great flight distance due to the high launch angle and low spin rate is obtained.

The spherical core preferably has a diameter of 36.0 mm or more, more preferably 37.0 mm or more, and even more preferably 38.0 mm or more. If the spherical core has the diameter of 36.0 mm or more, it is possible to make the inner core layer have a greater diameter, thereby improving the resilience performance of the golf ball. The spherical core preferably has a diameter of 40.6 mm or less, more preferably 40.3 mm or less, and even more preferably 40.0 mm or less. If the spherical core has the diameter of 40.6 mm or less, it is possible to suppress a reduction in durability.

When the spherical core has a diameter from 36.0 mm to 40.6 mm, a compression deformation amount (shrinking deformation amount of the spherical core along the compression direction) of the spherical core when applying a load from an initial load of 98 N to a final load of 1275 N is preferably 2.2 mm or more, more preferably 2.5 mm or more, and is preferably 4.0 mm or less, more preferably 3.5 mm or less. If the compression deformation amount is 2.2 mm or more, the shot feeling of the golf ball becomes better. If the compression deformation amount is 4.0 mm or less, the resilience of the golf ball becomes better.

The golf ball of the present invention comprises the intermediate layer disposed outside the spherical core and the cover disposed outside the intermediate layer. The intermediate layer is formed between the spherical core and the cover, and is composed of at least one layer. The intermediate layer may have two or more layers. The cover is formed as the outermost layer of the golf ball body.

The golf ball of the present invention includes, for example, a four-piece golf ball comprising a spherical core composed of a spherical inner core layer and an outer core layer, an intermediate layer disposed outside the spherical core and an cover outside the intermediate layer; and a multi-piece golf ball (five-piece or more) comprising a spherical core composed of a spherical inner core layer and an outer core layer, two or more intermediate layers disposed outside the spherical core, and a cover disposed outside the intermediate layer. In the followings, with respect to the embodiment of the four-piece golf ball, the present invention will be described referring to "preferable embodiment A," and with respect to the embodiment of the multi-piece golf ball (five-piece or more), the present invention will be described referring to "preferable embodiment B."

In the preferable embodiment A, the golf ball of the present invention comprises a single-layered intermediate layer disposed outside the spherical core and a cover disposed outside the intermediate layer. FIG. 1 is a partially cutaway sectional view showing the golf ball 2 according to the preferable embodiment A of the present invention. The golf ball 2 comprises a spherical core 7 composed of a spherical inner core layer 4 and an outer core layer 6 disposed outside the spherical inner core layer 4, a single-layered intermediate layer 8 disposed outside the spherical core 7, and a cover 12 disposed outside the intermediate layer 8. A reinforcing layer 10 may be disposed between the intermediate layer 8 and the cover 12 in order to improve adhesion between the intermediate layer 8 and the cover 12. A plurality of dimples 14 are formed on a surface of the cover 12. Other portions than dimples 14 on the surface of the cover 12 are referred to as "land 16". The golf ball 2 is provided with a paint layer and a mark layer outside the cover, but these layers are not depicted.

In the preferable embodiment A, the slab hardness (Hm) of the intermediate layer is higher than the slab hardness (Hc) of the cover. This configuration strikes a balance between a great flight distance and an approach performance. The hardness difference (Hm−Hc) between the slab hardness (Hm) of the intermediate layer and the slab hardness (Hc) of the cover is preferably 30 or more, more preferably 32 or more, even more preferably 34 or more, and is preferably 40 or less, more preferably 38 or less, even more preferably 36 or less in Shore D hardness. If the hardness difference (Hm−Hc) falls within the above range, it is possible to produce a low spin rate on driver shots and high spin rate on iron shots. Further, in the case that the intermediate layer is composed of at least two layers, the hardness difference between the cover and the intermediate layer adjacent to the cover (the outermost intermediate layer) is adjusted to fall within the above range.

In the preferable embodiment A, the intermediate layer preferably has a slab hardness (Hm) of 55 or more, more preferably 60 or more, even more preferably 63 or more, and preferably has a slab hardness (Hm) of 70 or less, more preferably 68 or less, even more preferably 67 or less in Shore D hardness. If the slab hardness of the intermediate layer is 55 or more in Shore D hardness, the degree of outer-hard inner-soft of the golf ball (except the cover) is enhanced, thereby producing a much lower spin rate on driver shots. If the slab hardness of the intermediate layer is 70 or less in Shore D hardness, the approach performance becomes much better.

In the preferable embodiment A, the intermediate layer preferably has a thickness of 0.5 mm or more, more preferably 0.7 mm or more, and even more preferably 0.8 mm or more. If the thickness is 0.5 mm or more, the durability becomes better. The intermediate layer preferably has a thickness of 1.6 mm or less, more preferably 1.3 mm or less, and even more preferably 1.1 mm or less. If the thickness is 1.6 mm or less, it is possible to relatively enlarge a diameter of the spherical core, and thus the resilience of the golf ball improves.

In the preferable embodiment B, the golf ball of the present invention comprises a first intermediate layer disposed outside the spherical core, a second intermediate layer disposed outside the first intermediate layer, and a cover disposed outside the second intermediate layer. The intermediate layers are formed between the spherical core and the cover, and composed of at least two layers having the first intermediate layer and the second intermediate layer. The intermediate layer may have three or more layers. In case of three or more intermediate layers, the intermediate layer disposed on the innermost side of the intermediate layers is referred to as "the first intermediate layer" and the intermediate layer disposed on the outermost side of the intermediate layers is referred to as "the second intermediate layer." The cover is formed as the outermost layer of the golf ball body.

Figure 2:
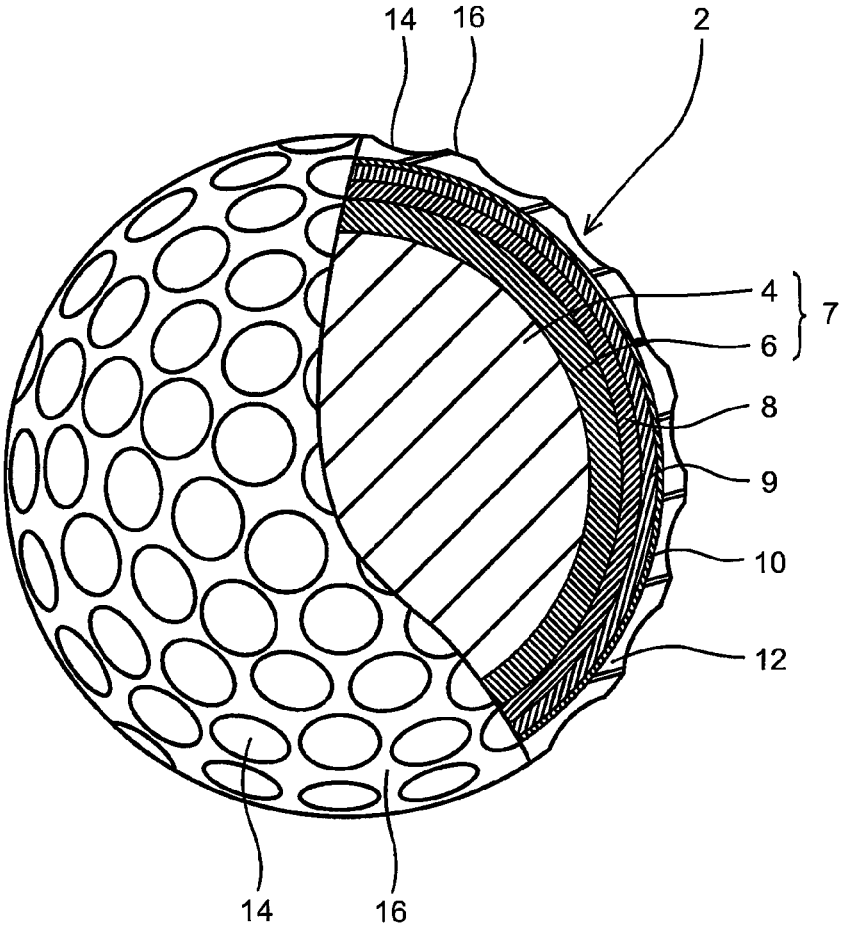
FIG. 2 is a partially cutaway sectional view showing the golf ball according to another preferable embodiment of the present invention.
Figure 3:
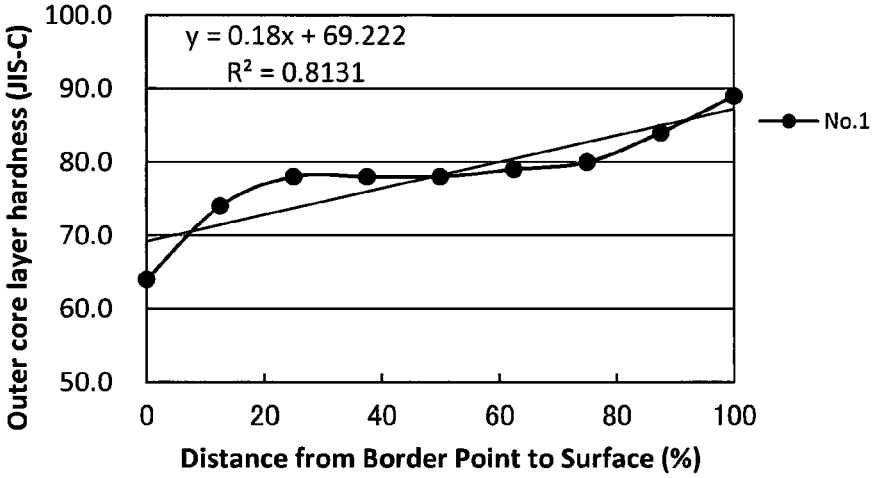
FIG. 3 is a graph showing the hardness distribution of the outer core layer.
Figure 4:
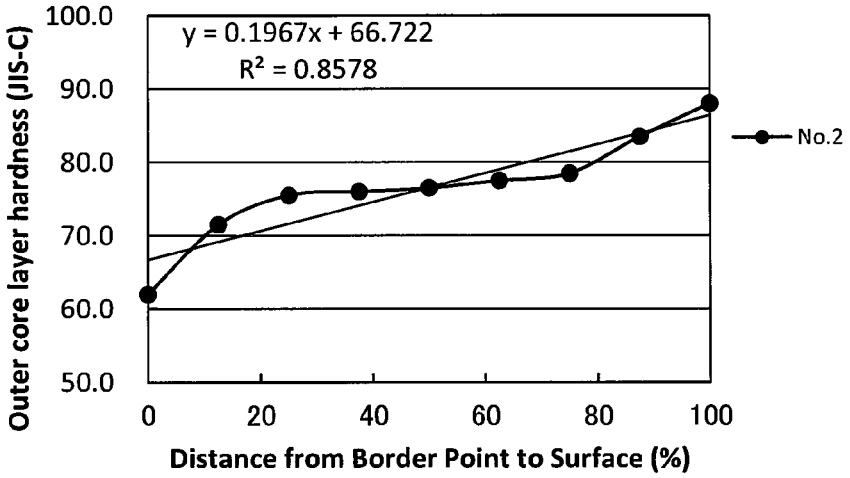
FIG. 4 is a graph showing the hardness distribution of the outer core layer.
Figure 5:
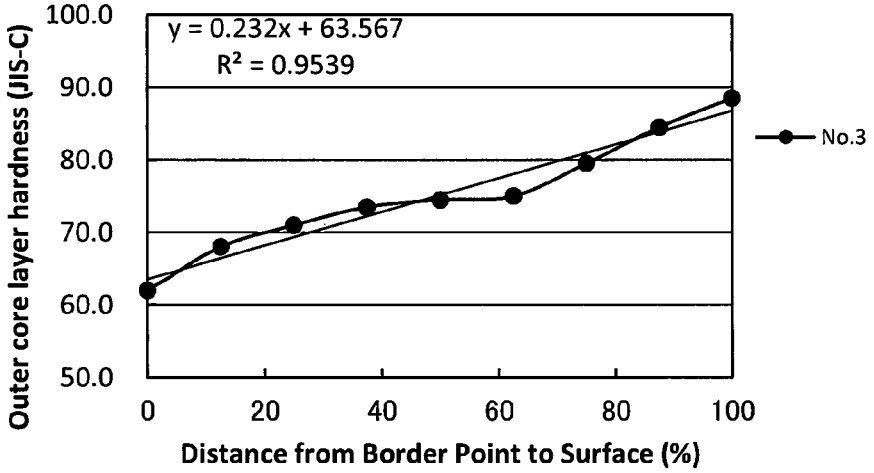
FIG. 5 is a graph showing the hardness distribution of the outer core layer.
Figure 6:
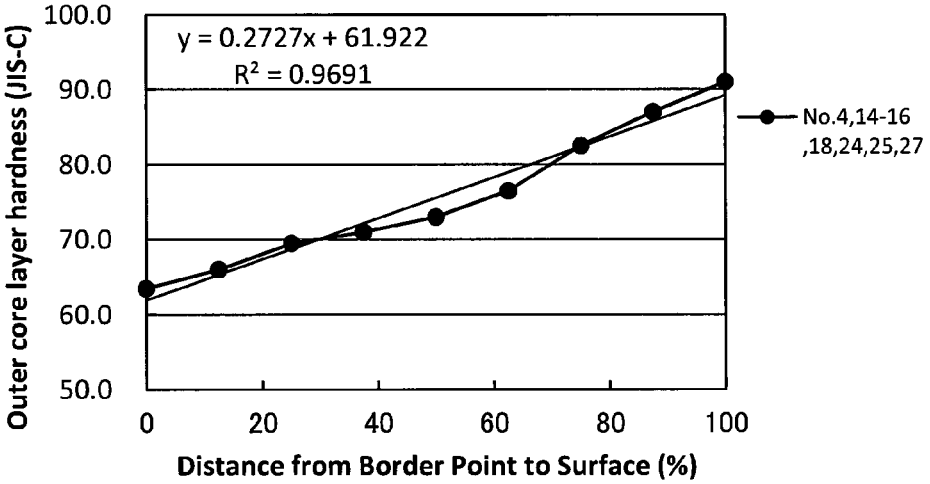
FIG. 6 is a graph showing the hardness distribution of the outer core layer.
Figure 7:
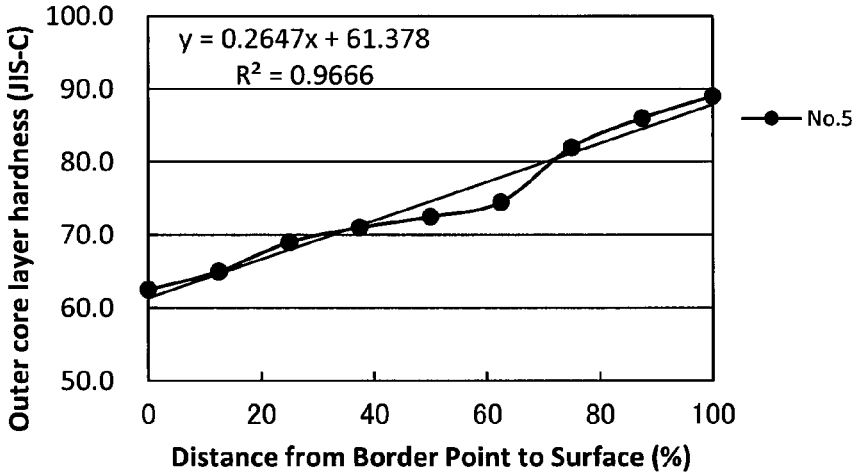
FIG. 7 is a graph showing the hardness distribution of the outer core layer.
Figure 8:
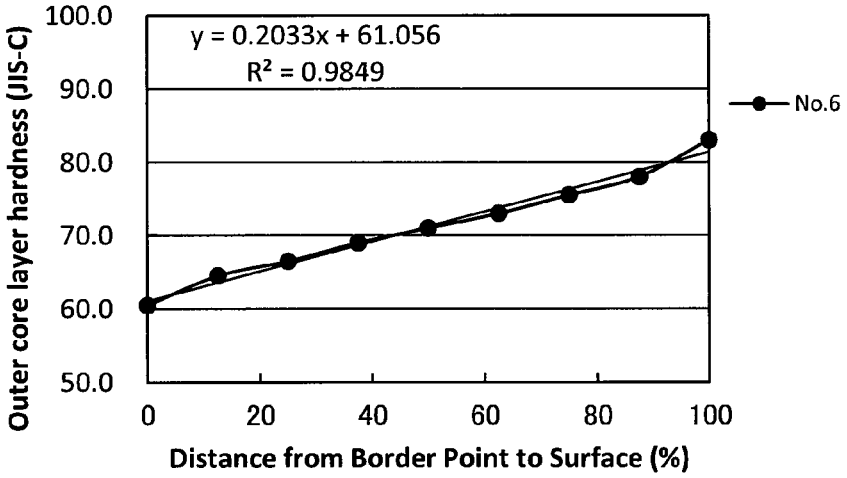
FIG. 8 is a graph showing the hardness distribution of the outer core layer.
Figure 9:
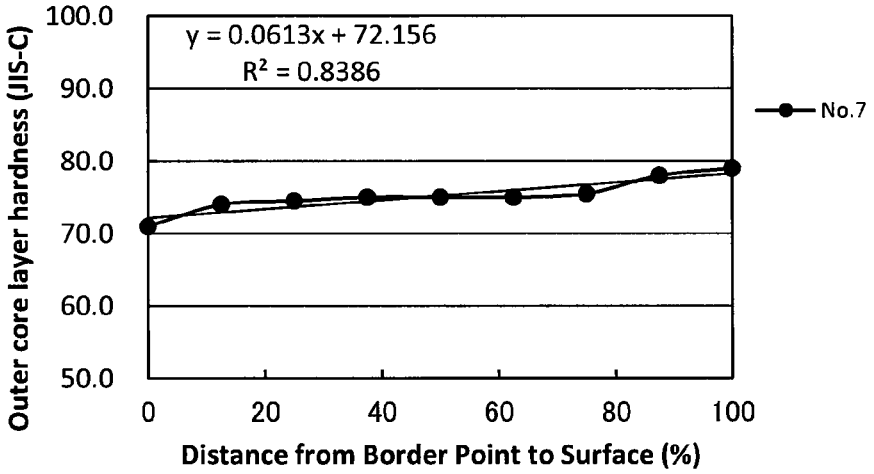
FIG. 9 is a graph showing the hardness distribution of the outer core layer.
Figure 10:
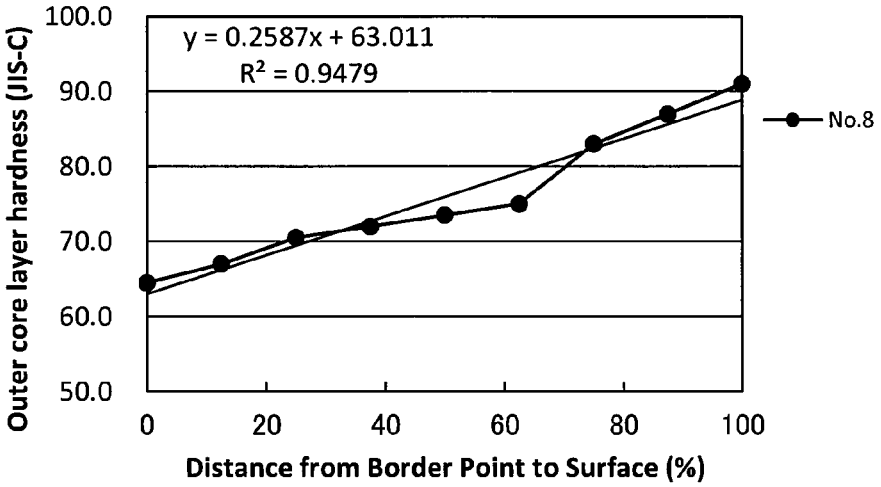
FIG. 10 is a graph showing the hardness distribution of the outer core layer.
Figure 11:
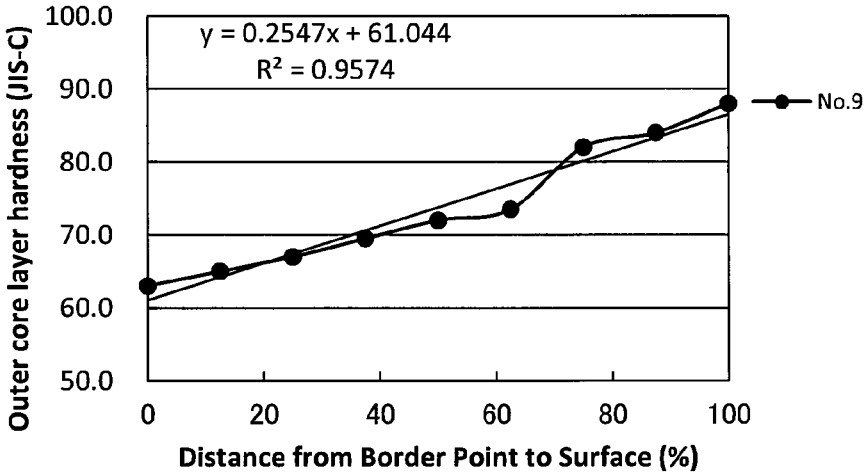
FIG. 11 is a graph showing the hardness distribution of the outer core layer.
Figure 12:
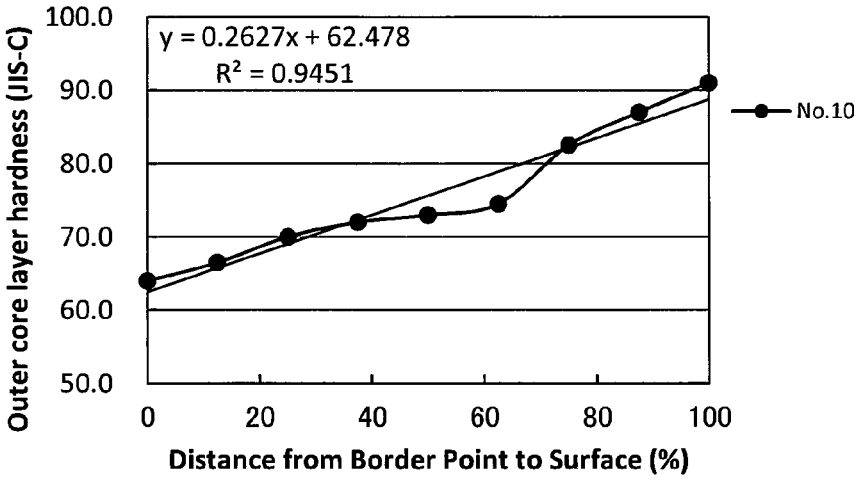
FIG. 12 is a graph showing the hardness distribution of the outer core layer.
Figure 13:
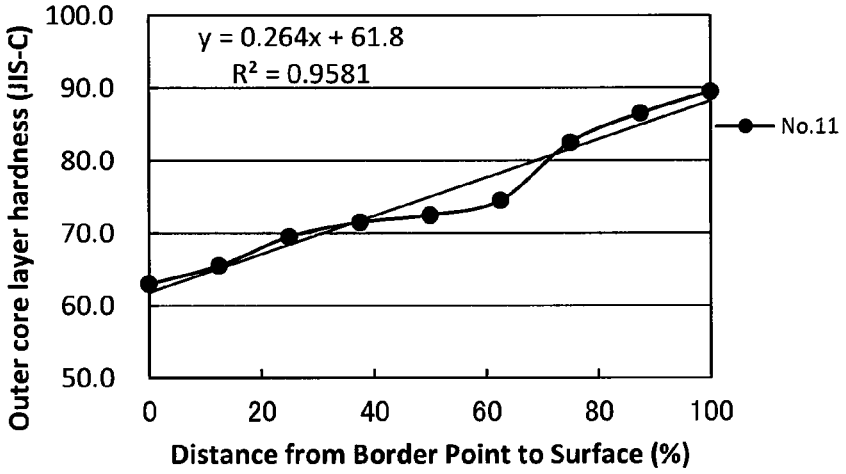
FIG. 13 is a graph showing the hardness distribution of the outer core layer.
Figure 14:
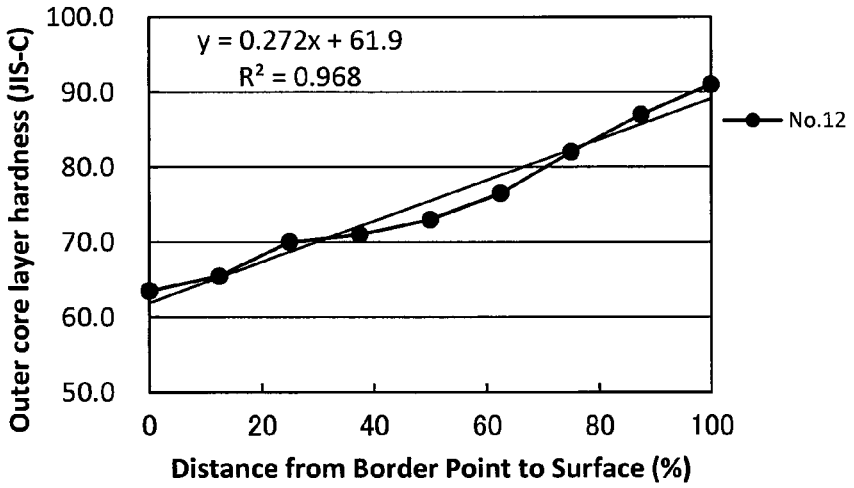
FIG. 14 is a graph showing the hardness distribution of the outer core layer.
Figure 15:
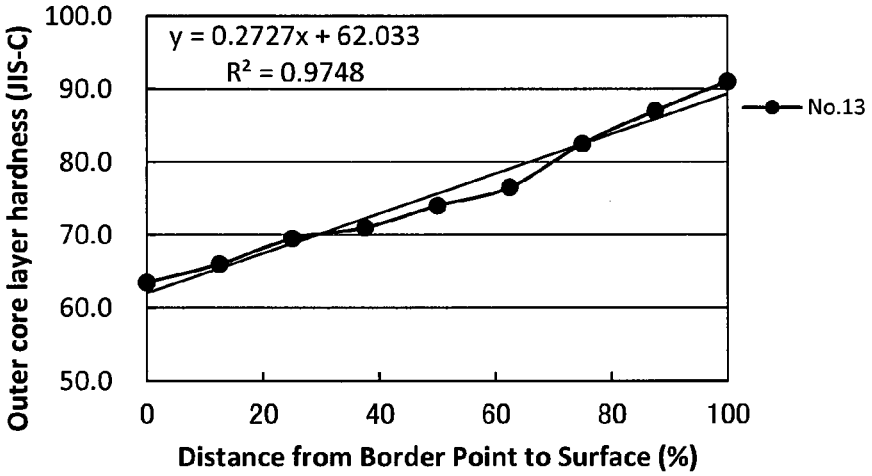
FIG. 15 is a graph showing the hardness distribution of the outer core layer.
Figure 16:
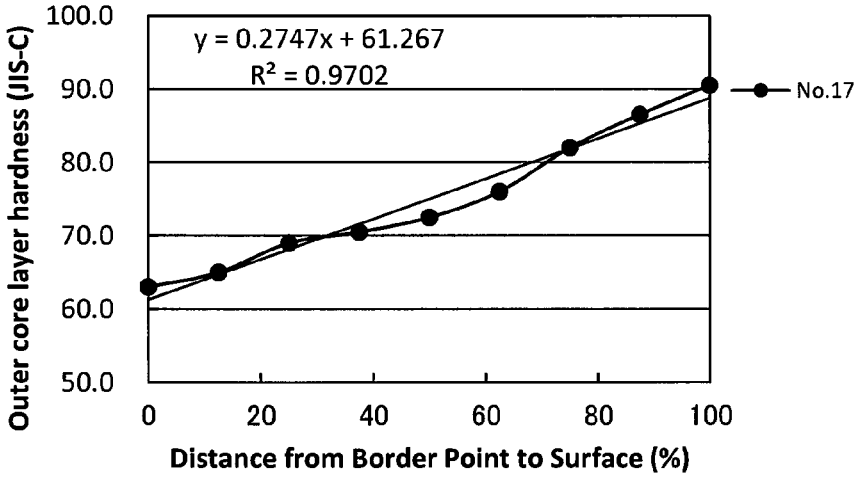
FIG. 16 is a graph showing the hardness distribution of the outer core layer.
Figure 17:
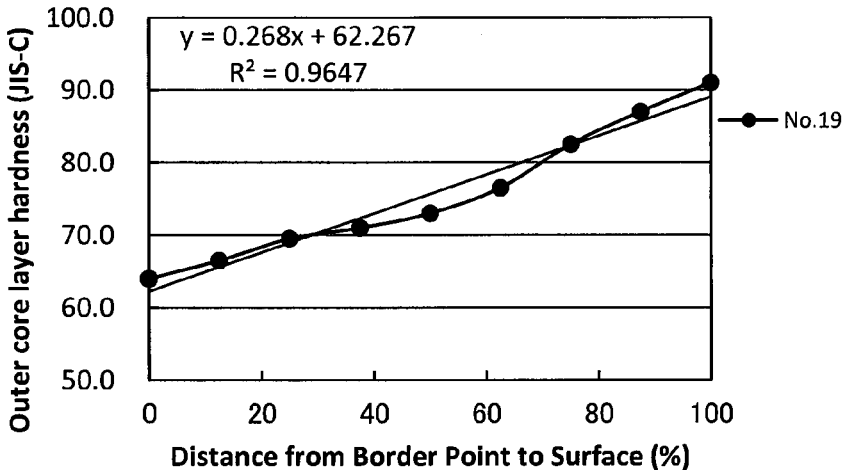
FIG. 17 is a graph showing the hardness distribution of the outer core layer.
Figure 18:
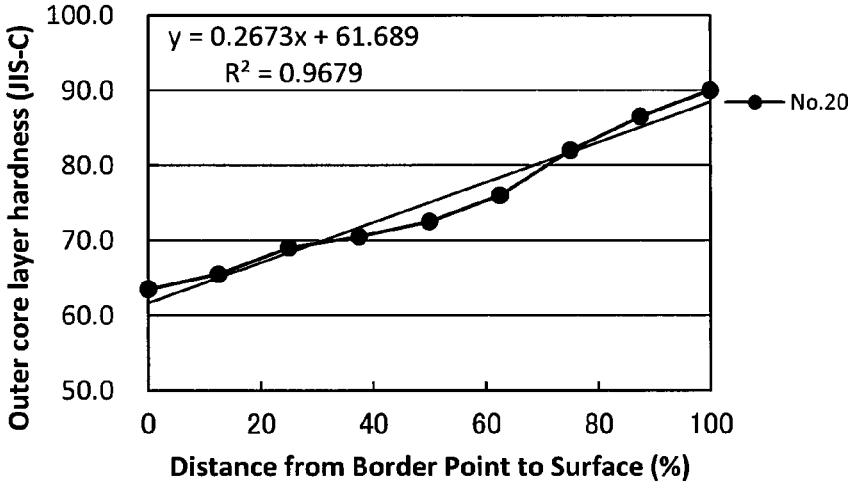
FIG. 18 is a graph showing the hardness distribution of the outer core layer.
Figure 19:
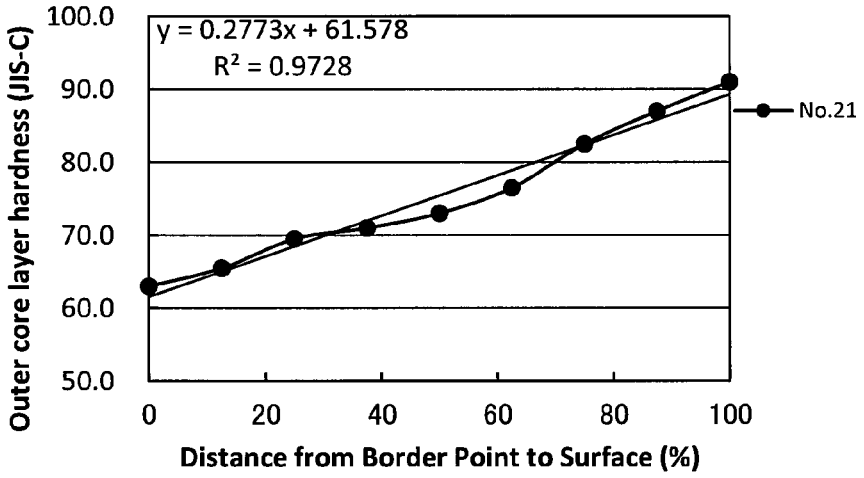
FIG. 19 is a graph showing the hardness distribution of the outer core layer.
Figure 20:
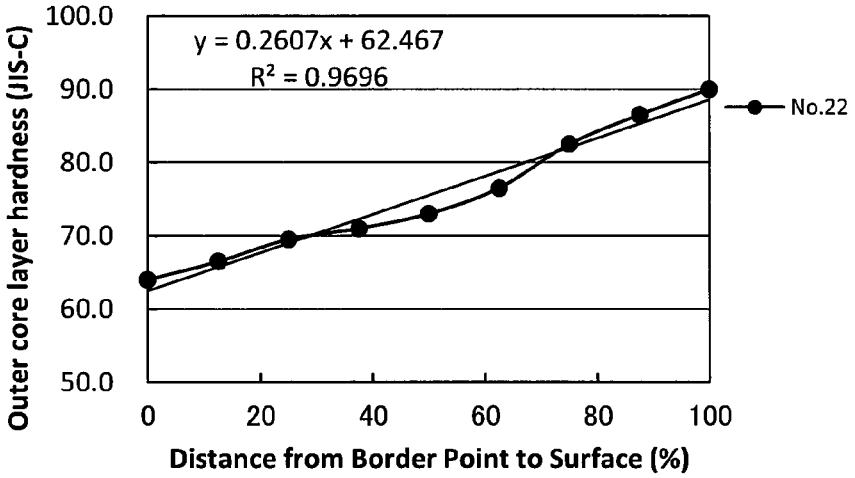
FIG. 20 is a graph showing the hardness distribution of the outer core layer.
Figure 21:
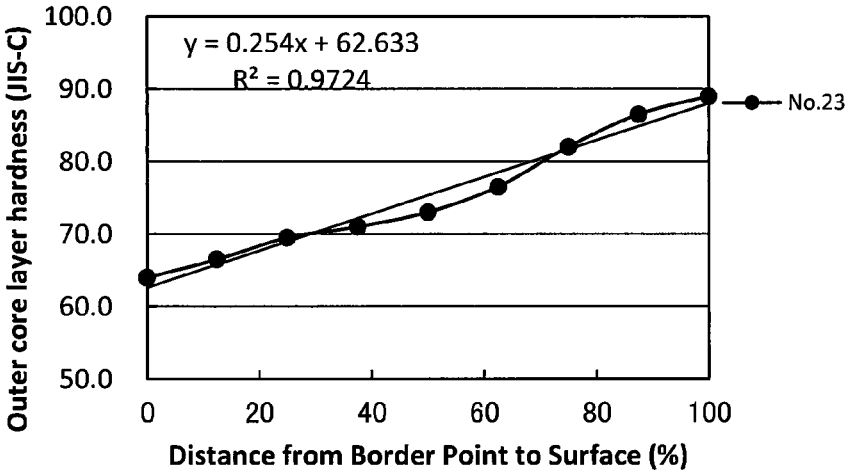
FIG. 21 is a graph showing the hardness distribution of the outer core layer.
Figure 22:
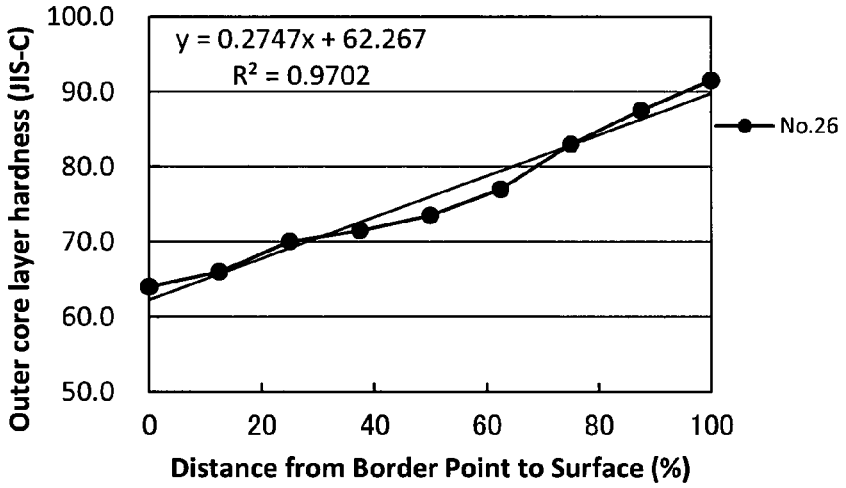
FIG. 22 is a graph showing the hardness distribution of the outer core layer.
Figure 23:
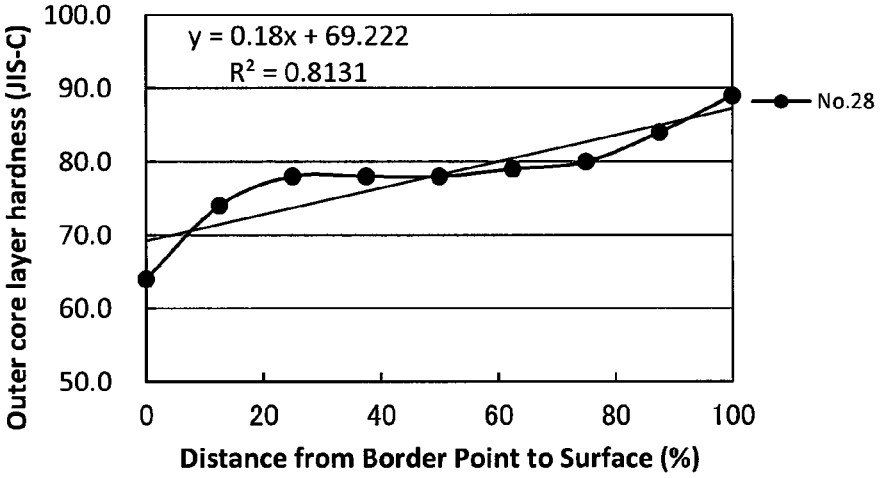
FIG. 23 is a graph showing the hardness distribution of the outer core layer.
Figure 24:
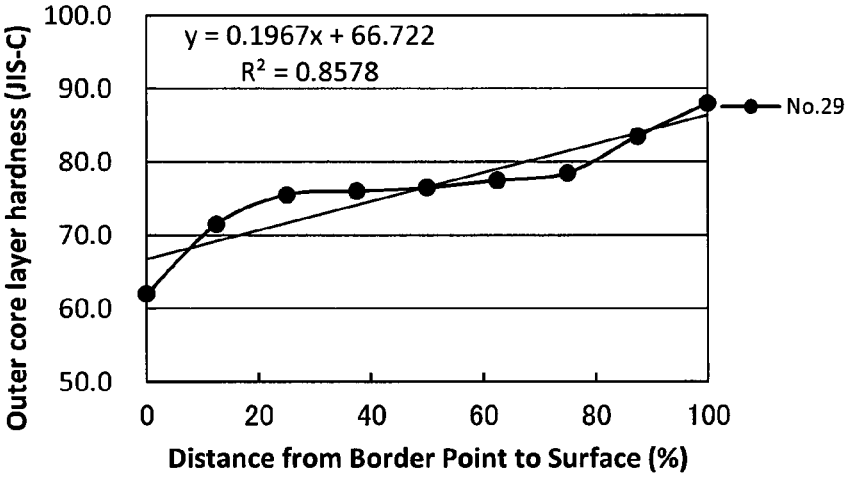
FIG. 24 is a graph showing the hardness distribution of the outer core layer.
Figure 25:
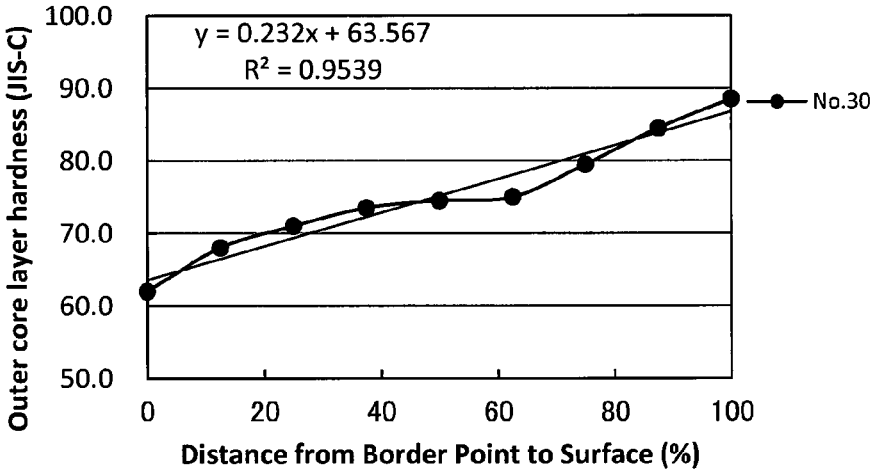
FIG. 25 is a graph showing the hardness distribution of the outer core layer.
Figure 26:
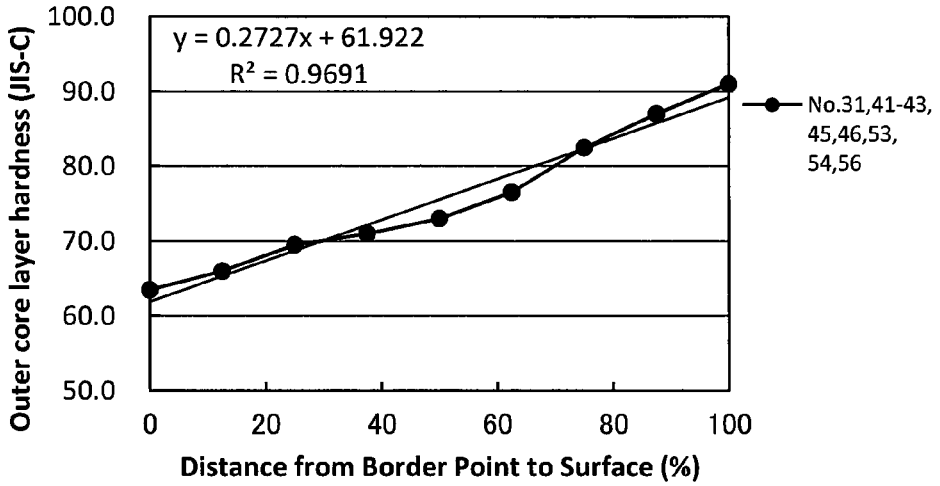
FIG. 26 is a graph showing the hardness distribution of the outer core layer.
Figure 27:
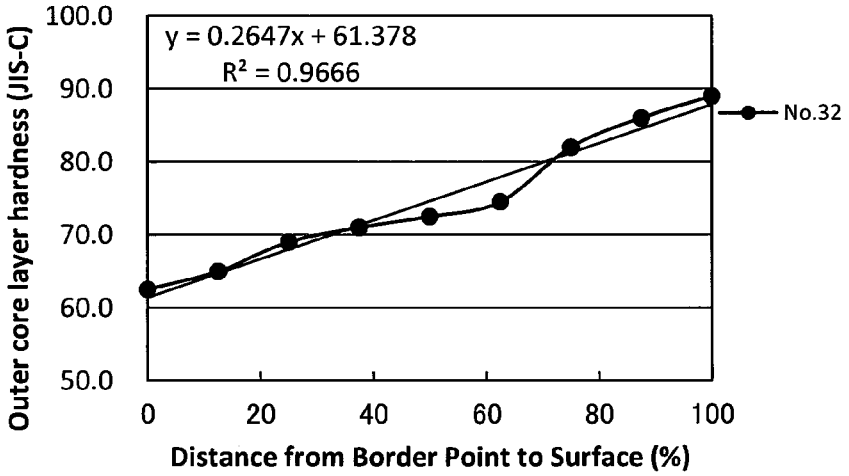
FIG. 27 is a graph showing the hardness distribution of the outer core layer.
Figure 28:
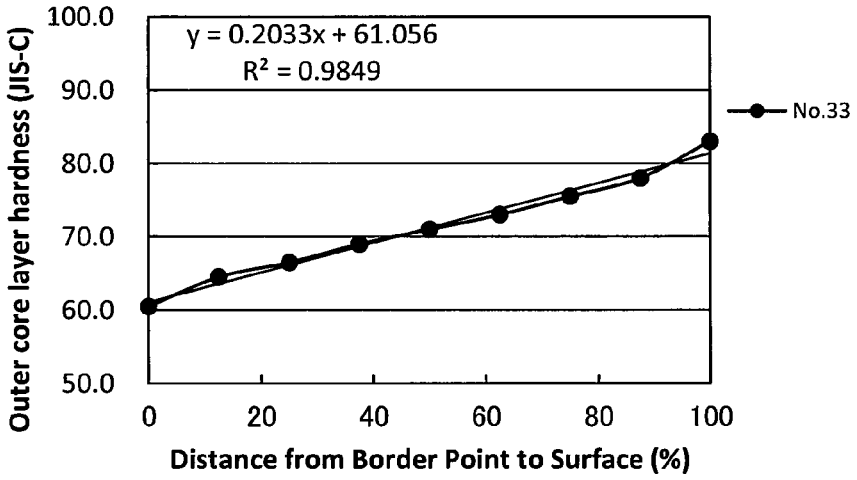
FIG. 28 is a graph showing the hardness distribution of the outer core layer.
Figure 29:
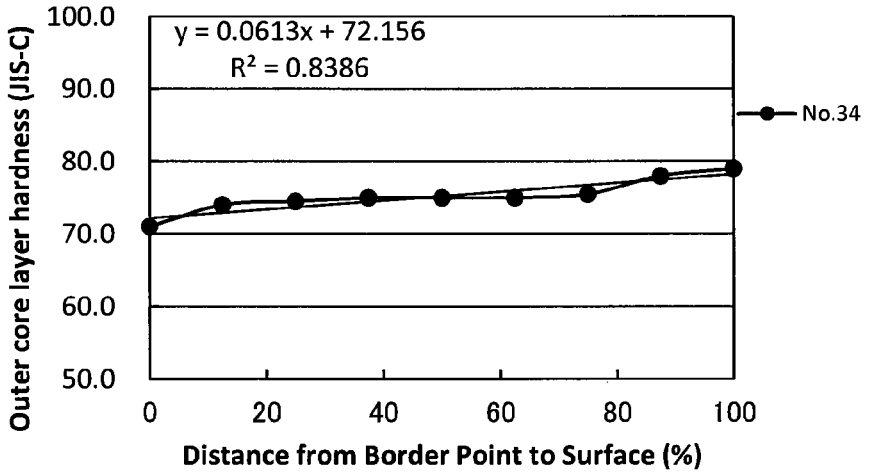
FIG. 29 is a graph showing the hardness distribution of the outer core layer.
Figure 30:
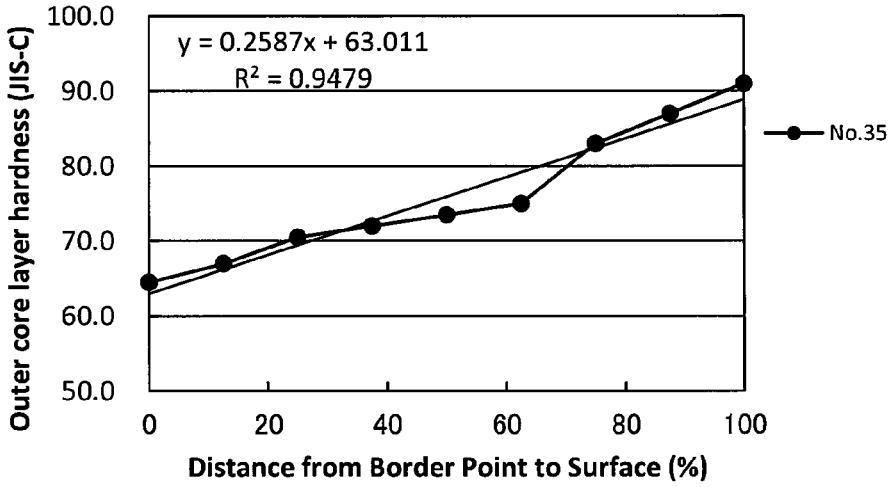
FIG. 30 is a graph showing the hardness distribution of the outer core layer.
Figure 31:
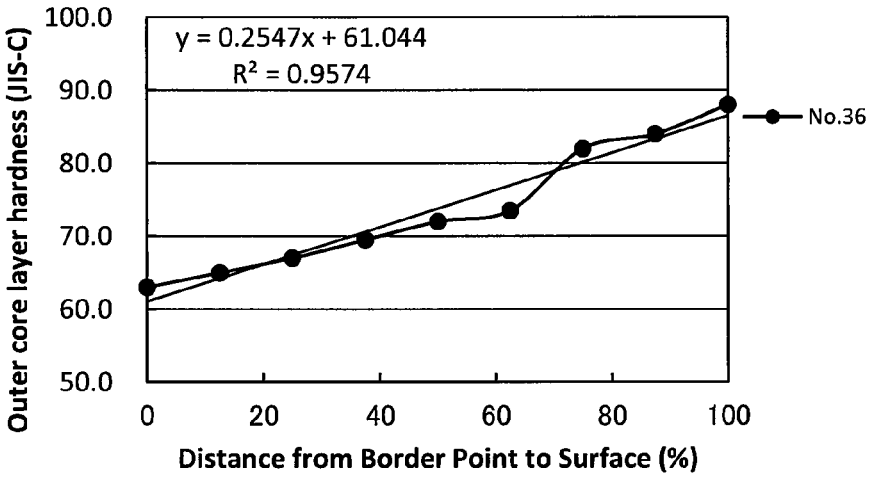
FIG. 31 is a graph showing the hardness distribution of the outer core layer.
Figure 32:
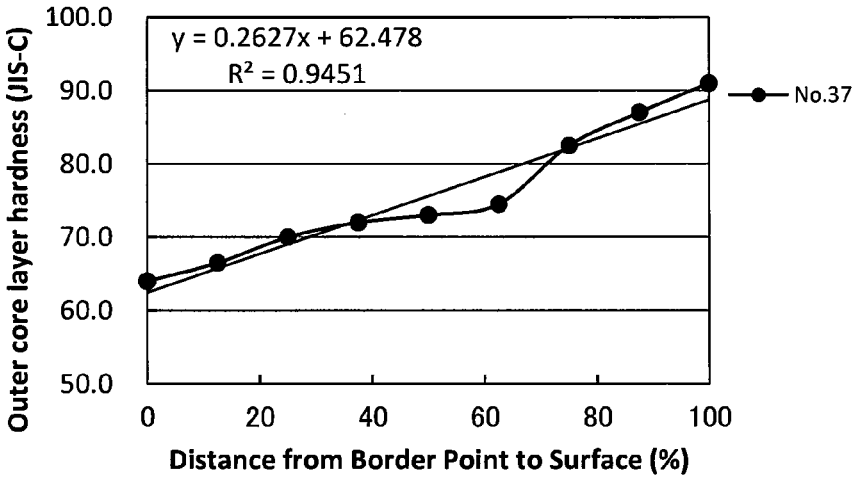
FIG. 32 is a graph showing the hardness distribution of the outer core layer.
Figure 33:
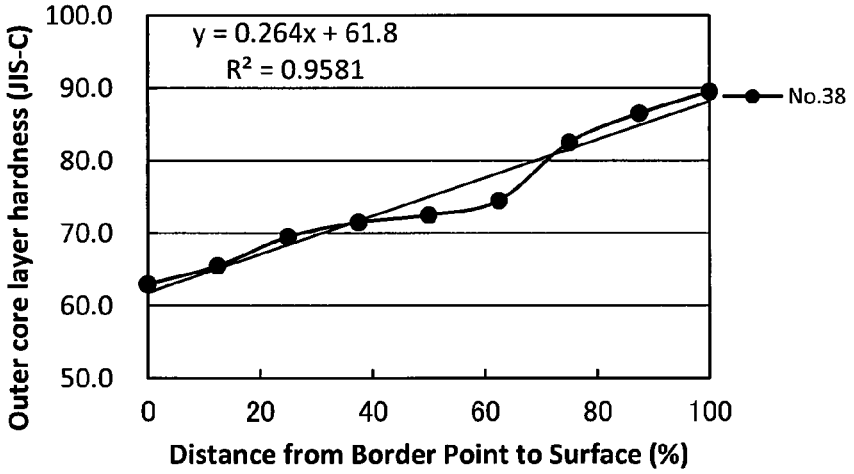
FIG. 33 is a graph showing the hardness distribution of the outer core layer.
Figure 34:
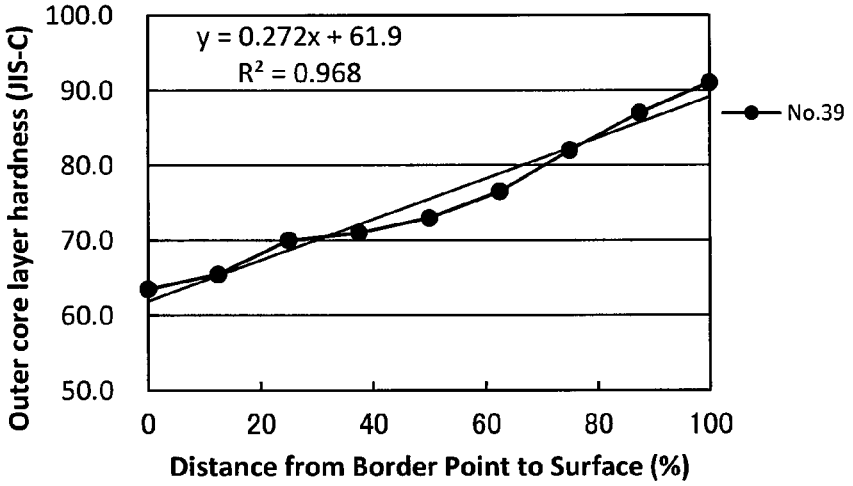
FIG. 34 is a graph showing the hardness distribution of the outer core layer.
Figure 35:
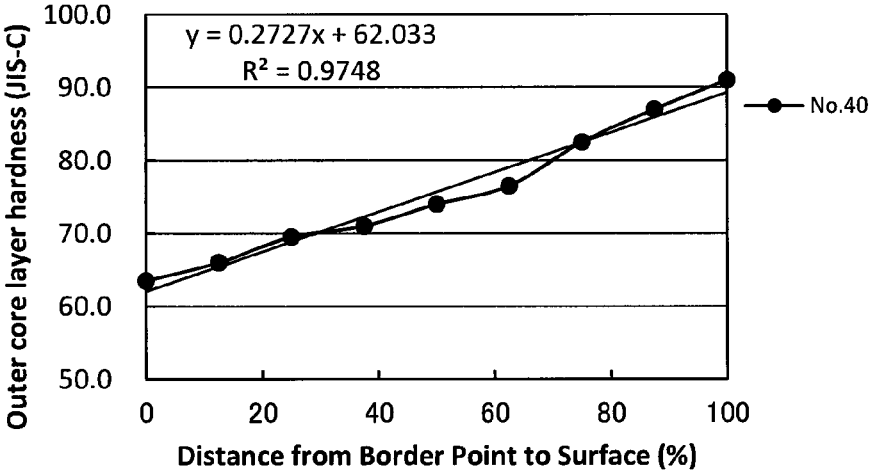
FIG. 35 is a graph showing the hardness distribution of the outer core layer.
Figure 36:
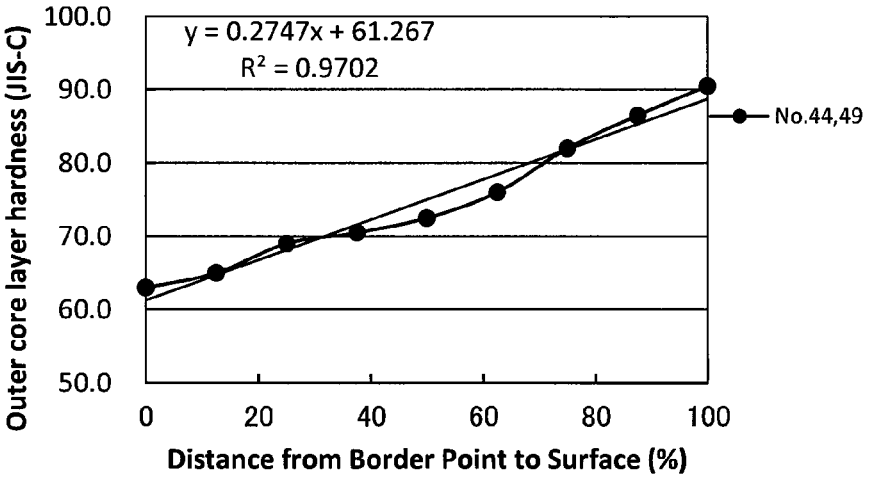
FIG. 36 is a graph showing the hardness distribution of the outer core layer.
Figure 37:
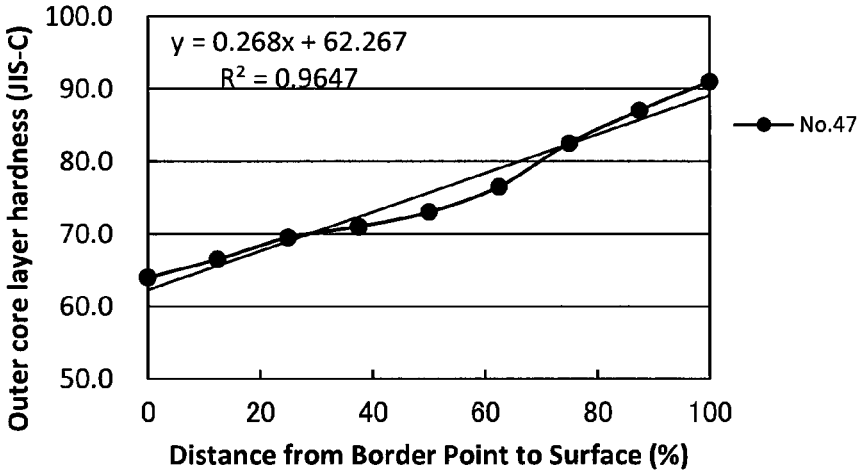
FIG. 37 is a graph showing the hardness distribution of the outer core layer.
Figure 38:
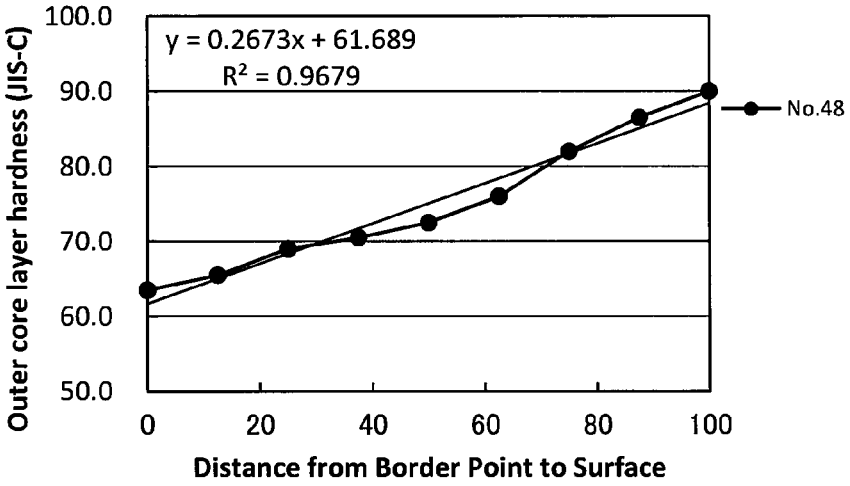
FIG. 38 is a graph showing the hardness distribution of the outer core layer.
Figure 39:
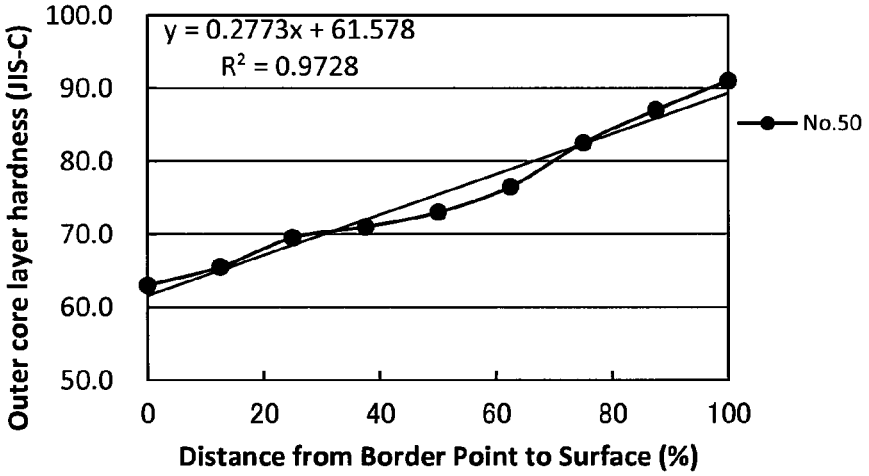
FIG. 39 is a graph showing the hardness distribution of the outer core layer.
Figure 40:
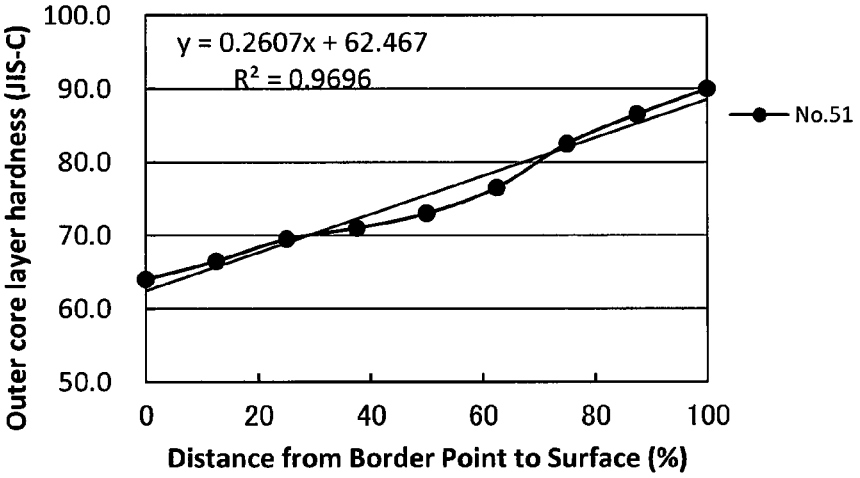
FIG. 40 is a graph showing the hardness distribution of the outer core layer.
Figure 41:
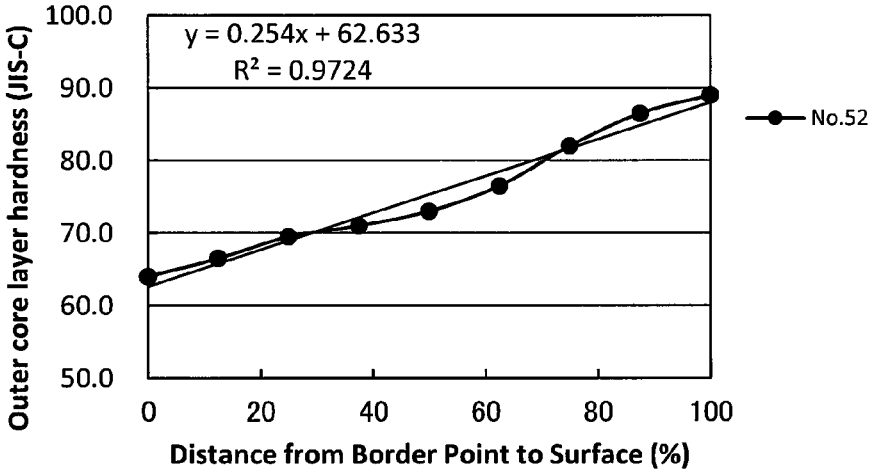
FIG. 41 is a graph showing the hardness distribution of the outer core layer.
Figure 42:
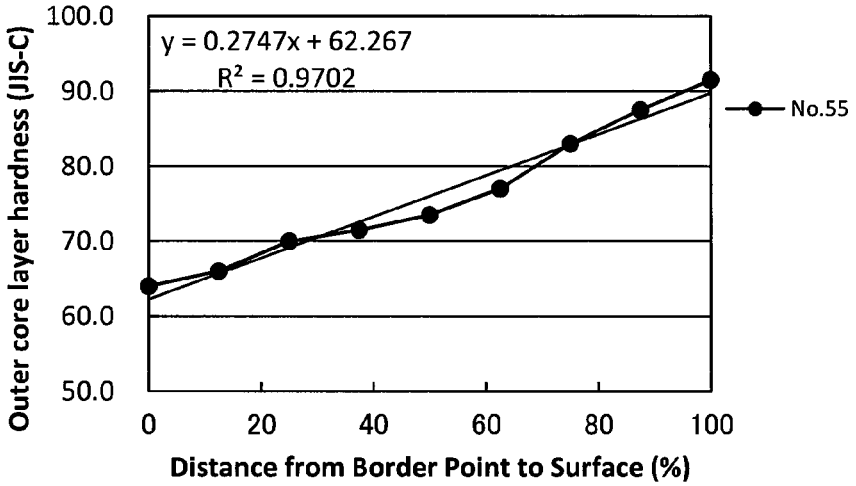
FIG. 42 is a graph showing the hardness distribution of the outer core layer.

FIG. 2 is a partially cutaway sectional view showing the golf ball 2 according to the preferable embodiment B of the present invention. The golf ball 2 comprises a spherical core 7 composed of a spherical inner core 4 and an outer core layer 6 disposed outside the spherical inner core 4, a first intermediate layer 8 disposed outside the spherical core 7, and a second intermediate layer 9 disposed outside the first intermediate layer 8, and a cover 12 disposed outside the second intermediate layer 9. A reinforcing layer 10 may be disposed between the second intermediate layer 9 and the cover 12 in order to improve adhesion between the second intermediate layer 9 and the cover 12. A plurality of dimples 14 are formed on a surface of the cover 12. Other portions than dimples 14 on the surface of the cover 12 are referred to as "land 16". The golf ball 2 is provided with a paint layer and a mark layer outside the cover, but these layers are not depicted.

The hardness difference (Hm2−Hm1) between the slab hardness (Hm1) of the first intermediate layer and the slab hardness (Hm2) of the second intermediate layer is preferably 8 or more, more preferably 14 or more, even more preferably 16 or more, and is preferably 35 or less, more preferably 30 or less, even more preferably 25 or less in Shore D hardness. If the hardness difference (Hm2−Hm1) falls within the above range, since the degree of outer-hard inner-soft of the golf ball (except the cover) is enhanced, it is possible to produce a lower spin rate on driver shots. Further, the spin rate on approach shots increases, and thus the approach performance is enhanced.

In the preferable embodiment B, the first intermediate layer preferably has a slab hardness (Hm1) of 30 or more, more preferably 40 or more, even more preferably 45 or more, and preferably has a slab hardness (Hm1) of 60 or less, more preferably 54 or less, even more preferably 52 or less in Shore D hardness. If the slab hardness of the first intermediate layer is 30 or more in Shore D hardness, it is possible to lower the spin rate on driver shots. If the slab hardness of the first intermediate layer is 60 or less in Shore D hardness, the approach performance becomes much better.

In the preferable embodiment B, the second intermediate layer preferably has a slab hardness (Hm2) of 55 or more, more preferably 60 or more, even more preferably 63 or more, and preferably has a slab hardness (Hm2) of 70 or less, more preferably 68 or less, even more preferably 67 or less in Shore D hardness. If the slab hardness of the second intermediate layer is 55 or more in Shore D hardness, the degree of outer-hard inner-soft of the golf ball (except the cover) is enhanced, thereby producing a much lower spin rate on driver shots. If the slab hardness of the second intermediate layer is 70 or less in Shore D hardness, the approach performance becomes much better.

In case of three or more intermediate layers in the preferable embodiment B of the present invention, the hardness of the intermediate layer disposed between the first intermediate layer and the second intermediate layer is preferably higher than the hardness of the first intermediate layer and is preferably lower than the hardness of the second intermediate layer. Further, the hardness of the intermediate layers is preferably designed as follows. The first intermediate layer has the lowest hardness, the intermediate layers disposed outside the first intermediate layer have the hardness which gradually increases from the inside to the outside, and the second intermediate layer has the highest hardness.

In the preferable embodiment B, the first and second intermediate layers preferably have a thickness of 0.5 mm or more, more preferably 0.7 mm or more, and even more preferably 0.8 mm or more, respectively. If the thickness of the first and second intermediate layers is 0.5 mm or more, the durability becomes better. The first and second intermediate layers preferably have a thickness of 1.5 mm or less, more preferably 1.2 mm or less, and even more preferably 1.1 mm or less, respectively. If the thickness of the intermediate layer is 1.5 mm or less, it is possible to relatively enlarge a diameter of the spherical core, and thus the resilience of the golf ball improves.

In the preferable embodiment B, the hardness difference (Hm2−Hc) between the slab hardness (Hm2) of the second intermediate layer and the slab hardness (Hc) of the cover is preferably 30 or more, more preferably 32 or more, even more preferably 34 or more, and is preferably 45 or less, more preferably 42 or less, even more preferably 38 or less in Shore D hardness. If the hardness difference (Hm2−Hc) falls within the above range, it is possible to produce a low spin rate on driver shots and high spin rate on iron shots.

The golf ball of the present invention has a cover disposed outside the intermediate layer.

The cover preferably has a slab hardness (Hc) of 48 or less, more preferably 40 or less, even more preferably 32 or less in Shore D hardness. If the slab hardness of the cover is 48 or less in Shore D hardness, the spin rate on approach shots increases, thereby enhancing controllability. The cover preferably has a slab hardness (Hc) of 20 or more, more preferably 24 or more, even more preferably 28 or more in Shore D hardness. If the slab hardness of the cover is 20 or more in Shore D hardness, the abrasion resistance of the cover improves.

The cover preferably has a thickness of 0.8 mm or less, more preferably 0.7 mm or less, even more preferably 0.6 mm or less. If the thickness is 0.8 mm or less, the spin rate on driver shots is further reduced. The cover preferably has a thickness of 0.1 mm or more, more preferably 0.2 mm or more, and even more preferably 0.3 mm or more. If the cover is too thin, it tends to be difficult to mold the cover.

The concave portions called "dimple" are usually formed on the surface of the cover. The total number of the dimples is preferably 200 or more and 500 or less. If the total number is less than 200, the dimple effect is hardly obtained. On the other hand, if the total number exceeds 500, the dimple effect is hardly obtained because the size of the respective dimples is small. The shape (shape in a plan view) of dimples includes, for example, without limitation, a circle, polygonal shapes such as roughly triangular shape, roughly quadrangular shape, roughly pentagonal shape, roughly hexagonal shape, and another irregular shape. The shape of the dimples is employed solely or at least two of them may be used in combination.

The golf ball of the present invention may have a reinforcing layer between the intermediate layer and the cover. The reinforcing layer adheres firmly to the intermediate layer as well as to the cover. The reinforcing layer suppresses delamination of the cover from the intermediate layer. In particular, when the golf ball with a thin cover is hit with an edge of a clubface, a wrinkle easily generates. The reinforcing layer suppresses the generation of the wrinkle.

From the aspect of suppressing the wrinkle, the reinforcing layer preferably has a thickness of 3 μm or more, and more preferably 5 μm or more. In order to facilitate the formation of the reinforcing layer, the reinforcing layer preferably has a thickness of 15 μm or less, more preferably 12 μm or less, and even more preferably 10 μm or less. The thickness is measured by observing a cross section of the golf ball with a microscope. When the intermediate layer has concavities and convexities on its surface by surface roughening, the thickness of the reinforcing layer is measured at the top of the convex part.

From the aspect of suppressing the wrinkle, the reinforcing layer preferably has a pencil hardness of 4B or harder, and more preferably B or harder. From the aspect of reducing the loss of the power transmission from the cover to the intermediate layer upon a hit of the golf ball, the reinforcing layer preferably has a pencil hardness or 3H or softer. The pencil hardness is measured according to the standard of "JIS K5400".

When the golf ball of the present invention has a diameter in a range from 40 mm to 45 mm, a compression deformation amount of the golf ball (shrinking amount of the golf ball in the compression direction thereof) when applying a load from an initial load of 98 N to a final load of 1275 N to the golf ball is preferably 1.8 mm or more, more preferably 2.0 mm or more, even more preferably 2.2 mm or more, even more preferably 2.3 mm or more, most preferably 2.4 mm or more, and is preferably 3.6 mm or less, more preferably 3.0 mm or less. If the compression deformation amount is 1.8 mm or more, the golf ball does not become excessively hard, and thus exhibits the good shot feeling. On the other hand, if the compression deformation amount is 3.6 mm or less, the resilience is enhanced.

It is preferred that a paint film is formed on a surface of the golf ball body. The paint film preferably has a thickness of, but not limited to, 5 μm or more, and more preferably 7 μm or more, and preferably has a thickness of 50 μm or less, and more preferably 40 μm or less, even more preferably 30 μm or less. If the thickness is less than 5 μm, the paint film is easy to wear off due to continued use of the golf ball, and if the thickness is more than 50 μm, the effect of the dimples is reduced, resulting in lowering flying performance of the golf ball.

(2) Outer Core Layer Rubber Composition

The outer core layer of the golf ball of the present invention is preferably formed from an outer core layer rubber composition containing (a) a base rubber, (b1) an α,β-unsaturated carboxylic acid having 3 to 8 carbon atoms and/or (b2) a metal salt of the α,β-unsaturated carboxylic acid having 3 to 8 carbon atoms as (b) a co-crosslinking agent, (c) a crosslinking initiator, and (d) an acid and/or a salt thereof. The outer core layer formed from the above rubber composition tends to have a hardness distribution where the hardness increases linearly or almost linearly from a boundary point between the inner core layer and the outer core layer toward the surface of the outer core layer.

The reason why the outer core layer formed from the above rubber composition has the hardness distribution where the hardness increases linearly or almost linearly from the boundary point between the outer core layer and the inner core layer toward the surface of the outer core layer is considered as follows. When molding the outer core layer, the internal temperature of the outer core layer is high at the inside of the outer core layer and decreases toward the surface of the outer core layer, since reaction heat from a crosslinking reaction of the base rubber accumulates at the inside of the outer core layer. (d) The acid and/or the salt thereof reacts with (b) the metal salt of the α,β-unsaturated carboxylic acid having 3 to 8 carbon atoms, when molding the outer core layer. That is, (d) the acid and/or the salt thereof exchanges the cation with the metal salt of the α,β-unsaturated carboxylic acid having 3 to 8 carbon atoms, thereby breaking a metal crosslinking by the metal salt of the α,β-unsaturated carboxylic acid having 3 to 8 carbons atoms. This cation exchange reaction readily occurs at the inside of the outer core layer where the temperature is high, and less occurs toward the surface of the outer core layer. In other words, the breaking of the metal crosslinking readily occurs at the inside of the outer core layer, but less occurs toward the surface of the outer core layer. As a result, it is conceivable that since a crosslinking density in the outer core layer increases from the boundary point between the outer core layer and inner core layer toward the surface of the outer core layer, the hardness of the outer core layer increases linearly or almost linearly from the boundary point between the outer core layer and the inner core layer toward the surface of the outer core layer. In addition, by using (e) the organic sulfur compound together with (d) the acid and/or the salt thereof, the slope of the hardness distribution can be controlled, and the degree of the outer-hard and inner-soft structure of the core can be further enhanced.

As (a) the base rubber used in the present invention, natural rubber and/or synthetic rubber can be used. For example, polybutadiene rubber, natural rubber, polyisoprene rubber, styrene polybutadiene rubber, ethylene-propylene-diene rubber (EPDM), or the like can be used. These rubbers may be used solely or two or more of these rubbers may be used in combination. Among them, typically preferred is the high cis-polybutadiene having a cis-1,4 bond in a proportion of 40% or more, more preferably 80% or more, even more preferably 90% or more in view of its superior resilience property.

The high-cis polybutadiene preferably has a 1,2-vinyl bond in a content of 2 mass % or less, more preferably 1.7 mass % or less, and even more preferably 1.5 mass % or less. If the content of 1,2-vinyl bond is excessively high, the resilience may be lowered.

The high-cis polybutadiene preferably includes one synthesized using a rare earth element catalyst. When a neodymium catalyst, which employs a neodymium compound of a lanthanum series rare earth element compound, is used, a polybutadiene rubber having a high content of a cis-1,4 bond and a low content of a 1,2-vinyl bond is obtained with excellent polymerization activity. Such a polybutadiene rubber is particularly preferred.

The high-cis polybutadiene preferably has a Mooney viscosity ($ML_{1+4}$ (100° C.)) of 30 or more, more preferably 32 or more, even more preferably 35 or more, and preferably has a Mooney viscosity ($ML_{1+4}$ (100° C.)) of 140 or less, more preferably 120 or less, even more preferably 100 or less, and most preferably 80 or less. It is noted that the Mooney viscosity ($ML_{1+4}$ (100° C.)) in the present invention is a value measured according to JIS K6300 using an L rotor under the conditions of: a preheating time of 1 minute; a rotor revolution time of 4 minutes; and a temperature of 100° C.

The high-cis polybutadiene preferably has a molecular weight distribution Mw/Mn (Mw: weight average molecular weight, Mn: number average molecular weight) of 2.0 or more, more preferably 2.2 or more, even more preferably 2.4 or more, and most preferably 2.6 or more, and preferably has a molecular weight distribution Mw/Mn of 6.0 or less, more preferably 5.0 or less, even more preferably 4.0 or less, and most preferably 3.4 or less. If the molecular weight distribution (Mw/Mn) of the high-cis polybutadiene is excessively low, the processability may deteriorate. If the molecular weight distribution (Mw/Mn) of the high-cis polybutadiene is excessively high, the resilience may be lowered. It is noted that the measurement of the molecular weight distribution is conducted by gel permeation chromatography ("HLC-8120GPC", manufactured by Tosoh Corporation) using a differential refractometer as a detector under the conditions of column: GMHHXL (manufactured by Tosoh Corporation), column temperature: 40° C., and mobile phase: tetrahydrofuran, and calculated by converting based on polystyrene standard.

Next, (b) the co-crosslinking agent will be described. (b) The co-crosslinking agent includes (b1) an α,β-unsaturated carboxylic acid having 3 to 8 carbon atoms and/or (b2) a metal salt of the α,β-unsaturated carboxylic acid having 3 to 8 carbon atoms. Hereinafter, (b1) the α,β-unsaturated carboxylic acid having 3 to 8 carbon atoms and/or (b2) the metal salt thereof sometimes may be merely referred to as "(b) an α,β-unsaturated carboxylic acid having 3 to 8 carbon atoms and/or a metal salt thereof".

(b) The α,β-unsaturated carboxylic acid having 3 to 8 carbon atoms and/or a metal salt thereof is blended as a co-crosslinking agent in the rubber composition and has an action of crosslinking a rubber molecule by graft polymerization to a base rubber molecular chain. In the case that the rubber composition used in the present invention contains only (b1) the α,β-unsaturated carboxylic acid having 3 to 8 carbon atoms as the co-crosslinking agent, the rubber composition preferably contains (f) a metal compound which will be described later. Neutralizing (b1) the α,β-unsaturated carboxylic acid having 3 to 8 carbon atoms with (f) the metal compound in the rubber composition provides substantially the same effect as using the metal salt of the α,β-unsaturated carboxylic acid having 3 to 8 carbon atoms as the co-crosslinking agent. Further, in the case of using (b1) the α,β-unsaturated carboxylic acid having 3 to 8 carbon atoms and (b2) the metal salt thereof in combination, (f) the metal compound may be used.

(b1) The α,β-unsaturated carboxylic acid having 3 to 8 carbon atoms includes, for example, acrylic acid, methacrylic acid, fumaric acid, maleic acid, crotonic acid, and the like.

Examples of the metals constituting (b2) the metal salts of the α,β-unsaturated carboxylic acid having 3 to 8 carbon atoms include: monovalent metal ions such as sodium, potassium, lithium or the like; divalent metal ions such as magnesium, calcium, zinc, barium, cadmium or the like; trivalent metal ions such as aluminum ion or the like; and other metal ions such as tin, zirconium or the like. The above metal ions can be used solely or as a mixture of at least two of them. Among these metal ions, divalent metal ions such as magnesium, calcium, zinc, barium, cadmium or the like are preferable. Use of the divalent metal salts of the α,β-unsaturated carboxylic acid having 3 to 8 carbon atoms easily generates a metal crosslinking between the rubber molecules. Especially, as the divalent metal sat, zinc acrylate is preferable, because zinc acrylate enhances the resilience of the resultant golf ball. (b) The α,β-unsaturated carboxylic acid having 3 to 8 carbon atoms and/or a metal salt thereof may be used solely or in combination at least two of them.

The content of (b) the α,β-unsaturated carboxylic acid having 3 to 8 carbon atoms and/or the metal salt thereof is preferably 15 parts by mass or more, more preferably 20 parts by mass or more, and is preferably 50 parts by mass or less, more preferably 45 parts by mass or less, even more preferably 40 parts by mass or less, with respect to 100 parts by mass of (a) the base rubber. If the content of (b) the α,β-unsaturated carboxylic acid having 3 to 8 carbon atoms and/or the metal salt thereof is less than 15 parts by mass, the content of (c) the crosslinking initiator which will be described below must be increased in order to obtain the appropriate hardness of the constituting member formed from the rubber composition, which tends to cause the lower resilience. On the other hand, if the content of (b) the α,β-unsaturated carboxylic acid having 3 to 8 carbon atoms and/or the metal salt thereof exceeds 50 parts by mass, the constituting member formed from the rubber composition becomes excessively hard, which may cause the lower shot feeling.

(c) The crosslinking initiator is blended in order to crosslink (a) the base rubber component. As (c) the crosslinking initiator, an organic peroxide is preferred. Specific examples of the organic peroxide include organic peroxides such as dicumyl peroxide, 1,1-bis(t-butylperoxy)-3,3,5-trimethylcyclohexane, 2,5-dimethyl-2,5-di(t-butylperoxy)hexane, and di-t-butyl peroxide. These organic peroxides may be used solely or two or more of these organic peroxides may be used in combination. Among them, dicumyl peroxide is preferably used.

The content of (c) the crosslinking initiator is preferably 0.2 part by mass or more, and more preferably 0.5 part by mass or more, and is preferably 5.0 parts by mass or less, and more preferably 2.5 parts by mass or less, with respect to 100 parts by mass of (a) the base rubber. If the content of (c) the crosslinking initiator is less than 0.2 part by mass, the constituting member formed from the rubber composition becomes too soft, and thus the golf ball may have the lower resilience. If the content of (c) the crosslinking initiator exceeds 5.0 parts by mass, the amount of (b) the co-crosslinking agent must be decreased in order to obtain the appropriate hardness of the constituting member formed from the rubber composition, resulting in the insufficient resilience and lower durability of the golf ball.

Next, (d) the acid and/or the salt thereof will be described. It is considered that (d) the acid and/or the salt thereof has an action of breaking the metal crosslinking by the metal salt of (b) the α,β-unsaturated carboxylic acid having 3 to 8 carbon atoms in the outer core layer, when molding the outer core layer.

(d) The acid and/or the salt thereof may include any one of an aliphatic acid and/or a salt thereof and an aromatic acid and/or a salt thereof, as long as it exchanges the cation component with the metal salt of the α,β-unsaturated carboxylic acid having 3 to 8 carbon atoms. As (d) the acid and/or the salt thereof, for example, preferred is a protonic acid and/or a salt thereof. The protonic acid includes oxo acids such as a carboxylic acid, a sulfonic acid, and a phosphoric acid; and hydroacids such as hydrochloric acid, hydrofluoric acid or the like. Preferred of the acids is an oxo acid, more preferred is a carboxylic acid. That is, (d) the acid and/or the salt thereof preferably includes a carboxylic acid and/or a salt thereof.

(d) The acid and/or the salt thereof may include any one of an aliphatic carboxylic acid (sometimes may be merely referred to as "fatty acid" in the present invention) and/or a salt thereof and an aromatic carboxylic acid and/or a salt thereof, and preferred is the aliphatic carboxylic acid and/or the salt thereof. (d) The carboxylic acid and/or the salt thereof preferably includes a carboxylic acid having 1 to 30 carbon atoms and/or a salt thereof, more preferably a carboxylic acid having 4 to 30 carbon atoms and/or a salt thereof, and even more preferably a carboxylic acid having 5 to 25 carbon atoms and/or a salt thereof. (d) The carboxylic acid and/or the salt thereof does not include (b) the α,β-unsaturated carboxylic acid having 3 to 8 carbon atoms and/or the metal salt thereof used as the co-crosslinking agent.

The fatty acid may be either a saturated fatty acid or an unsaturated fatty acid; however, a saturated fatty acid is preferable. Specific examples of the saturated fatty acids (IUPAC name) are methanoic acid (C1), ethanoic acid (C2), propanoic acid (C3), butanoic acid (C4), pentanoic acid (C5), hexanoic acid (C6), heptanoic acid (C7), octanoic acid (C8), nonanoic acid (C9), decanoic acid (C10), undecanoic acid (C11), dodecanoic acid (C12), tridecanoic acid (C13), tetradecanoic acid (C14), pentadecanoic acid (C15), hexadecnoic acid (C16), heptadecanoic acid (C17), octadecanoic acid (C18), nonadecanoic acid (C19), icosanoic acid (C20), henicosanoic acid (C21), docosanoic acid (C22), tricosanoic acid (C23), tetracosanoic acid (C24), pentacosanoic acid (C25), hexacosanoic acid (C26), heptacosanoic acid (C27), octacosanoic acid (C28), nonacosanoic acid (C29), triacontanoic acid (C30).

Specific examples of the unsaturated fatty acid (IUPAC) are ethenoic acid (C2), propenoic acid (C3), butenoic acid (C4), pentenoic acid (C5), hexenoic acid (C6), heptenoic acid (C7), octenoic acid (C8), nonenoic acid (C9), decenoic acid (C10), undecenoic acid (C11), dodecenoic acid (C12), tridecenoic acid (C13), tetradecenoic acid (C14), pentadecenoic acid (C15), hexadecenoic acid (C16), heptadecenoic acid (C17), octadecenoic acid (C18), nonadecenoic acid (C19), icosenoic acid (C20), henicosenoic acid (C21), docosenoic acid (C22), tricosenoic acid (C23), tetracosenoic acid (C24), pentacosenoic acid (C25), hexacosenoic acid (C26), heptacosenoic acid (C27), octacosenoic acid (C28), nonacosenoic acid (C29), triacontenoic acid (C30).

Specific examples of the fatty acid (Common name) are, formic acid (C1), acetic acid (C2), propionic acid (C3), butyric acid (C4), valeric acid (C5), caproic acid (C6), enanthic acid (C7), caprylic acid (C8), pelargonic acid (C9), capric acid (C10), lauric acid (C12), myristic acid (C14), myristoleic acid (C14), pentadecylic acid (C15), palmitic acid (C16), palmitoleic acid (C16), margaric acid (C17), stearic acid (C18), elaidic acid (C18), vaccenic acid (C18), oleic acid (C18), linoleic acid (C18), linolenic acid (C18), 12-hydroxystearic acid (C18), arachidic acid (C20), gadoleic acid (C20), arachidonic acid (C20), eicosenoic acid (C20), behenic acid (C22), erucic acid (C22), lignoceric acid (C24), nervonic acid (C24), cerotic acid (C26), montanic acid (C28), and melissic acid (C30). The fatty acid may be used alone or as a mixture of at least two of them. Among those described above, capric acid, lauric acid, myristic acid, palmitic acid, setaric acid, behenic acid and oleic acid are preferable as the fatty acid.

There is no particular limitation on the aromatic carboxylic acid, as long as it is a compound that has an aromatic ring and a carboxyl group. Specific examples of the aromatic carboxylic acid include, for example, benzoic acid (C7), phthalic acid (C8), isophthalic acid (C8), terephthalic acid (C8), hemimellitic acid (benzene-1,2,3-tricarboxylic acid) (C9), trimellitic acid (benzene-1,2,4-tricarboxylic acid) (C9), trimesic acid (benzene-1,3,5-tricarboxylic acid) (C9), mellophanic acid (benzene-1,2,3,4-tetracarboxylic acid) (C10), prehnitic acid (benzene-1,2,3,5-tetracarboxylic acid) (C10), pyromellitic acid (benzene-1,2,4,5-tetracarboxylic acid) (C10), mellitic acid (benzene hexacarboxylic acid) (C12), diphenic acid (biphenyl-2,2'-dicarboxylic acid) (C12), toluic acid (methylbenzoic acid) (C8), xylic acid (C9), prehnitylic acid (2,3,4-trimethylbenzoic acid) (C10), γ-isodurylic acid (2,3,5-trimethylbenzoic acid) (C10), durylic acid (2,4,5-trimethylbenzoic acid) (C10), β-isodurylic acid (2,4,6-trimethylbenzoic acid) (C10), α-isodurylic acid (3,4,5-trimethylbenzoic acid) (C10), cuminic acid (4-isopropylbenzoic acid) (C10), uvitic acid (5-methylisophthalic acid) (C9), α-toluic acid (phenylacetic acid) (C8), hydratropic acid (2-phenylpropanoic acid) (C9), and hydrocinnamic acid (3-phenylpropanoic acid) (C9).

Furthermore, examples of the aromatic carboxylic acid substituted with a hydroxyl group, an alkoxy group, or an oxo group include salicylic acid (2-hydroxybenzoic acid) (C7), anisic acid (methoxybenzoic acid) (C8), cresotinic acid (hydroxy(methyl)benzoic acid) (C8), o-homosalicylic acid (2-hydroxy-3-methylbenzoic acid) (C8), m-homosalicylic acid (2-hydroxy-4-methylbenzoic acid) (C8), p-homosalicylic acid (2-hydroxy-5-methylbenzoic acid) (C8), o-pyrocatechuic acid (2,3-dihydroxybenzoic acid) (C7), β-resorcylic acid (2,4-dihydroxybenzoic acid) (C7), γ-resorcylic acid (2,6-dihydroxybenzoic acid) (C7), protocatechuic acid (3,4-dihydroxybenzoic acid) (C7), α-resorcylic acid (3,5-dihydroxybenzoic acid) (C7), vanillic acid (4-hydroxy-3-methoxybenzoic acid) (C8), isovanillic acid (3-hydroxy-4-methoxybenzoic acid) (C8), veratric acid (3,4-dimethoxybenzoic acid) (C9), o-veratric acid (2,3-dimethoxybenzoic acid) (C9), orsellinic acid (2,4-dihydroxy-6-methylbenzoic acid) (C8), m-hemipinic acid (4,5-dimethoxyphthalic acid) (C10), gallic acid (3,4,5-trihydroxybenzoic acid) (C7), syringic acid (4-hydroxy-3,5-dimethoxybenzoic acid) (C9), asaronic acid (2,4,5-trimethoxybenzoic acid) (C10), mandelic acid (hydroxy(phenyl) acetic acid) (C8), vanilmandelic acid (hydroxy(4-hydroxy-3-methoxy phenyl) acetic acid) (C9), homoanisic acid ((4-methoxy phenyl) acetic acid) (C9), homogentisic acid ((2,5-dihydroxyphenyl) acetic acid) (C8), homoprotocatechuic acid ((3,4-dihydroxyphenyl) acetic acid) (C8), homovanillic acid ((4-hydroxy-3-methoxy phenyl) acetic acid) (C9), homoisovanillic acid ((3-hydroxy-4-methoxy phenyl) acetic acid) (C9), homoveratric acid ((3,4-dimethoxy phenyl) acetic acid) (C10), o-homoveratric acid ((2,3-dimethoxy phenyl) acetic acid) (C10), homophthalic acid (2-(carboxymethyl)benzoic acid) (C9), homoisophthalic acid (3-(carboxymethyl)benzoic acid) (C9), homoterephthalic acid (4-(carboxymethyl)benzoic acid) (C9), phthalonic acid (2-(carboxycarbonyl)benzoic acid) (C9), isophthalonic acid (3-(carboxycarbonyl)benzoic acid) (C9), terephthalonic acid (4-(carboxycarbonyl)benzoic acid) (C9), benzilic acid (hydroxy diphenylacetic acid) (C14), atrolactic acid (2-hydroxy-2-phenylpropanoic acid) (C9), tropic acid (3-hydroxy-2-phenylpropanoic acid) (C9), melilotic acid (3-(2-hydroxyphenyl) propanoic acid) (C9), phloretic acid (3-(4-hydroxy phenyl) propanoic acid) (C9), hydrocaffeic acid (3-(3,4-dihydroxyphenyl) propanoic acid) (C9), hydroferulic acid (3-(4-hydroxy-3-methoxy phenyl) propanoic acid) (C10), hydroisoferulic acid (3-(3-hydroxy-4-methoxy phenyl) propanoic acid) (C10), p-coumaric acid (3-(4-hydroxy phenyl) acrylic acid) (C9), umbellic acid (3-(2,4-dihydroxyphenyl) acrylic acid) (C9), caffeic acid (3-(3,4-dihydroxyphenyl) acrylic acid) (C9), ferulic acid (3-(4-hydroxy-3-methoxy phenyl) acrylic acid) (C10), isoferulic acid (3-(3-hydroxy-4-methoxy phenyl) acrylic acid) (C10), and sinapic acid (3-(4-hydroxy-3,5-dimethoxy phenyl) acrylic acid) (C11).

The cation component of (d) the salt of the acid may be any one of a metal ion, an ammonium ion and an organic cation. The metal ion includes monovalent metal ions such as sodium, potassium, lithium, silver and the like; divalent metal ions such as magnesium, calcium, zinc, barium, cadmium, copper, cobalt, nickel, manganese and the like; trivalent metal ions such as aluminum, iron and the like; and other ions such as tin, zirconium, titanium and the like. As the cation component of the salt of the carboxylic acid, a zinc ion is preferable. The cation components may be used alone or as a mixture of at least two of them.

The organic cation includes a cation having a carbon chain. The organic cation includes, for example, without limitation, an organic ammonium ion. Examples of the organic ammonium ion are: primary ammonium ions such as stearyl ammonium ion, hexyl ammonium ion, octyl ammonium ion, 2-ethyl hexyl ammonium ion or the like; secondary ammonium ions such as dodecyl (lauryl) ammonium ion, octadecyl (stearyl) ammonium ion or the like; tertiary ammonium ions such as trioctyl ammonium ion or the like; and quaternary ammonium ions such as dioctyldimethyl ammonium ion, distearyldimethyl ammonium ion or the like. Those organic cation may be used alone or as a mixture of at least two of them.

The content of (d) the acid and/or the salt thereof is preferably 1.0 part by mass or more, more preferably 1.5 parts by mass or more, even more preferably 2.0 parts by mass or more, and is preferably less than 40 parts by mass, more preferably 30 parts by mass or less, even more preferably 20 parts by mass or less. If the content is too little, the effect of adding (d) the acid and/or the salt thereof is not sufficient, and thus the degree of the outer-hard inner-soft of the outer core layer may be small. If the content is too much, the resilience of the core may be lowered, since the hardness of the resultant outer core layer may be lowered as a whole.

There are cases where the surface of the zinc acrylate used as the co-crosslinking agent is treated with (d) the acid and/or the salt thereof to improve the dispersibility to the rubber. In the case of using zinc acrylate whose surface is treated with (d) the acid and/or the salt thereof, in the present invention, the amount of (d) the acid and/or the salt thereof used as a surface treating agent is not included in the content of (d) component. It is not conceivable that the (d) the acid and/or the salt thereof hardly contribute to the cation exchange reaction with (b) the co-crosslinking agent.

The content of (d) the acid and/or the salt thereof is preferably determined by the kind and the combination of the acid and/or the salt thereof to be used. Particularly, the content of (d) the acid and/or the salt thereof is preferably determined by the carbon number and the combination of the acid and/or the salt thereof. It is conceivable that the action of breaking the metal crosslinking is affected by the number of moles of the acid and/or the salt thereof to be added. Concurrently, the acid and/or the salt thereof acts as a plasticizer for the outer core layer. If the blending amount (mass) of the acid and/or the salt thereof to be added increases, the entire outer core layer is softened. This plasticizing effect is affected by the blending amount (mass) of the acid and/or the salt thereof to be added. In view of those actions, on the same blending amount (mass), the number of moles of the acid and/or the salt thereof to be added is made larger by using the acid and/or the salt thereof having less carbon atoms (small molecular weight) compared to using the acid and/or the salt thereof having larger carbon atoms (large molecular weight). That is, the acid and/or the salt thereof having less carbon atoms can enhance the effect of breaking the metal crosslinking, while suppressing softening the entire outer core layer by the plasticizing effect.

For example, if a carboxylic acid having 1 to 14 carbon atoms and/or a salt thereof is used as (d) the acid and/or the salt thereof, the content of the carboxylic acid having 1 to 14 carbon atoms and/or a salt thereof is preferably 1.0 part by mass or more, more preferably 1.2 parts by mass or more, even more preferably 1.4 parts by mass or more, and is preferably 20 parts by mass or less, more preferably 18 parts by mass or less, even more preferably 16 parts by mass or less with respect to 100 parts by mass of (a) the base rubber. The carbon number of the salt of the carboxylic acid having 1 to 14 carbon atoms is the carbon number of the carboxylic acid component, and the carbon number of the organic cation is not included.

For example, if a carboxylic acid having 15 to 30 carbon atoms and/or a salt thereof is used as (d) the acid and/or the salt thereof, the content of the carboxylic acid having 15 to 30 carbon atoms and/or the salt thereof is preferably 5 parts by mass or more, more preferably 6 parts by mass or more, even more preferably 7 parts by mass or more, and is preferably less than 40 parts by mass, more preferably 35 parts by mass or less, even more preferably 30 parts by mass or less with respect to 100 parts by mass of (a) the base rubber. The carbon number of the salt of the carboxylic acid having 15 to 30 carbon atoms is the carbon number of the carboxylic acid component, and the carbon number of the organic cation is not included.

If a carboxylic acid having 15 to 30 carbon atoms and/or a salt thereof is used as (d) the acid and/or the salt thereof, the content of the carboxylic acid having 15 to 30 carbon atoms and/or the salt thereof is preferably 10 parts by mass or more, more preferably 15 parts by mass or more, even more preferably 20 parts by mass or more, and is preferably less than 70 parts by mass, more preferably 60 parts by mass or less, even more preferably 50 parts by mass or less with respect to 100 parts by mass of (b) the $\alpha,\beta$-unsaturated carboxylic acid having 3 to 8 carbon atoms and/or the metal salt thereof.

The rubber composition used in the present invention preferably further contains (e) an organic sulfur compound. By using (e) the organic sulfur compound and (d) the acid and/or the salt thereof in combination for the rubber composition, the degree of the outer-hard and inner-soft structure of the outer core layer can be controlled, while maintaining approximate linearity of the hardness distribution of the outer core layer.

(e) The organic sulfur compound is not particularly limited, as long as it is an organic compound having a sulfur atom in the molecule thereof. Examples thereof include an organic compound having a thiol group (—SH), a polysulfide bond having 2 to 4 sulfur atoms (—S—S—, —S—S—S—, or —S—S—S—S—), or a metal salt thereof (—SM, —S-M-S—, —S-M-S—S—, —S—S-M-S—S—, —S-M-S—S—S—, or the like; M is a metal atom). Furthermore, (e) the organic sulfur compound may be any one of aliphatic compounds (aliphatic thiol, aliphatic thiocarboxylic acid, aliphatic dithiocarboxylic acid, aliphatic polysulfides, or the like), heterocyclic compounds, alicyclic compounds (alicyclic thiol, alicyclic thiocarboxylic acid, alicyclic dithiocarboxylic acid, alicyclic polysulfides, or the like), and aromatic compounds.

(e) The organic sulfur compound includes, for example, thiophenols, thionaphthols, polysulfides, thiocarboxylic acids, dithiocarboxylic acids, sulfenamides, thiurams, thiuramdisulfides, dithiocarbamates, and thiazoles. From the aspect of the larger hardness distribution of the spherical core, (e) the organic sulfur compound preferably includes, organic compounds having a thiol group (—SH) or a metal salt thereof, more preferably thiophenols, thionaphthols, or a metal salt thereof. Examples of the metal salts are salts of monovalent metals such as sodium, lithium, potassium, copper (I), and silver (I), and salts of divalent metals such as zinc, magnesium, calcium, strontium, barium, titanium (II), manganese (II), iron (II), cobalt (II), nickel (II), zirconium (II), and tin (II).

Examples of the thiophenols include thiophenol; thiophenols substituted with a fluoro group such as 4-fluorothiophenol, 2,5-difluorothiophenol, 2,4,5-trifluorothiophenol, 2,4,5,6-tetrafluorothiophenol, pentafluorothiophenol; thiophenols substituted with a chloro group such as 2-chlorothiophenol, 4-chlorothiophenol, 2,4-dichlorothiophenol, 2,5-dichlorothiophenol, 2,6-dichlorothiophenol, 2,4,5-trichlorothiophenol, 2,4,5,6-tetrachlorothiophenol, pentachlorothiophenol; thiophenols substituted with a bromo group such as 4-bromothiophenol, 2,5-dibromothiophenol, 2,4,5-tribromothiophenol, 2,4,5,6-tetrabromothiophenol, pentabromothiophenol; thiophenols substituted with a iodo group such as 4-iodothiophenol, 2,5-diiodothiophenol, 2,4,5-triiodothiophenol, 2,4,5,6-tetraiodothiophenol, pentaiodothiophenol; or a metal salt thereof. The metal salt is preferably zinc salt.

Examples of the thionaphthols (naphthalenethiols) are 2-thionaphthol, 1-thionaphthol, 2-chloro-1-thionaphthol, 2-bromo-1-thionaphthol, 2-fluoro-1-thionaphthol, 2-cyano-1-thionaphthol, 2-acetyl-1-thionaphthol, 1-chloro-2-thionaphthol, 1-bromo-2-thionaphthol, 1-fluoro-2-thionaphthol, 1-cyano-2-thionaphthol, and 1-acetyl-2-thionaphthol and metal salts thereof. Preferable examples include 1-thionaphthol, 2-thionaphthol and zinc salt thereof.

The sulfenamide based organic sulfur compound includes, for example, N-cyclohexyl-2-benzothiazole sulfenamide, N-oxydiethylene-2-benzothiazole sulfenamide, and N-t-butyl-2-benzothiazole sulfenamide. The thiuram based organic sulfur compound includes, for example, tetramethylthiuram monosulfide, tetramethylthiuram disulfide, tetraethylthiuram disulfide, tetrabutylthiuram disulfide, and dipentamethylenethiuram tetrasulfide. The dithiocarbamates include, for example, zinc dimethyldithiocarbamate, zinc diethyldithiocarbamate, zinc dibutyldithiocarbamate, zinc ethylphenyl dithiocarbamate, sodium dimethyldithiocarbamate, sodium diethyldithiocarbamate, copper (II) dimethyldithiocarbate, iron (III) dimethyldithiocarbamate, selenium diethyldithiocarbamate, and tellurium diethyldithiocarbamate. The thiazole based organic sulfur compound includes, for example, 2-mercaptobenzothiazole (MBT), dibenzothiazyl disulfide (MBTS), sodium salt, zinc salt, copper salt, or cyclohexylamine salt of 2-mercaptobenzothiazole, 2-(2,4-dinitrophenyl) mercaptobenzothiazole, and 2-(2,6-diethyl-4-morpholinothio)benzothiazole. (e) The organic sulfur compounds may be used alone or as a mixture of at least two of them.

The content of (e) the organic sulfur compound is preferably 0.05 part by mass or more, more preferably 0.1 part by mass or more, and is preferably 5.0 parts by mass or less, more preferably 2.0 parts by mass or less, with respect to 100 parts by mass of (a) the base rubber. If the content of (e) the organic sulfur compound is less than 0.05 part by mass, the effect of adding (e) the organic sulfur compound cannot be obtained and thus the resilience may not improve. If the content of (e) the organic sulfur compound exceeds 5.0 parts by mass, the compression deformation amount of the obtained golf ball becomes large and thus the resilience may be lowered.

The rubber composition used in the present invention can include additives such as a pigment, a filler for adjusting weight or the like, an antioxidant, a peptizing agent, and a softener where necessary. Further, as described above, if the rubber composition used in the present invention contains only (b1) the α,β-unsaturated carboxylic acid having 3 to 8 carbon atoms as a co-crosslinking agent, the rubber composition preferably contains (f) the metal compound.

(f) The metal compound is not limited, as long as it can neutralize (b1) the α,β-unsaturated carboxylic acid having 3 to 8 carbon atoms in the rubber composition. Examples of (f) the metal compounds are metal hydroxides such as magnesium hydroxide, zinc hydroxide, calcium hydroxide, sodium hydroxide, lithium hydroxide, potassium hydroxide, copper hydroxide, and the like; metal oxides such as magnesium oxide, calcium oxide, zinc oxide, copper oxide, and the like; metal carbonates such as magnesium carbonate, zinc carbonate, calcium carbonate, sodium carbonate, lithium carbonate, potassium carbonate, and the like. From the aspect of reacting with (b1) the α,β-unsaturated carboxylic acid having 3 to 8 carbon atoms as the co-crosslinking agent to form a metal crosslinking, (f) the metal compound preferably includes a divalent metal compound, more preferably includes a zinc compound. Use of the zinc compound provides a golf ball with excellent resilience. (f) The metal compound may be used alone or as a mixture of at least two of them. The content of (f) the metal compound is preferably determined in accordance with the desired degree of neutralization of the carboxyl group of (b) the α,β-unsaturated carboxylic acid having 3 to 8 carbon atoms.

Examples of the pigment blended in the rubber composition include a white pigment, a blue pigment, and a purple pigment. As the white pigment, titanium oxide is preferably used. The type of titanium oxide is not particularly limited, but rutile type is preferably used because of the high opacity. The blending amount of titanium oxide is preferably 0.5 part by mass or more, and more preferably 2 parts by mass or more, and is preferably 8 parts by mass or less, and more preferably 5 parts by mass or less, with respect to 100 parts by mass of (a) the base rubber.

It is also preferred that the rubber composition contains both a white pigment and a blue pigment. The blue pigment is blended in order to cause white color to be vivid, and examples thereof include ultramarine blue, cobalt blue, and phthalocyanine blue. Examples of the purple pigment include anthraquinone violet, dioxazine violet, and methyl violet.

The blending amount of the blue pigment is preferably 0.001 part by mass or more, and more preferably 0.05 part by mass or more, and is preferably 0.2 part by mass or less, and more preferably 0.1 part by mass or less, with respect to 100 parts by mass of (a) the base rubber. If the blending amount of the blue pigment is less than 0.001 part by mass, blueness is insufficient, and the color looks yellowish. If the blending amount of the blue pigment exceeds 0.2 part by mass, blueness is excessively strong, and a vivid white appearance is not provided.

The filler blended in the rubber composition is used as a weight adjusting agent for mainly adjusting the weight of the golf ball obtained as an final product. The filler may be blended where necessary. The filler includes, for example, inorganic fillers such as zinc oxide, barium sulfate, calcium carbonate, magnesium oxide, tungsten powder, molybdenum powder, or the like. The filler more preferably includes zinc oxide. It is considered that zinc oxide functions as a vulcanization aid to enhance the hardness of the whole core. The content of the filler is preferably 0.5 part by mass or more, more preferably 1 part by mass or more, and is preferably 30 parts by mass or less, more preferably 25 parts by mass or less, even more preferably 20 parts by mass or less. If the content of the filler is less than 0.5 part by mass, it is difficult to adjust the weight, while if the content of the filler exceeds 30 parts by mass, the weight ratio of the rubber component becomes small and thus the resilience tends to be lowered.

The blending amount of the antioxidant is preferably 0.1 part by mass or more and 1 part by mass or less, with respect to 100 parts by mass of (a) the base rubber. In addition, the blending amount of the peptizing agent is preferably 0.1 part by mass or more and 5 parts by mass or less, with respect to 100 parts by mass of (a) the base rubber.

(3) Inner Core Layer Composition

Material for the inner core layer includes a rubber composition or a resin composition. As the inner core layer rubber composition, exemplified is a rubber composition containing, for example, (a) a base rubber, (b) a co-crosslinking agent, and (c) a crosslinking initiator. As (a) the base rubber, (b) the co-crosslinking agent, and (c) the crosslinking initiator, the same components used for the outer core layer rubber composition can be used.

In the inner core layer rubber composition, (f) an organic sulfur compound, (e) a metal compound, a filler, an antioxidant, and a peptizing agent may be blended appropriately in addition to (a) the base rubber, (b) the co-crosslinking agent, and (c) the crosslinking initiator. With regard to these components, the same components used in the outer core layer composition can be used. It is preferred that (d) the acid and/or the salt thereof is not blended in the inner core layer rubber composition. However, in the case that (d) the acid and/or the salt thereof is blended in the inner core layer rubber composition, the content thereof is preferably more than 40 parts by mass with respect to 100 parts by mass of (a) the base rubber.

The resin component includes a binary copolymer composed of an olefin and an α,β-unsaturated carboxylic acid having 3 to 8 carbon atoms, a ternary copolymer composed of an olefin, an α,β-unsaturated carboxylic acid having 3 to 8 carbon atoms, and an α,β-unsaturated carboxylic acid ester, a binary ionomer resin consisting of a metal ion neutralized product of a binary copolymer composed of an olefin and an α,β-unsaturated carboxylic acid having 3 to 8 carbon atoms, and a ternary ionomer resin consisting of a metal ion-neutralized product of a ternary copolymer composed of an olefin, an α,β-unsaturated carboxylic acid having 3 to 8 carbon atoms, and an α,β-unsaturated carboxylic acid ester.

Specific examples of the binary copolymer include an ethylene-methacrylic acid copolymer such as "NUCREL (registered trademark) (e.g. NUCREL N1050H, NUCREL N2050H, NUCREL N1110H, NUCREL NO200H) manufactured by Du Pont-Mitsui Polychemicals Co., Ltd. Specific examples of the ternary copolymer include "NUCREL (registered trademark) (e.g. NUCREL AN4318, NUCREL AN4319) manufactured by Du Pont-Mitsui Polychemicals Co., Ltd.

Specific examples of the binary ionomer resin include trade name "Himilan (registered trademark) (e.g. Himilan 1555 (Na), Himilan 1557 (Zn), Himilan 1605 (Na), Himilan 1706 (Zn), Himilan 1707 (Na), Himilan AM7311 (Mg), Himilan AM7329 (Zn))" commercially available from Du Pont-Mitsui Polychemicals Co., Ltd. Specific examples of the ternary ionomer resin include trade name "Himilan (registered trademark) (e.g. Himilan AM7327 (Zn), Himilan 1855 (Zn), Himilan 1856 (Na), Himilan AM7331 (Na), or the like)" commercially available from Du Pont-Mitsui Polychemicals Co., Ltd.

When the binary copolymer or ternary copolymer is used as the resin component, a metal compound may be blended. The metal compound includes (e) the metal compound used for the outer core layer rubber composition.

When the resin composition is used for the inner core layer, an amphoteric surfactant having a cationic part and anionic part may be blended. Examples of the amphoteric surfactant include a betaine type amphoteric surfactant such as alkylbetaine type, amidobetaine type, imidazoliumbetaine type, alkylsulfobetain type, amidosulfobetain type, and the like; amidoamino acid type amphoteric surfactant and alkylamino fatty acid salt; alkylamine oxide; β-alanine type amphoteric surfactant and glycine type amphoteric surfactant; sulfobetaine type amphoteric surfactant; phosphobetaine type amphoteric surfactant; and the like.

Specific examples of the amphoteric surfactant are dimethyllaurylbetaine, oleyldimethylaminoacetic acid betaine (oleylbetaine), dimethyloleylbetaine, dimethylstearylbetaine, stearyldihydroxymethylbetaine, stearyldihydroxyethylbetaine, lauryldihydroxymethylbetaine, lauryldihydroxyethylbetaine, myristyldihydroxymethylbetaine, behenyldihydroxymethylbetaine, palmityldihydroxyethylbetaine, oleyldihydroxymethylbetaine, coconut oil fatty acid amidopropylbetaine, lauric acid amidoalkylbetaine, 2-alkyl-N-carboxyalkylimidazoliumbetaine, lauric acid amidoalkylhydroxysulfobetaine, coconut oil fatty acid amidodialkylhydroxyalkylsulfobetaine, N-alkyl-β-aminopropionic acid salt, N-alkyl-β-iminodipropionic acid salt, alkyldiaminoalkylglycine, alkylpolyaminoalkylglycine, sodium salt of alkylamino fatty acid, N,N-dimethyloctylamine oxide, N,N-dimethyllaurylamine oxide, N,N-dimethylstearylamine oxide, and the like.

The content of the amphoteric surfactant is preferably 10 parts by mass or more, more preferably 15 parts by mass or more, even more preferably 20 parts by mass or more, and is preferably 100 parts by mass or less, more preferably 90 parts by mass or less, even more preferably 80 parts by mass or less with respect to 100 parts by mass of the base resin.

If the inner core layer includes the resin composition, a basic metal salt of a fatty acid may be blended. By blending the basic metal salt of the fatty acid, the resilience performance is improved. The basic metal salt of the fatty acid is preferably a basic metal salt of a saturated fatty acid. The basic metal salt of the fatty acid is preferably a basic metal salt of a fatty acid having 4 to 22 carbon atoms, and more preferably basic metal salt of a fatty acid having 5 to 18 carbon atoms. Specific examples of the basic metal salt of the fatty acid include basic magnesium caprylate, basic calcium caprylate, basic zinc caprylate, basic magnesium laurate, basic calcium laurate, basic zinc laurate, basic magnesium myristate, basic calcium myristate, basic zinc myristate, basic magnesium palmitate, basic calcium palmitate, basic zinc palmitate, basic magnesium oleate, basic calcium oleate, basic zinc oleate, basic magnesium stearate, basic calcium stearate, basic zinc stearate, basic magnesium 12-hydroxystearate, basic calcium 12-hydroxystearate, basic zinc 12-hydroxystearate, basic magnesium behenate, basic calcium behenate, and basic zinc behenate. The basic metal salt of the fatty acid preferably includes basic zinc fatty acid, and more preferably basic zinc stearate, basic zinc laurate, and basic zinc caprylate. The basic metal salt of the fatty acid may be used alone or as a mixture of at least two of them.

The content of the basic metal salt of the fatty acid is preferably 3 parts by mass or more, more preferably 5 parts by mass or more, even more preferably 10 parts by mass or more, and is preferably 80 parts by mass or less, more preferably 60 parts by mass or less, even more preferably 50 parts by mass or less with respect 100 parts by mass of the base resin.

(4) Intermediate Layer Composition

An intermediate layer composition containing a resin component is preferably used for the intermediate layer. Examples of the resin component include ionomer resins, styrene block-containing thermoplastic elastomers, thermoplastic polyurethane elastomers, thermoplastic polyamide elastomers, thermoplastic polyester elastomers, thermoplastic polyolefin elastomers, and thermoplastic styrene elastomers. Among these, ionomer resins are preferred as the resin component. Ionomer resins are highly elastic.

An ionomer resin and another resin may be used in combination. In this case, from the aspect of the resilience performance, the ionomer resin is the principal component of the resin component. The content of the ionomer resin in the resin component is preferably 50 mass % or more, more preferably 70 mass % or more, and even more preferably 85 mass % or more.

Examples of the ionomer resin include, for example, one prepared by neutralizing at least a part of carboxyl croups in a binary copolymer composed of an olefin and an α,β-unsaturated carboxylic acid having 3 to 8 carbon atoms with a metal ion, one prepared by neutralizing at least a part of carboxyl groups in a ternary copolymer composed of an olefin, an α,β-unsaturated carboxylic acid having 3 to 8 carbon atoms and an α,β-unsaturated carboxylic acid ester, or a mixture of them. The olefin preferably includes an olefin having 2 to 8 carbon atoms. Examples of the olefin include ethylene, propylene, butene, pentene, hexene, heptene and octene. Among them, ethylene is more preferred. Examples of the α,β-unsaturated carboxylic acid having 3 to 8 carbon atoms are acrylic acid, methacrylic acid, fumaric acid, maleic acid and crotonic acid. Among these, acrylic acid or methacrylic acid is particularly preferred. Examples of the α,β-unsaturated carboxylic acid ester are methyl, ethyl, propyl, n-butyl, isobutyl ester and the like of acrylic acid, methacrylic acid, fumaric acid and maleic acid. Particularly, acrylic acid ester and methacrylic acid ester are preferred. Among them, as the ionomer resin, preferred are a metal ion-neutralized product of the binary copolymer composed of ethylene-(meth)acrylic acid and a metal ion-neutralized product of the ternary copolymer composed of ethylene-(meth)acrylic acid-(meth)acrylic acid ester.

Specific examples of the ionomer resin include trade name "Himilan (registered trademark) (e.g. Himilan 1555 (Na), Himilan 1557 (Zn), Himilan 1605 (Na), Himilan 1706 (Zn), Himilan 1707 (Na), Himilan AM3711 (Mg))", and specific examples of the ternary ionomer resin include "Himilan 1856 (Na), Himilan 1855 (Zn), Himilan AM7329 (Zn)" commercially available from Du Pont-Mitsui Polychemicals Co., Ltd.

Further, examples include "Surlyn (registered trademark) (e.g. the binary copolymerized ionomer such as Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li); and the ternary copolymerized ionomer such as Surlyn 8120 (Na), Surlyn 8320 (Na), Surlyn 9320 (Zn), Surlyn 6320 (Mg), HPF 1000 (Mg), HPF 2000 (Mg))" commercially available from E.I. du Pont de Nemours and Company.

Further, examples include "lotek (registered trademark) (e.g. the binary copolymerized ionomer such as lotek 8000 (Na), lotek 8030 (Na), lotek 7010 (Zn), lotek 7030 (Zn); and the ternary copolymerized ionomer such as lotek 7510 (Zn), lotek 7520 (Zn))" commercially available from ExxonMobil Chemical Corporation.

It is noted that Na, Zn, Li, and Mg described in the parentheses after the trade names indicate metal types of neutralizing metal ions for the ionomer resins. The above ionomer resins may be used solely or as a mixture of two or more of them.

Examples of the thermoplastic styrene elastomers include "Rabalon (registered trademark)" commercially available from Mitsubishi Chemical Corporation.

The intermediate layer composition may further contain a pigment component such as a white pigment (for example, titanium oxide), a blue pigment, and a red pigment; a weight adjusting agent such as zinc oxide, calcium carbonate, and barium sulfate; a dispersant; an antioxidant; an ultraviolet absorber; a light stabilizer; a fluorescent material or a fluorescent brightener; and the like, as long as they do not impair the effect of the present invention.

(5) Reinforcing Layer Composition

The reinforcing layer adheres firmly to the intermediate layer as well as to the cover. The reinforcing layer suppresses delamination of the cover from the intermediate layer. The reinforcing layer is preferably formed between the intermediate layer and the cover, especially in the case that the intermediate layer is formed from an intermediate layer composition containing a base resin and the cover composition containing a base resin, and that the base resins contained in the intermediate layer and the cover are different each other (for example, the intermediate layer composition contains an ionomer resin as the base resin and the cover composition contains the thermoplastic polyurethane as the base resin).

The reinforcing layer is formed from a reinforcing layer composition containing a resin component. As the resin component, a two-component curing type thermosetting resin is preferably used. Example of two-component curing type thermosetting resin include epoxy resins, urethane resins, acrylic resins, polyester resins and cellulose resins. From the aspect of the strength and durability of the reinforcing layer, two-component curing type epoxy resins and two-component curing type urethane resins are preferred.

The reinforcing layer composition may include additives such as a coloring agent (for example, titanium dioxide), a phosphoric acid-based stabilizer, an antioxidant, a light stabilizer, a fluorescent brightener, an ultraviolet absorber, an anti-blocking agent and the like. The additives may be added to either the base material or the curing agent of the two-component curing thermosetting resin.

(6) Cover Composition

The cover of the golf ball of the present invention is formed from a cover composition containing a resin component. Examples of the resin components include an ionomer resin, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polyurethane elastomer having a trade name "Elastollan (registered trademark)" commercially available from BASF Japan Ltd., a thermoplastic styrene elastomer having a trade name "Rabalon (registered trademark)" commercially available from Mitsubishi Chemical Corporation, and the like. These resin components may be used alone or in combination of two or more thereof.

The cover composition constituting the cover of the golf ball of the present invention preferably contains the thermoplastic polyurethane as a resin component. The content of the thermoplastic polyurethane in the resin component of the cover composition is preferably 50 mass % or more, more preferably 60 mass % or more, even more preferably 70 mass % or more.

The cover composition may contain a pigment component such as a white pigment (for example, titanium oxide), a blue pigment, a red pigment, or the like, a specific gravity adjusting agent such as zinc oxide, calcium carbonate, barium sulfate, or the like, a dispersant, an antioxidant, an ultraviolet absorber, a light stabilizer, a fluorescent material or a fluorescent brightener, or the like as long as they do not impair the performance of the cover.

The amount of the white pigment (for example, titanium oxide) is preferably 0.5 part or more, more preferably 1 part or more, and the content of the white pigment is preferably 10 parts or less, more preferably 8 parts or less, with respect to 100 parts of the resin component constituting the cover by mass. If the amount of the white pigment is 0.5 part by mass or more, it is possible to impart the opacity to the resultant cover. Further, if the amount of the white pigment is more than 10 parts by mass, the durability of the resultant cover may deteriorate.

(7) Method for Manufacturing Golf Ball

The inner core layer used in the present invention is prepared using the rubber composition or the resin composition for the inner core layer. If the inner core layer is formed from the rubber composition, the inner core layer is obtained by heating and molding the kneaded rubber composition in the molds. The temperature for press-molding into the inner core layer is preferably 140° C. or more, more preferably 145° C. or more, even more preferably 150° C. or more, and is preferably 160° C. or less. The pressure for press-molding preferably ranges from MPa to 30 MPa. The time for press-molding is preferably from 10 minutes to 40 minutes.

If the inner core layer is formed from the resin composition, the inner core layer is molded by injection molding. The molding by the injection molding method is conducted by charging and cooling the resin composition. For example, the resin composition heated and melted at the temperature ranging from 160° C. to 260° C. is charged into molds clamped under the pressure of 1 MPa to 100 MPa for 1 second to 100 seconds, and after cooling for 30 seconds to 300 seconds, the molds are opened.

A method for molding the outer core layer includes, for example, an embodiment which comprises molding the outer core layer composition into a hollow-shell, covering the inner core layer with a plurality of the hollow-shells and subjecting the inner core layer with a plurality of the hollow shells to the compression-molding (preferably an embodiment which comprises molding the rubber composition into a half hollow-shell, covering the inner core layer with the two half hollow-shells, and subjecting the inner core layer with the two half hollow-shells to the compression-molding). The compression-molding of the rubber composition into a half shell can be carried out, for example, under a pressure of 1 MPa or more and 100 MPa or less at a molding temperature of 10° C. or more and 60° C. or less. A method for molding the outer core layer using the half shells includes, for example, compression molding the inner core layer covered with the two half shells. The compression molding of half shells into the outer core layer can be carried out, for example, under a pressure of 1 MPa or more and 100 MPa or less at a molding temperature of 140° C. or more and 180° C. or less. By performing the molding under the above conditions, the outer core layer having a uniform thickness can be formed.

The rubber composition used in the present invention is obtained by mixing and kneading (a) the base rubber, (b) the α,β-unsaturated carboxylic acid having 3 to 8 carbon atoms and/or the metal salt thereof, (c) the crosslinking initiator, and (d) the acid and/or the salt thereof, if necessary other additives. The kneading can be conducted, without any limitation, with a publicly known kneading machine such as a kneading roll, a banbury mixer, a kneader, or the like.

A method for molding an intermediate layer or a cover is not particularly limited, and includes an embodiment which comprises injection molding the intermediate layer composition or the cover composition directly onto the spherical core or the spherical core formed with the intermediate layer, or an embodiment which comprises molding the intermediate layer composition or the cover composition into a hollow-shell, covering the spherical core or the spherical core formed with the intermediate layer with a plurality of the hollow-shells and subjecting to the compression-molding (preferably an embodiment which comprises molding the intermediate layer composition or the cover composition into a half hollow-shell, covering the spherical core or the spherical core formed with the intermediate layer with the two half hollow-shells, and subjecting to the compression-molding).

When molding the intermediate layer or the cover in a compression molding method, molding of the half shell can be performed by either compression molding method or injection molding method, and the compression molding method is preferred. The compression-molding of the intermediate layer composition or cover composition into half shell can be carried out, for example, under a pressure of 1 MPa or more and 20 MPa or less at a molding temperature of −20° C. or more and 70° C. or less relative to the flow beginning temperature of the intermediate layer composition or the cover composition. By performing the molding under the above conditions, a half shell having a uniform thickness can be formed. The compression molding of half shells into the intermediate layer or cover can be carried out, for example, under a molding pressure of 0.5 MPa or more and 25 MPa or less at a molding temperature of −20° C. or more and 70° C. or less relative to the flow beginning temperature of the intermediate layer composition or the cover composition. By performing the molding under the above conditions, a golf ball cover having a uniform thickness can be formed.

In the case of directly injection molding the intermediate layer composition or the cover composition, the intermediate layer composition or the cover composition extruded in the pellet form beforehand may be used for injection molding or the materials such as the base resin components and the pigment may be dry blended, followed by directly injection molding the blended material. It is preferred to use upper and lower molds having a spherical cavity and pimples, wherein a part of the pimples also serves as a retractable hold pin. When molding the intermediate layer or cover by injection molding, the hold pin is protruded, the core is placed in, held with the hold pin, and the intermediate layer composition or the cover composition which has been heated and melted is charged and then cooled to obtain an intermediate layer or a cover. For example, it is preferred that the intermediate layer composition or the cover composition heated and melted at the temperature ranging from 200° C. to 250° C. is charged into molds clamped under the pressure of 9 MPa to 15 MPa for 0.5 to 5 seconds, and after cooling for 10 to 60 seconds, the molds are opened.

After the cover is molded, the golf ball body is ejected from the molds, and where necessary the golf ball body is preferably subjected to surface treatments such as deburring, cleaning, and sandblast. If desired, a paint film or a mark may be formed.

EXAMPLES

Hereinafter, the present invention will be described in detail by way of example. The present invention is not limited to examples described below. Various changes and modifications can be made without departing from the spirit and scope of the present invention.

[Evaluation Methods]

(1) Slab Hardness (Shore D Hardness)

Sheets with a thickness of about 2 mm were produced by injection molding the intermediate layer composition and cover composition, and stored at 23° C. for two weeks. Three or more of these sheets were stacked on one another so as not to be affected by the measuring substrate on which the sheets were placed, and the hardness of the stack was measured with a type P1 auto loading durometer manufactured by Kobunshi Keiki Co., Ltd., provided with a Shore D type spring hardness tester prescribed in ASTM-D2240.

(2) Core Hardness Distribution (JIS-C hardness)

The core hardness was measured by the following method. The core hardness was obtained by calculating the average of hardness measured at four points.

Spherical core surface hardness (Hs2)

A type P1 auto loading durometer manufactured by Kobunshi Keiki Co., Ltd., provided with a JIS-C type spring hardness tester was used. The JIS-C hardness measured at the surface of the spherical core was adopted as the surface hardness (Hs2) of the spherical core.

Inner core layer surface hardness (Hs1)

The spherical core was cut into two hemispheres to obtain a cut plane. The surface hardness (Hs1) of the inner core layer is JIS-C hardness measured in the region surrounded by the following first and second circle on the cut plane. The first circle is defined by the boundary between the inner core layer and the outer core layer. The second circle is a concentric circle with the first circle and has a shorter radius than the first circle by 10% of the radius of the first circle. The radius of each circle is as follows.

Radius of the first circle: r1=radius of the first circle

Radius of the second circle: r2=r1×0.9

Outer core layer innermost point hardness (Hb)

The spherical core was cut into two hemispheres to obtain a cut plane. The surface hardness (Hb) at the innermost point of the outer core layer is JIS-C hardness measured in the region surrounded by the following first and third circle on the cut plane. The first circle is defined by the boundary between the inner core layer and the outer core layer. The third circle is a concentric circle with the first circle and has a larger radius than the first circle by 10% of the thickness of the outer core layer. The radius of each circle is as follows.

Radius of the first circle: r1=radius of the first circle

Radius of the third circle: r3=r1+(thickness of the outer core layer)×0.1)

Inner core layer central hardness (Ho) and hardness at points of 12.5% to 87.5% in outer core layer The spherical core was cut into two hemispheres to obtain a cut plane, and the JIS-C hardness measured at the central point of the inner core layer is defined as the central hardness (Ho) of the inner core layer. In addition, hardness was measured at predetermined distances from the boundary point between the inner core layer and the outer core layer.

(3) Compression Deformation Amount (mm)

A compression deformation amount of the core or golf ball (a shrinking amount of the core or golf ball in the compression direction thereof), when applying a load from an initial load of 98N to a final load of 1275N to the core or golf ball, was measured.

(4) Coefficient of Restitution

A 198.4 g of metal cylindrical object was allowed to collide with each core or golf ball at a speed of 45 m/sec, and the speeds of the cylindrical object and the core or golf ball before and after the collision were measured. Based on these speeds and the mass of each object, coefficient of restitution for each core or golf ball was calculated. The measurement was conducted by using twelve samples for each core or golf ball, and the average value was regarded as the coefficient of restitution for the core or golf ball. Assuming that the coefficient of restitution of golf ball No. 18 is defined as an index of 100.0, the coefficient of restitution of golf balls No. 1 to No. 27 are shown by converting the coefficient of restitution of each golf ball into this index. Assuming that the coefficient of restitution of golf ball No. 46 is defined as an index of 100.0, the coefficient of restitution of golf balls No. 28 to No. 56 are shown by converting the coefficient of restitution of each golf ball into this index.

(5) Flight Distance (m) and Spin Rate (Rpm) on a Driver Shot

A titanium-head driver ("XXIO" manufactured by Dunlop sports, Shaft hardness: S, loft angle: 10°) was installed on a swing robot M/C manufactured by TRUETEMPER Sports, Inc. A golf ball was hit at a head speed of 45 m/sec, and the flight distance (the distance from the launch point to the stop point) and the spin rate immediately after hitting the golf ball were measured. This measurement was conducted ten times for each golf ball, and the average value was adopted as the measurement value for the golf ball. A sequence of photographs of the hit golf ball were taken for measuring the spin rate (rpm) immediately after hitting the golf ball.

(6) Spin Rate on Approach Shots

A sand wedge (CG15 forged wedge (52°), available from Cleveland Golf) was installed on a swing robot M/C manufactured by TRUETEMPER Sports, Inc. A golf ball was hit at a head speed of 21 m/sec, and a sequence of photographs of the hit golf balls were taken for measuring the spin rate (rpm). The measurement was performed ten times for each golf ball, and the average value is adopted as the spin rate (rpm).

(7) Durability

A titanium-head W#1 driver ("XXIO" manufactured by Dunlop sports, Shaft hardness: S, loft angle: 10°) was installed on a swing robot M/C manufactured by TRUETEMPER CO, and the head speed was set to 45 m/sec. Each golf ball was stored in a constant temperature reservoir kept at the temperature of 23° C. for 12 hours. Immediately after taking each golf ball out of the reservoir, they were repeatedly hit with the driver. The number of hits required to break the golf ball was counted. This measurement was conducted by using twelve golf balls for each golf ball. With respect to golf balls No. 1 to No. 27, the number of hits for golf ball No. 1 was defined as an index of 100, and the durability of each golf ball was represented by converting the number of hits for each golf ball into this index. With respect to golf balls No. 28 to No. 56, the number of hits for golf ball No. 28 was defined as an index of 100, and the durability of each golf ball was represented by converting the number of hits for each golf ball into this index. A greater index value indicates that the durability of the golf ball is excellent.

[Production of Golf Balls]

(1) Production of Inner Core Layer

Rubber Compositions No. 1, 2

The rubber compositions having formulations shown in Table 3 were kneaded with a kneading roll and pressed in upper and lower molds, each having a hemispherical cavity to prepare the spherical inner cores. The heat-pressing was conducted under the conditions shown in Tables 6 to 11.

Resin Compositions No. 18 to 21

The blending materials shown in Table 3 were dry blended, followed by mixing with a twin-screw kneading extruder to extrude the blended material in the strand form into the cool water. The extruded strand was cut with a pelletizer to prepare an inner core layer composition in the form of pellet. Extrusion was performed in the following conditions: screw diameter=45 mm; screw revolutions=200 rpm; and screw L/D=35. The mixtures were heated to a temperature in a range from 160° C. to 230° C. at a die position of the extruder. The obtained inner core layer composition in the form of pellet was injection molded at a temperature of 220° C. to prepare spherical inner cores.

(2) Production of Spherical Cores

The rubber compositions shown in table 3 were kneaded and molded into half shells. Molding of half shells was conducted by charging a pellet of the rubber composition into each of the depressed part of the lower mold for molding half shells, and applying pressure to mold half shells. Compression molding was conducted at the temperature of 30° C. for 1 minute under the molding pressure of 10 MPa. The inner core layers obtained above were covered with two half shells. The inner core layers covered with two half shells were placed in the molds composed of upper mold and lower mold each having a spherical cavity and heat-pressed under the conditions shown in tables 6 to 11 to prepare the spherical cores consisting of the inner core layer and the outer core layer covering the inner core layer. It is noted that the blending amount of barium sulfate was adjusted to make the golf ball have a mass of 45.6 g.

TABLE 3

| Rubber composition No. | | 1 | 2 | 3 | 4 | 5 | 6 | 7 | 8 | 9 | 10 | 11 |
|---|---|---|---|---|---|---|---|---|---|---|---|---|
| Formulation (Parts by mass) | BR-730 | 100 | 100 | 100 | 100 | 100 | 100 | 100 | 100 | 100 | 100 | 100 |
| | Sanceler SR | 25 | 25 | 36 | 40 | 40 | 40 | 41 | 42 | 43 | 37 | 38 |
| | ZN-DA90S | — | — | — | — | — | — | — | — | — | — | — |
| | Zinc oxide | 5 | 5 | 5 | 5 | 5 | 5 | 5 | 5 | 5 | 5 | 5 |
| | Barium sulfate | *1) | *1) | *1) | *1) | *1) | *1) | *1) | *1) | *1) | *1) | *1) |
| | 2-thionaphthol | 0.2 | 0.2 | 0.2 | 0.2 | 0.2 | 0.2 | 0.2 | 0.2 | 0.2 | 0.2 | 0.2 |
| | Bispentabromophenyldisulfide | — | — | — | — | — | — | — | — | — | — | — |
| | Dicumyl peroxide | 0.9 | 0.9 | 0.9 | 0.9 | 0.9 | 0.9 | 0.9 | 0.9 | 0.9 | 0.9 | 0.9 |
| | Zinc octanoate | — | — | — | 0.5 | 2 | 5 | 10 | 30 | 45 | — | — |
| | Zinc stearate | — | — | — | — | — | — | — | — | — | 10 | 20 |
| | Zinc myristate | — | — | — | — | — | — | — | — | — | — | — |
| | Himilan AM7327 | — | — | — | — | — | — | — | — | — | — | — |
| | Nucrel AN4319 | — | — | — | — | — | — | — | — | — | — | — |
| | Basic Mg oleate (metal content: 1.4 mol %) | — | — | — | — | — | — | — | — | — | — | — |
| | Basic Mg oleate (metal content: 1.7 mol %) | — | — | — | — | — | — | — | — | — | — | — |
| | Magnesium hydroxide | — | — | — | — | — | — | — | — | — | — | — |
| | Oleyldimethylaminoacetic acid betaine | — | — | — | — | — | — | — | — | — | — | — |
| | Nocrac 200 | — | 0.2 | — | — | — | — | — | — | — | — | — |

| Rubber composition No. | | 12 | 13 | 14 | 15 | 16 | 17 | 18 | 19 | 20 | 21 |
|---|---|---|---|---|---|---|---|---|---|---|---|
| Formulation (Parts by mass) | BR-730 | 100 | 100 | 100 | 100 | 100 | 100 | — | — | — | — |
| | Sanceler SR | 40 | 41 | 42 | — | 41 | 39 | — | — | — | — |
| | ZN-DA90S | — | — | — | 40 | — | — | — | — | — | — |
| | Zinc oxide | 5 | 5 | 5 | 5 | 5 | 5 | — | — | — | — |
| | Barium sulfate | *1) | *1) | *1) | *1) | *1) | *1) | — | — | — | — |
| | 2-thionaphthol | 0.2 | 0.2 | — | 0.2 | 0.2 | 0.2 | — | — | — | — |
| | Bispentabromophenyldisulfide | — | — | 0.3 | — | — | — | — | — | — | — |
| | Dicumyl peroxide | 0.9 | 0.9 | 0.9 | 0.9 | 0.9 | 0.9 | — | — | — | — |
| | Zinc octanoate | — | — | 5 | 5 | 5 | 5 | — | — | — | — |
| | Zinc stearate | — | — | — | — | — | — | — | — | — | — |
| | Zinc myristate | 5 | 10 | — | — | — | — | — | — | — | — |
| | Himilan AM7327 | — | — | — | — | — | — | 100 | — | — | — |
| | Nucrel AN4319 | — | — | — | — | — | — | — | 100 | 100 | 100 |
| | Basic Mg oleate (metal content: 1.4 mol %) | — | — | — | — | — | — | 30 | — | — | — |
| | Basic Mg oleate (metal content: 1.7 mol %) | — | — | — | — | — | — | — | 30 | — | — |

TABLE 3-continued

| | | | | | | | | | | |
|---|---|---|---|---|---|---|---|---|---|---|
| Magnesium hydroxide | — | — | — | — | — | — | — | — | 5.1 | 6.7 |
| Oleyldimethylaminoacetic acid betaine | — | — | — | — | — | — | — | — | 70 | 30 |
| Nocrac 200 | — | — | — | — | — | — | — | — | — | — |

*1) As to an amount of barium sulfate, adjustment was made such that the golf ball had a mass of 45.6 g.

BR-730: a high-cis polybutadiene (cis-1,4 bond content = 96 mass %, 1,2-vinyl bond content = 1.3 mass %, Moony viscosity ($ML_{1+4}$ (100° C.) = 55, molecular weight distribution (Mw/Mn) = 3) available from JSR Corporation Sanceler SR: zinc acrylate (product of 10 mass % stearic acid coating) available from Sanshin Chemical Industry Co., Ltd.

ZN-DA90S: Zinc acrylate (product of 10 mass % zinc stearate coating)available from Sanshin Chemical Industry Co., Ltd.

Zinc oxide: "Ginrei R" manufactured by Toho Zinc Co., Ltd.

Barium sulfate: "Barium sulfate BD" manufactured by Sakai Chemical Industry Co., Ltd., adjustment was made such that the finally obtained golf ball had a mass of 45.6 g.

2-thionaphthol: manufactured by Tokyo Chemical Industry Co., Ltd.

Bispentabromophenyldisulfide: manufactured by Kawaguchi Chemical Industry Co., Ltd.

Dicumyl peroxide: "Percumyl (registered trademark) D" manufactured by NOF Corporation.

Zinc octanoate: manufactured by Mitsuwa Chemicals Co., Ltd.

Zinc stearate: manufactured by Wako Pure Chemical Industries, Ltd.

Zinc myristate: manufactured by Wako Pure Chemical Industries, Ltd.

Himilan AM7327: Zinc ion neutralized ethylene-methacrylic acid-butyl acrylate ternary copolymer ionomer resin available from Du Pont-Mitsui Polychemicals Co., Ltd.

Nucrel AN4319: Ethylene-methacrylic acid-butyl acrylate ternary copolymer available from Du Pont-Mitsui Polychemicals Co., Ltd.

Basic magnesium oleate: available from Nitto Kasei Kogyo K.K. (metal content: 1.4 mol %)

Basic magnesium oleate: available from Nitto Kasei Kogyo K.K. (metal content: 1.7 mol %)

Magnesium hydroxide: available from Wako Pure Chemical Industries Ltd.

Oleylbetaine (oleyldimethylaminoacetic acid betaine): a purified preparation of "Chembetaine OL" available from The Lubrizol Corporation (water and salt are removed)

Nocrac 200: 2,6-di-t-butyl-4-methylphenol available from Ouchi Shinko Chemical Industrial Co., Ltd.

(3) Preparation of Intermediate Layer Composition and Cover Composition

The blending materials shown in Tables 4 to 5 were mixed with a twin-screw kneading extruder to prepare an intermediate layer composition and cover composition in the form of pellet. Extrusion was conducted in the following conditions: screw diameter=45 mm; screw revolutions=200 rpm; and screw L/D=35. The mixtures were heated to a temperature in a range from 160° C. to 230° C. at a die position of the extruder.

TABLE 4

| Intermediate layer composition No. | | a | b | c |
|---|---|---|---|---|
| Formulation (parts by mass) | Surlyn 8945 | 55 | 45 | 25 |
| | Himilan AM7329 | 45 | 45 | 45 |
| | Rabalon T3221C | — | 10 | 30 |
| | Titanium dioxide | 3 | 3 | 3 |
| Slab hardness (Shore D) | | 65 | 56 | 47 |

Surlyn 8945: a sodium ion neutralized ethylene-methacrylic acid copolymer ionomer resin available from E.I. du Pont de Nemours and Company.

Himilan AM7329: a zinc ion neutralized ethylene-methacrylic acid copolymer ionomer resin available from Du Pont-Mitsui Polychemicals Co., Ltd.

Rabalon T3221C: Styrene elastomer available from Mitsubishi Chemical Corporation.

Titanium dioxide: Ishihara Sangyo Kaisha, Ltd.

TABLE 5

| Cover composition No. | | A | B | C | D |
|---|---|---|---|---|---|
| Formulation (parts by mass) | Elastollan NY82A | 100 | — | — | — |
| | Elastollan NY85A | — | 50 | — | — |
| | Elastollan NY90A | — | 50 | — | — |
| | Elastollan NY97A | — | — | 100 | — |
| | Surlyn 8945 | — | — | — | 40 |
| | Himilan AM7329 | — | — | — | 55 |
| | Rabalon T3221C | — | — | — | 5 |
| | Tinuvin 770 | 0.2 | 0.2 | 0.2 | 0.2 |
| | Titanium dioxde | 4 | 4 | 4 | 4 |
| | Ultramarine blue | 0.04 | 0.04 | 0.04 | 0.04 |
| Slab hardness (Shore D) | | 29 | 36 | 47 | 60 |

Elastollan NY82A: Polyurethane elastomer available from BASF Japan Co.

Elastollan NY85A: Polyurethane elastomer available from BASF Japan Co.

Elastollan NY90A: Polyurethane elastomer available from BASF Japan Co.

Elastollan NY97A: Polyurethane elastomer available from BASF Japan Co.

Tinuvin 770: a hindered amine stabilizer available from BSFA Japan Ltd.

(4) Production of Golf Ball Body

Intermediate layer for 4 piece golf ball No. 1 to No. 27

The intermediate layer compositions obtained above were injection-molded onto the spherical cores to form the intermediate layers. When molding the intermediate layer, the hold pins were protruded, the cores were placed in the molds and held with the protruded hold pins, the intermediate layer compositions heated at 260° C. was charged into the molds clamped at a pressure of 80 tons within 0.3 seconds, and cooled for 30 seconds. Then, the molds were opened, and the spheres covered with the intermediate layer were ejected.

Intermediate Layer for 5 Piece Golf Ball No. 28 to No. 56

First Intermediate Layer

The intermediate layer compositions obtained above were injection-molded onto the spherical cores to form the first intermediate layers. When molding the first intermediate layer, the hold pins were protruded, the spherical cores were placed in the molds and held with the protruded hold pins, the intermediate layer compositions heated at 260° C. was charged into the molds clamped at a pressure of 80 tons within 0.3 seconds, and cooled for 30 seconds. Then, the molds were opened, and the spheres covered with the first intermediate layer were ejected.

Second Intermediate Layer

The intermediate layer compositions obtained above were injection-molded onto the spheres covered with the first intermediate layer to form the second intermediate layers covering the spheres covered with the first intermediate layers.

When molding the second intermediate layer, the hold pins were protruded, the spheres covered with the first intermediate layers were placed in the molds and held with the protruded hold pins, the intermediate layer compositions heated at 260° C. was charged into the molds clamped at a pressure of 80 tons within 0.3 seconds, and cooled for 30 seconds. Then, the molds were opened, and the spheres covered with the intermediate layer were ejected.

Reinforcing Layer

The reinforcing layer was formed by applying a two-component curing type thermosetting resin to the molded intermediate layer. As the two-component curing type thermosetting resin, a paint composition including a two-component curing type epoxy resin as a base polymer was used. The base material liquid of this paint composition includes 30 parts by mass of a bisphenol A type solid epoxy resin and 70 parts by mass of a solvent. The curing agent liquid of this paint composition includes 40 parts by mass of a modified polyamide amine, 5 parts by mass of titanium oxide, and 55 parts by mass of a solvent. The mass ratio of the base material liquid to the curing agent liquid is 1/1. This paint composition was applied to the surface of the intermediate layer with a spray gun, and maintained at 23° C. for 12 hours to obtain a reinforcing layer with a thickness of 6 μm.

Compression molding of half shells was conducted by, charging one pellet of the cover composition obtained as described above into each of depressed parts of lower molds for molding half shells, and applying pressure to mold half shells. Compression molding was conducted at a temperature of 160° C. for 2 minutes under a molding pressure of 11 MPa. The spheres covered with the intermediate layer and formed with the reinforcing layer were covered with the two half shells in a concentric manner, placed in the molds having a plurality of pimples on the surface of the cavity thereof. Compression molding was conducted at a temperature of 150° C. for 3 minutes under a molding pressure of 13 MPa. The molded cover was formed with a plurality of dimples which have inverted shape of the pimples.

Paint Film

The golf ball bodies were subjected to surface treatment by grinding the surface thereof, and then a two-component curing type polyurethane paint was applied on the golf ball bodies by an air gun, and dried and cured to obtain a golf ball having a diameter of 42.7 mm and a mass of 45.6 g.

TABLE 6

| Golf ball No. | | | 1 | 2 | 3 | 4 | 5 | 6 | 7 | 8 | 9 |
|---|---|---|---|---|---|---|---|---|---|---|---|
| Inner core layer | Rubber composition No. | | 2 | 2 | 2 | 2 | 2 | 2 | 2 | 2 | 2 |
| | Vulcanization condition | Temperature (° C.) | 153 | 153 | 153 | 153 | 153 | 153 | 153 | 153 | 153 |
| | | Time (min.) | 30 | 30 | 30 | 30 | 30 | 30 | 30 | 30 | 30 |
| | Diameter (mm) | | 15 | 15 | 15 | 15 | 15 | 15 | 15 | 15 | 15 |
| | Center hardness Ho (JIS-C) | | 68 | 68 | 68 | 68 | 68 | 68 | 68 | 68 | 68 |
| | Surface hardness Hs1 (JIS-C) | | 70 | 70 | 70 | 70 | 70 | 70 | 70 | 70 | 70 |
| | Hardness difference Hs1 − Ho (JIS-C) | | 2 | 2 | 2 | 2 | 2 | 2 | 2 | 2 | 2 |
| Outer core layer | Rubber composition No. | | 3 | 4 | 5 | 6 | 7 | 8 | 9 | 10 | 11 |
| | Vulcanzation condition | Temperature (° C.) | 170 | 170 | 170 | 170 | 170 | 170 | 170 | 170 | 170 |
| | | Time (min.) | 25 | 25 | 25 | 25 | 25 | 25 | 25 | 25 | 25 |
| | Diameter (mm) | | 39.7 | 39.7 | 39.7 | 39.7 | 39.7 | 39.7 | 39.7 | 39.7 | 39.7 |
| | Hardness distribution (JIS-C) | Innermost point hardness Hb | 64.0 | 62.0 | 62.0 | 63.5 | 62.5 | 60.5 | 71.0 | 64.5 | 63.0 |
| | | 12.5% point hardness | 74.0 | 71.5 | 68.0 | 66.0 | 65.0 | 64.5 | 74.0 | 67.0 | 65.0 |
| | | 25% point hardness | 78.0 | 75.5 | 71.0 | 69.5 | 69.0 | 66.5 | 74.5 | 70.5 | 67.0 |
| | | 37.5% point hardness | 78.0 | 76.0 | 73.5 | 71.0 | 71.0 | 69.0 | 75.0 | 72.0 | 69.5 |
| | | 50% point hardness | 78.0 | 76.5 | 74.5 | 73.0 | 72.5 | 71.0 | 75.0 | 73.5 | 72.0 |
| | | 62.5% point hardness | 79.0 | 77.5 | 75.0 | 76.5 | 74.5 | 73.0 | 75.0 | 75.0 | 73.5 |
| | | 75% point hardness | 80.0 | 78.5 | 79.5 | 82.5 | 82.0 | 75.5 | 75.5 | 83.0 | 82.0 |
| | | 87.5% point hardness | 84.0 | 83.5 | 84.5 | 87.0 | 86.0 | 78.0 | 78.0 | 87.0 | 84.0 |
| | | Surface hardness Hs2 | 89.0 | 88.0 | 88.5 | 91.0 | 89.0 | 83.0 | 79.0 | 91.0 | 88.0 |
| | Hardness difference Hs2 − Hb | | 25.0 | 26.0 | 26.5 | 27.5 | 26.5 | 22.5 | 8.0 | 26.5 | 25.0 |
| | $R^2$ of approximated curve | | 0.81 | 0.86 | 0.95 | 0.97 | 0.97 | 0.98 | 0.84 | 0.95 | 0.96 |
| | Slope of approximated curve | | 0.18 | 0.20 | 0.23 | 0.27 | 0.26 | 0.20 | 0.06 | 0.26 | 0.25 |
| Two-layer core | Hardness difference Hs2 − Ho | | 21.0 | 20.0 | 20.5 | 23.0 | 21.0 | 15.0 | 11.0 | 23.0 | 20.0 |
| Intermediate layer | Intermediate layer composition No. | | a | a | a | a | a | a | a | a | a |
| | Slab hardness Hm (Shore D) | | 65 | 65 | 65 | 65 | 65 | 65 | 65 | 65 | 65 |
| | Diameter (mm) | | 41.7 | 41.7 | 41.7 | 41.7 | 41.7 | 41.7 | 41.7 | 41.7 | 41.7 |
| | Thickness (mm) | | 1.0 | 1.0 | 1.0 | 1.0 | 1.0 | 1.0 | 1.0 | 1.0 | 1.0 |
| Cover | Cover composition No. | | A | A | A | A | A | A | A | A | A |
| | Slab hardness Hc (Shore D) | | 29 | 29 | 29 | 29 | 29 | 29 | 29 | 29 | 29 |
| | Thickness (mm) | | 0.5 | 0.5 | 0.5 | 0.5 | 0.5 | 0.5 | 0.5 | 0.5 | 0.5 |
| Ball properties | Hardness difference Hm − Hc (Shore D) | | 36 | 36 | 36 | 36 | 36 | 36 | 36 | 36 | 36 |
| | Compression deformation amount (mm) | | 2.5 | 2.5 | 2.5 | 2.5 | 2.5 | 2.5 | 2.5 | 2.5 | 2.5 |
| | Coefficient of Restitution | | 100.4 | 100.5 | 100.8 | 101.2 | 101.1 | 100.6 | 100.2 | 100.7 | 101.0 |
| | Driver: spin rate (rpm) | | 3250 | 3200 | 3100 | 3000 | 3050 | 3100 | 3300 | 3100 | 3050 |
| | Driver flying distance (m) | | 237 | 239 | 243 | 246 | 245 | 243 | 236 | 243 | 245 |
| | Approach: spin rate (rpm) | | 6800 | 6800 | 6800 | 6750 | 6750 | 6750 | 6800 | 6800 | 6750 |
| | Durability | | 100 | 102 | 109 | 113 | 110 | 108 | 103 | 107 | 109 |

TABLE 7

| | Golf ball No. | | 10 | 11 | 12 | 13 | 14 | 15 | 16 | 17 | 18 |
|---|---|---|---|---|---|---|---|---|---|---|---|
| Inner core layer | Rubber composition No. | | 2 | 2 | 2 | 2 | 2 | 2 | 2 | 2 | 1 |
| | Vulcanization condition | Temperature (° C.) | 153 | 153 | 153 | 153 | 153 | 153 | 153 | 153 | 170 |
| | | Time (min.) | 30 | 30 | 30 | 30 | 30 | 30 | 30 | 30 | 25 |
| | Diameter (mm) | | 15 | 15 | 15 | 15 | 15 | 15 | 15 | 15 | 15 |
| | Center hardness Ho (JIS-C) | | 68 | 68 | 68 | 68 | 68 | 68 | 68 | 68 | 65 |
| | Surface hardness Hs1 (JIS-C) | | 70 | 70 | 70 | 70 | 70 | 70 | 70 | 70 | 75 |
| | Hardness difference Hs1 − Ho (JIS-C) | | 2 | 2 | 2 | 2 | 2 | 2 | 2 | 2 | 10 |
| Outer core layer | Rubber composition No. | | 12 | 13 | 14 | 15 | 6 | 6 | 6 | 17 | 6 |
| | Vulcanization condition | Temperature (° C.) | 170 | 170 | 170 | 170 | 170 | 170 | 170 | 170 | 170 |
| | | Time (min.) | 25 | 25 | 25 | 25 | 25 | 25 | 25 | 25 | 25 |
| | Diameter (mm) | | 39.7 | 39.7 | 39.7 | 39.7 | 39.7 | 39.7 | 39.7 | 39.7 | 39.7 |
| | Hardness distribution (JIS-C) | Innermost point hardness Hb | 64.0 | 63.0 | 63.5 | 63.5 | 63.5 | 63.5 | 63.5 | 63.0 | 63.5 |
| | | 12.5% point hardness | 66.5 | 65.5 | 65.5 | 66.0 | 66.0 | 66.0 | 66.0 | 65.0 | 66.0 |
| | | 25% point hardness | 70.0 | 69.5 | 70.0 | 69.5 | 69.5 | 69.5 | 69.5 | 69.0 | 69.5 |
| | | 37.5% point hardness | 72.0 | 71.5 | 71.0 | 71.0 | 71.0 | 71.0 | 71.0 | 70.5 | 71.0 |
| | | 50% point hardness | 73.0 | 72.5 | 73.0 | 74.0 | 73.0 | 73.0 | 73.0 | 72.5 | 73.0 |
| | | 62.5% point hardness | 74.5 | 74.5 | 76.5 | 76.5 | 76.5 | 76.5 | 76.5 | 76.0 | 76.5 |
| | | 75% point hardness | 82.5 | 82.5 | 82.0 | 82.5 | 82.5 | 82.5 | 82.5 | 82.0 | 82.5 |
| | | 87.5% point hardness | 87.0 | 86.5 | 87.0 | 87.0 | 87.0 | 87.0 | 87.0 | 86.5 | 87.0 |
| | | Surface hardness Hs2 | 91.0 | 89.5 | 91.0 | 91.0 | 91.0 | 91.0 | 91.0 | 90.5 | 91.0 |
| | Hardness difference Hs2 − Hb | | 27.0 | 26.5 | 27.5 | 27.5 | 27.5 | 27.5 | 27.5 | 27.5 | 27.5 |
| | $R^2$ of approximated curve | | 0.95 | 0.96 | 0.97 | 0.97 | 0.97 | 0.97 | 0.97 | 0.97 | 0.97 |
| | Slope of approximated curve | | 0.26 | 0.26 | 0.27 | 0.27 | 0.27 | 0.27 | 0.27 | 0.27 | 0.27 |
| Two-layer core | Hardness difference Hs2 − Ho | | 23.0 | 21.5 | 23.0 | 23.0 | 23.0 | 23.0 | 23.0 | 22.5 | 26.0 |
| Intermediate layer | Intermediate layer composition No. | | a | a | a | a | b | a | a | b | a |
| | Slab hardness Hm (Shore D) | | 65 | 65 | 65 | 65 | 56 | 65 | 65 | 56 | 65 |
| | Diameter (mm) | | 41.7 | 41.7 | 41.7 | 41.7 | 41.7 | 41.7 | 41.7 | 41.7 | 41.7 |
| | Thickness (mm) | | 1.0 | 1.0 | 1.0 | 1.0 | 1.0 | 1.0 | 1.0 | 1.0 | 1.0 |
| Cover | Cover composition No. | | A | A | A | A | A | B | C | D | A |
| | Slab hardness Hc (Shore D) | | 29 | 29 | 29 | 29 | 29 | 36 | 47 | 60 | 29 |
| | Thickness (mm) | | 0.5 | 0.5 | 0.5 | 0.5 | 0.5 | 0.5 | 0.5 | 0.5 | 0.5 |
| Ball properties | Hardness difference Hm − Hc (Shore D) | | 36 | 36 | 36 | 36 | 27 | 29 | 18 | −4 | 36 |
| | Compression deformation amount (mm) | | 2.5 | 2.5 | 2.5 | 2.5 | 2.5 | 2.5 | 2.5 | 2.5 | 2.5 |
| | Coefficient of Restitution | | 100.9 | 101.1 | 101.2 | 101.2 | 101.0 | 101.3 | 101.5 | 101.0 | 100.0 |
| | Driver: spin rate (rpm) | | 3100 | 3050 | 3050 | 3000 | 3100 | 2900 | 2850 | 2750 | 2950 |
| | Driver flying distance (m) | | 242 | 244 | 245 | 246 | 243 | 248 | 249 | 251 | 240 |
| | Approach: spin rate (rpm) | | 6800 | 6750 | 6750 | 6750 | 6850 | 6600 | 6450 | 5750 | 6700 |
| | Durability | | 107 | 109 | 108 | 113 | 120 | 109 | 106 | 103 | 102 |

TABLE 8

| | Golf ball No. | | 19 | 20 | 21 | 22 | 23 | 24 | 25 | 26 | 27 |
|---|---|---|---|---|---|---|---|---|---|---|---|
| Inner core layer | Rubber composition No. | | 2 | 2 | 2 | 2 | 2 | 18 | 19 | 20 | 21 |
| | Vulcanization condition | Temperature (° C.) | 153 | 153 | 153 | 153 | 153 | | Injection molding | | |
| | | Time (min.) | 30 | 30 | 30 | 30 | 30 | | | | |
| | Diameter (mm) | | 15 | 15 | 9 | 21 | 26 | 15 | 15 | 15 | 15 |
| | Center hardness Ho (JIS-C) | | 68 | 68 | 68 | 68 | 68 | 70 | 60 | 44 | 70 |
| | Surface hardness Hs1 (JIS-C) | | 70 | 70 | 70 | 70 | 70 | 70 | 60 | 44 | 70 |
| | Hardness difference Hs1 − Ho (JIS-C) | | 2 | 2 | 2 | 2 | 2 | 0 | 0 | 0 | 0 |
| Outer core layer | Rubber composition No. | | 6 | 17 | 6 | 6 | 6 | 6 | 6 | 16 | 6 |
| | Vulcanization condition | Temperature (° C.) | 170 | 170 | 170 | 170 | 170 | 170 | 170 | 170 | 170 |
| | | Time (min.) | 25 | 25 | 25 | 25 | 25 | 25 | 25 | 25 | 25 |
| | Diameter (mm) | | 38.9 | 38.3 | 39.7 | 39.7 | 39.7 | 39.7 | 39.7 | 39.7 | 39.7 |
| | Hardness distribution (JIS-C) | Innermost point hardness Hb | 64.0 | 63.5 | 63.0 | 64.0 | 64.0 | 63.5 | 63.5 | 64.0 | 63.5 |
| | | 12.5% point hardness | 66.5 | 65.5 | 65.5 | 66.5 | 66.5 | 66.0 | 66.0 | 66.0 | 66.0 |
| | | 25% point hardness | 69.5 | 69.0 | 69.5 | 69.5 | 69.5 | 69.5 | 69.5 | 70.0 | 69.5 |
| | | 37.5% point hardness | 71.0 | 70.5 | 71.0 | 71.0 | 71.0 | 71.0 | 71.0 | 71.5 | 71.0 |
| | | 50% point hardness | 73.0 | 72.5 | 73.0 | 73.0 | 73.0 | 73.0 | 73.0 | 73.5 | 73.0 |
| | | 62.5% point hardness | 76.5 | 76.0 | 76.5 | 76.5 | 76.5 | 76.5 | 76.5 | 77.0 | 76.5 |
| | | 75% point hardness | 82.5 | 82.0 | 82.5 | 82.5 | 82.0 | 82.5 | 82.5 | 83.0 | 82.5 |
| | | 87.5% point hardness | 87.0 | 86.5 | 87.0 | 86.5 | 86.5 | 87.0 | 87.0 | 87.5 | 87.0 |
| | | Surface hardness Hs2 | 91.0 | 90.0 | 91.0 | 90.0 | 89.0 | 91.0 | 91.0 | 91.5 | 91.0 |
| | Hardness difference Hs2 − Hb | | 27.0 | 26.5 | 28.0 | 26.0 | 25.0 | 27.5 | 27.5 | 27.5 | 27.5 |
| | $R^2$ of approximated curve | | 0.96 | 0.97 | 0.97 | 0.97 | 0.97 | 0.97 | 0.97 | 0.97 | 0.97 |
| | Slope of approximated curve | | 0.27 | 0.27 | 0.28 | 0.26 | 0.25 | 0.27 | 0.27 | 0.27 | 0.27 |

TABLE 8-continued

| | Golf ball No. | 19 | 20 | 21 | 22 | 23 | 24 | 25 | 26 | 27 |
|---|---|---|---|---|---|---|---|---|---|---|
| Two-layer core | Hardness difference Hs2 − Ho | 23.0 | 22.0 | 23.0 | 22.0 | 21.0 | 21.0 | 31.0 | 47.5 | 21.0 |
| Intermediate layer | Intermediate layer composition No. | a | a | a | a | a | a | a | a | a |
| | Slab hardness Hm (Shore D) | 65 | 65 | 65 | 65 | 65 | 65 | 65 | 65 | 65 |
| | Diameter (mm) | 40.9 | 41.7 | 41.7 | 41.7 | 41.7 | 41.7 | 41.7 | 41.7 | 41.7 |
| | Thickness (mm) | 1.0 | 1.7 | 1.0 | 1.0 | 1.0 | 1.0 | 1.0 | 1.0 | 1.0 |
| Cover | Cover composition No. | A | A | A | A | A | A | A | A | A |
| | Slab hardness Hc (Shore D) | 29 | 29 | 29 | 29 | 29 | 29 | 29 | 29 | 29 |
| | Thickness (mm) | 0.9 | 0.5 | 0.5 | 0.5 | 0.5 | 0.5 | 0.5 | 0.5 | 0.5 |
| Ball properties | Hardness difference Hm − Hc (Shore D) | 36 | 36 | 36 | 36 | 36 | 36 | 36 | 36 | 36 |
| | Compression deformation amount (mm) | 2.5 | 2.5 | 2.5 | 2.5 | 2.6 | 2.5 | 2.6 | 2.5 | 2.5 |
| | Coefficient of Restitution | 100.6 | 100.8 | 101.3 | 100.7 | 100.4 | 101.2 | 101.2 | 101.0 | 101.4 |
| | Driver spin: rate (rpm) | 3150 | 3050 | 3100 | 2900 | 2850 | 3000 | 2950 | 2900 | 3000 |
| | Driver flying distance (m) | 242 | 242 | 243 | 243 | 241 | 246 | 247 | 247 | 247 |
| | Approach: spin rate (rpm) | 6950 | 6650 | 6800 | 6700 | 6700 | 6750 | 6750 | 6700 | 6750 |
| | Durability | 110 | 116 | 113 | 108 | 105 | 120 | 118 | 115 | 120 |

TABLE 9

| | Golf ball No. | | 28 | 29 | 30 | 31 | 32 | 33 |
|---|---|---|---|---|---|---|---|---|
| Inner core layer | Rubber composition No. | | 2 | 2 | 2 | 2 | 2 | 2 |
| | Vulcanization condition | Temperature (° C.) | 153 | 153 | 153 | 153 | 153 | 153 |
| | | Time (mm.) | 30 | 30 | 30 | 30 | 30 | 30 |
| | Diameter (mm) | | 15 | 15 | 15 | 15 | 15 | 15 |
| | Center hardness Ho (JIS-C) | | 68 | 68 | 68 | 68 | 68 | 68 |
| | Surface hardness Hs1 (JIS-C) | | 70 | 70 | 70 | 70 | 70 | 70 |
| | Hardness difference Hs1 − Ho (JIS-C) | | 2 | 2 | 2 | 2 | 2 | 2 |
| Outer core layer | Rubber composition No. | | 3 | 4 | 5 | 6 | 7 | 8 |
| | Vulcanization condition | Temperature (° C.) | 170 | 170 | 170 | 170 | 170 | 170 |
| | | Time (min.) | 25 | 25 | 25 | 25 | 25 | 25 |
| | Diameter (mm) | | 38.7 | 38.7 | 38.7 | 38.7 | 38.7 | 38.7 |
| | Hardness distribution (JIS-C) | Innermost point hardness Hb | 64.0 | 62.0 | 62.0 | 63.5 | 62.5 | 60.5 |
| | | 12.5% point hardness | 74.0 | 71.5 | 68.0 | 66.0 | 65.0 | 64.5 |
| | | 25% point hardness | 78.0 | 75.5 | 71.0 | 69.5 | 69.0 | 66.5 |
| | | 37.5% point hardness | 78.0 | 76.0 | 73.5 | 71.0 | 71.0 | 69.0 |
| | | 50% point hardness | 78.0 | 76.5 | 74.5 | 73.0 | 72.5 | 71.0 |
| | | 62.5% point hardness | 79.0 | 77.5 | 75.0 | 76.5 | 74.5 | 73.0 |
| | | 75% point hardness | 80.0 | 78.5 | 79.5 | 82.5 | 82.0 | 75.5 |
| | | 87.5% point hardness | 84.0 | 83.5 | 84.5 | 87.0 | 86.0 | 78.0 |
| | | Surface hardness Hs2 | 89.0 | 88.0 | 88.5 | 91.0 | 89.0 | 83.0 |
| | Hardness difference Hs2 − Hb | | 25.0 | 26.0 | 26.5 | 27.5 | 26.5 | 22.5 |
| | $R^2$ of approximated curve | | 0.81 | 0.86 | 0.95 | 0.97 | 0.97 | 0.98 |
| | Slope of approximated curve | | 0.18 | 0.20 | 0.23 | 0.27 | 0.26 | 0.20 |
| Two-layer core | Hardness difference Hs2 − Ho | | 21.0 | 20.0 | 20.5 | 23.0 | 21.0 | 15.0 |
| First intermediate layer | Intermediate layer composition No. | | c | c | c | c | c | c |
| | Slab hardness Hm1 (Shore D) | | 47 | 47 | 47 | 47 | 47 | 47 |
| | Diameter (mm) | | 40.3 | 40.3 | 40.3 | 40.3 | 40.3 | 40.3 |
| | Thickness (mm) | | 0.8 | 0.8 | 0.8 | 0.8 | 0.8 | 0.8 |
| Second intermediate layer | Intermediate layer composition No. | | a | a | a | a | a | a |
| | Slab hardness Hm2 (Shore D) | | 65 | 65 | 65 | 65 | 65 | 65 |
| | Diameter (mm) | | 41.9 | 41.9 | 41.9 | 41.9 | 41.9 | 41.9 |
| | Thickness (mm) | | 0.8 | 0.8 | 0.8 | 0.8 | 0.8 | 0.8 |
| Cover | Cover composition No. | | A | A | A | A | A | A |
| | Slab hardness Hc (Shore D) | | 29 | 29 | 29 | 29 | 29 | 29 |
| | Thickness (mm) | | 0.4 | 0.4 | 0.4 | 0.4 | 0.4 | 0.4 |
| Ball properties | Hardness difference Hm2 − Hm1 (Shore D) | | 18 | 18 | 18 | 18 | 18 | 18 |
| | Hardness difference Hm2 − Hc (Shore D) | | 36 | 36 | 36 | 36 | 36 | 36 |
| | Compression deformation amount (mm) | | 2.4 | 2.4 | 2.4 | 2.4 | 2.4 | 2.4 |
| | Coefficient of Restitution | | 100.4 | 100.5 | 100.8 | 101.2 | 101.1 | 100.6 |
| | Driver: spin rate (rpm) | | 3150 | 3100 | 3000 | 2900 | 2950 | 3000 |
| | Driver flying distance (m) | | 239 | 241 | 245 | 248 | 247 | 245 |
| | Approach: spin rate (rpm) | | 6650 | 6650 | 6650 | 6600 | 6600 | 6600 |
| | Durability | | 100 | 103 | 108 | 114 | 110 | 108 |

| | Golf ball No. | | 34 | 35 | 36 | 37 |
|---|---|---|---|---|---|---|
| Inner core layer | Rubber composition No. | | 2 | 2 | 2 | 2 |
| | Vulcanization condition | Temperature (° C.) | 153 | 153 | 153 | 153 |
| | | Time (mm.) | 30 | 30 | 30 | 30 |

TABLE 9-continued

| | | | | | | |
|---|---|---|---|---|---|---|
| | Diameter (mm) | | 15 | 15 | 15 | 15 |
| | Center hardness Ho (JIS-C) | | 68 | 68 | 68 | 68 |
| | Surface hardness Hs1 (JIS-C) | | 70 | 70 | 70 | 70 |
| | Hardness difference Hs1 − Ho (JIS-C) | | 2 | 2 | 2 | 2 |
| Outer core layer | Rubber composition No. | | 9 | 10 | 11 | 12 |
| | Vulcanization condition | Temperature (° C.) | 170 | 170 | 170 | 170 |
| | | Time (min.) | 25 | 25 | 25 | 25 |
| | Diameter (mm) | | 38.7 | 38.7 | 38.7 | 38.7 |
| | Hardness distribution (JIS-C) | Innermost point hardness Hb | 71.0 | 64.5 | 63.0 | 64.0 |
| | | 12.5% point hardness | 74.0 | 67.0 | 65.0 | 66.5 |
| | | 25% point hardness | 74.5 | 70.5 | 67.0 | 70.0 |
| | | 37.5% point hardness | 75.0 | 72.0 | 69.5 | 72.0 |
| | | 50% point hardness | 75.0 | 73.5 | 72.0 | 73.0 |
| | | 62.5% point hardness | 75.0 | 75.0 | 73.5 | 74.5 |
| | | 75% point hardness | 75.5 | 83.0 | 82.0 | 82.5 |
| | | 87.5% point hardness | 78.0 | 87.0 | 84.0 | 87.0 |
| | | Surface hardness Hs2 | 79.0 | 91.0 | 88.0 | 91.0 |
| | Hardness difference Hs2 − Hb | | 8.0 | 26.5 | 25.0 | 27.0 |
| | $R^2$ of approximated curve | | 0.84 | 0.95 | 0.96 | 0.95 |
| | Slope of approximated curve | | 0.06 | 0.26 | 0.25 | 0.26 |
| Two-layer core | Hardness difference Hs2 − Ho | | 11.0 | 23.0 | 20.0 | 23.0 |
| First intermediate layer | Intermediate layer composition No. | | c | c | c | c |
| | Slab hardness Hm1 (Shore D) | | 47 | 47 | 47 | 47 |
| | Diameter (mm) | | 40.3 | 40.3 | 40.3 | 40.3 |
| | Thickness (mm) | | 0.8 | 0.8 | 0.8 | 0.8 |
| Second intermediate layer | Intermediate layer composition No. | | a | a | a | a |
| | Slab hardness Hm2 (Shore D) | | 65 | 65 | 65 | 65 |
| | Diameter (mm) | | 41.9 | 41.9 | 41.9 | 41.9 |
| | Thickness (mm) | | 0.8 | 0.8 | 0.8 | 0.8 |
| Cover | Cover composition No. | | A | A | A | A |
| | Slab hardness Hc (Shore D) | | 29 | 29 | 29 | 29 |
| | Thickness (mm) | | 0.4 | 0.4 | 0.4 | 0.4 |
| Ball properties | Hardness difference Hm2 − Hm1 (Shore D) | | 18 | 18 | 18 | 18 |
| | Hardness difference Hm2 − Hc (Shore D) | | 36 | 36 | 36 | 36 |
| | Compression deformation amount (mm) | | 2.4 | 2.4 | 2.4 | 2.4 |
| | Coefficient of Restitution | | 100.2 | 100.7 | 101.0 | 100.9 |
| | Driver: spin rate (rpm) | | 3200 | 3000 | 2950 | 3000 |
| | Driver flying distance (m) | | 238 | 245 | 247 | 244 |
| | Approach: spin rate (rpm) | | 6650 | 6650 | 6600 | 6650 |
| | Durability | | 103 | 107 | 110 | 107 |

TABLE 10

| Golf ball No. | | | 38 | 39 | 40 | 41 | 42 | 43 |
|---|---|---|---|---|---|---|---|---|
| Inner core layer | Rubber composition No. | | 2 | 2 | 2 | 2 | 2 | 2 |
| | Vulcanization condition | Temperature (° C.) | 153 | 153 | 153 | 153 | 153 | 153 |
| | | Time (mm.) | 30 | 30 | 30 | 30 | 30 | 30 |
| | Diameter (mm) | | 15 | 15 | 15 | 15 | 15 | 15 |
| | Center hardness Ho (JIS-C) | | 68 | 68 | 68 | 68 | 68 | 68 |
| | Surface hardness Hs1 (JIS-C) | | 70 | 70 | 70 | 70 | 70 | 70 |
| | Hardness difference Hs1 − Ho (JIS-C) | | 2 | 2 | 2 | 2 | 2 | 2 |
| Outer core layer | Rubber composition No. | | 13 | 14 | 15 | 6 | 6 | 6 |
| | Vulcanization condition | Temperature (° C.) | 170 | 170 | 170 | 170 | 170 | 170 |
| | | Time (min.) | 25 | 25 | 25 | 25 | 25 | 25 |
| | Diameter (mm) | | 38.7 | 38.7 | 38.7 | 38.7 | 38.7 | 38.7 |
| | Hardness distribution (JIS-C) | Innermost point hardness Hb | 63.0 | 63.5 | 63.5 | 63.5 | 63.5 | 63.5 |
| | | 12.5% point hardness | 65.5 | 65.5 | 66.0 | 66.0 | 66.0 | 66.0 |
| | | 25% point hardness | 69.5 | 70.0 | 69.5 | 69.5 | 69.5 | 69.5 |
| | | 37.5% point hardness | 71.5 | 71.0 | 71.0 | 71.0 | 71.0 | 71.0 |
| | | 50% point hardness | 72.5 | 73.0 | 74.0 | 73.0 | 73.0 | 73.0 |
| | | 62.5% point hardness | 74.5 | 76.5 | 76.5 | 76.5 | 76.5 | 76.5 |
| | | 75% point hardness | 82.5 | 82.0 | 82.5 | 82.5 | 82.5 | 82.5 |
| | | 87.5% point hardness | 86.5 | 87.0 | 87.0 | 87.0 | 87.0 | 87.0 |
| | | Surface hardness Hs2 | 89.5 | 91.0 | 91.0 | 91.0 | 91.0 | 91.0 |
| | Hardness difference Hs2 − Hb | | 26.5 | 27.5 | 27.5 | 27.5 | 27.5 | 27.5 |
| | $R^2$ of approximated curve | | 0.96 | 0.97 | 0.97 | 0.97 | 0.97 | 0.97 |
| | Slope of approximated curve | | 0.26 | 0.27 | 0.27 | 0.27 | 0.27 | 0.27 |

TABLE 10-continued

| | | | | | | | |
|---|---|---|---|---|---|---|---|
| Two-layer core | Hardness difference Hs2 − Ho | 21.5 | 23.0 | 23.0 | 23.0 | 23.0 | 23.0 |
| First intermediate layer | Intermediate layer composition No. | c | c | c | b | c | c |
| | Slab hardness Hm1 (Shore D) | 47 | 47 | 47 | 56 | 47 | 47 |
| | Diameter (mm) | 40.3 | 40.3 | 40.3 | 40.3 | 40.3 | 40.3 |
| | Thickness (mm) | 0.8 | 0.8 | 0.8 | 0.8 | 0.8 | 0.8 |
| Second intermediate layer | Intermediate layer composition No. | a | a | a | a | a | a |
| | Slab hardness Hm2 (Shore D) | 65 | 65 | 65 | 65 | 65 | 65 |
| | Diameter (mm) | 41.9 | 41.9 | 41.9 | 41.9 | 41.9 | 41.9 |
| | Thickness (mm) | 0.8 | 0.8 | 0.8 | 0.8 | 0.8 | 0.8 |
| Cover | Cover composition No. | A | A | A | A | B | C |
| | Slab hardness Hc (Shore D) | 29 | 29 | 29 | 29 | 36 | 47 |
| | Thickness (mm) | 0.4 | 0.4 | 0.4 | 0.4 | 0.4 | 0.4 |
| Ball properties | Hardness difference Hm2 − Hm1 (Shore D) | 18 | 18 | 18 | 9 | 18 | 18 |
| | Hardness difference Hm2 − Hc (Shore D) | 36 | 36 | 36 | 36 | 29 | 18 |
| | Compression deformation amount (mm) | 2.4 | 2.4 | 2.4 | 2.4 | 2.4 | 2.4 |
| | Coefficient of Restitution | 101.1 | 101.2 | 101.2 | 101.3 | 101.3 | 101.5 |
| | Driver: spin rate (rpm) | 2950 | 2950 | 2900 | 2850 | 2800 | 2750 |
| | Driver flying distance (m) | 246 | 247 | 248 | 247 | 250 | 251 |
| | Approach: spin rate (rpm) | 6600 | 6600 | 6600 | 6450 | 6450 | 6300 |
| | Durability | 109 | 108 | 114 | 110 | 109 | 106 |

| | | | Golf ball No. | 44 | 45 | 46 | 47 |
|---|---|---|---|---|---|---|---|
| Inner core layer | Rubber composition No. | | | 2 | 2 | 1 | 2 |
| | Vulcanization condition | Temperature (° C.) | | 153 | 153 | 170 | 153 |
| | | Time (mm.) | | 30 | 30 | 25 | 30 |
| | Diameter (mm) | | | 15 | 15 | 15 | 15 |
| | Center hardness Ho (JIS-C) | | | 68 | 68 | 65 | 68 |
| | Surface hardness Hs1 (JIS-C) | | | 70 | 70 | 75 | 70 |
| | Hardness difference Hs1 − Ho (JIS-C) | | | 2 | 2 | 10 | 2 |
| Outer core layer | Rubber composition No. | | | 17 | 6 | 6 | 6 |
| | Vulcanization condition | Temperature (° C.) | | 170 | 170 | 170 | 170 |
| | | Time (min.) | | 25 | 25 | 25 | 25 |
| | Diameter (mm) | | | 38.7 | 38.7 | 38.7 | 37.7 |
| | Hardness distribution (JIS-C) | Innermost point hardness Hb | | 63.0 | 63.5 | 63.5 | 64.0 |
| | | 12.5% point hardness | | 65.0 | 66.0 | 66.0 | 66.5 |
| | | 25% point hardness | | 69.0 | 69.5 | 69.5 | 69.5 |
| | | 37.5% point hardness | | 70.5 | 71.0 | 71.0 | 71.0 |
| | | 50% point hardness | | 72.5 | 73.0 | 73.0 | 73.0 |
| | | 62.5% point hardness | | 76.0 | 76.5 | 76.5 | 76.5 |
| | | 75% point hardness | | 82.0 | 82.5 | 82.5 | 82.5 |
| | | 87.5% point hardness | | 86.5 | 87.0 | 87.0 | 87.0 |
| | | Surface hardness Hs2 | | 90.5 | 91.0 | 91.0 | 91.0 |
| | Hardness difference Hs2 − Hb | | | 27.5 | 27.5 | 27.5 | 27.0 |
| | $R^2$ of approximated curve | | | 0.97 | 0.97 | 0.97 | 0.96 |
| | Slope of approximated curve | | | 0.27 | 0.27 | 0.27 | 0.27 |
| Two-layer core | Hardness difference Hs2 − Ho | | | 22.5 | 23.0 | 26.0 | 23.0 |
| First intermediate layer | Intermediate layer composition No. | | | c | a | c | c |
| | Slab hardness Hm1 (Shore D) | | | 47 | 65 | 47 | 47 |
| | Diameter (mm) | | | 40.3 | 40.3 | 40.3 | 39.3 |
| | Thickness (mm) | | | 0.8 | 0.8 | 0.8 | 0.8 |
| Second intermediate layer | Intermediate layer composition No. | | | b | c | a | a |
| | Slab hardness Hm2 (Shore D) | | | 56 | 47 | 65 | 65 |
| | Diameter (mm) | | | 41.9 | 41.9 | 41.9 | 40.9 |
| | Thickness (mm) | | | 0.8 | 0.8 | 0.8 | 0.8 |
| Cover | Cover composition No. | | | D | A | A | A |
| | Slab hardness Hc (Shore D) | | | 60 | 29 | 29 | 29 |
| | Thickness (mm) | | | 0.4 | 0.4 | 0.4 | 0.9 |
| Ball properties | Hardness difference Hm2 − Hm1 (Shore D) | | | 9 | 18 | 18 | 18 |
| | Hardness difference Hm2 − Hc (Shore D) | | | 4 | 18 | 36 | 36 |
| | Compression deformation amount (mm) | | | 2.4 | 2.4 | 2.4 | 2.4 |
| | Coefficient of Restitution | | | 101.0 | 101 | 100.0 | 100.6 |
| | Driver: spin rate (rpm) | | | 2650 | 3250 | 2850 | 3150 |
| | Driver flying distance (m) | | | 253 | 239 | 242 | 244 |
| | Approach: spin rate (rpm) | | | 5650 | 6800 | 6550 | 6900 |
| | Durability | | | 103 | 119 | 103 | 111 |

TABLE 11

| Golf ball No. | | | 48 | 49 | 50 | 51 | 52 | 53 | 54 | 55 | 56 |
|---|---|---|---|---|---|---|---|---|---|---|---|
| Inner core layer | Rubber composition No. | | 2 | 2 | 2 | 2 | 2 | 18 | 19 | 20 | 21 |
| | Vulcanization condition | Temperature (° C.) | 153 | 153 | 153 | 153 | 153 | | Injection molding | | |
| | | Time (mm.) | 30 | 30 | 30 | 30 | 30 | | | | |
| | Diameter (mm) | | 15 | 15 | 9 | 21 | 26 | 15 | 15 | 15 | 15 |
| | Center hardness Ho (JIS-C) | | 68 | 68 | 68 | 68 | 68 | 70 | 60 | 44 | 70 |
| | Surface hardness Hs1 (JIS-C) | | 70 | 70 | 70 | 70 | 70 | 70 | 60 | 44 | 70 |
| | Hardness difference Hs1 − Ho (JIS-C) | | 2 | 2 | 2 | 2 | 2 | 0 | 0 | 0 | 0 |
| Outer core layer | Rubber composition No. | | 17 | 17 | 6 | 6 | 6 | 6 | 6 | 16 | 6 |
| | Vulcanization condition | Temperature (° C.) | 170 | 170 | 170 | 170 | 170 | 170 | 170 | 170 | 170 |
| | | Time (min.) | 25 | 25 | 25 | 25 | 25 | 25 | 25 | 25 | 25 |
| | Diameter (mm) | | 35.5 | 38.7 | 38.7 | 38.7 | 38.7 | 38.7 | 38.7 | 38.7 | 38.7 |
| | Hardness distribution (JIS-C) | Innermost point hardness Hb | 63.5 | 63.0 | 63.0 | 64.0 | 64.0 | 63.5 | 63.5 | 64.0 | 63.5 |
| | | 12.5% point hardness | 65.5 | 65.0 | 65.5 | 66.5 | 66.5 | 66.0 | 66.0 | 66.0 | 66.0 |
| | | 25% point hardness | 69.0 | 69.0 | 69.5 | 69.5 | 69.5 | 69.5 | 69.5 | 70.0 | 69.5 |
| | | 37.5% point hardness | 70.5 | 70.5 | 71.0 | 71.0 | 71.0 | 71.0 | 71.0 | 71.5 | 71.0 |
| | | 50% point hardness | 72.5 | 72.5 | 73.0 | 73.0 | 73.0 | 73.0 | 73.0 | 73.5 | 73.0 |
| | | 62.5% point hardness | 76.0 | 76.0 | 76.5 | 76.5 | 76.5 | 76.5 | 76.5 | 77.0 | 76.5 |
| | | 75% point hardness | 82.0 | 82.0 | 82.5 | 82.5 | 82.0 | 82.5 | 82.5 | 83.0 | 82.5 |
| | | 87.5% point hardness | 86.5 | 86.5 | 87.0 | 86.5 | 86.5 | 87.0 | 87.0 | 87.5 | 87.0 |
| | | Surface hardness Hs2 | 90.0 | 90.5 | 91.0 | 90.0 | 89.0 | 91.0 | 91.0 | 91.5 | 91.0 |
| | Hardness difference Hs2 − Hb | | 26.5 | 27.5 | 28.0 | 26.0 | 25.0 | 27.5 | 27.5 | 27.5 | 27.5 |
| | $R^2$ of approximated curve | | 0.97 | 0.97 | 0.97 | 0.97 | 0.97 | 0.97 | 0.97 | 0.97 | 0.97 |
| | Slope of approximated curve | | 0.27 | 0.27 | 0.28 | 0.26 | 0.25 | 0.27 | 0.27 | 0.27 | 0.27 |
| Two-layer core | Hardness difference Hs2 − Ho | | 22.0 | 22.5 | 23.0 | 22.0 | 21.0 | 21.0 | 31.0 | 47.5 | 21.0 |
| First intermediate layer | Intermediate layer composition No. | | c | — | c | c | c | c | c | c | c |
| | Slab hardness Hm1 (Shore D) | | 47 | — | 47 | 47 | 47 | 47 | 47 | 47 | 47 |
| | Diameter (mm) | | 38.7 | — | 40.3 | 40.3 | 40.3 | 40.3 | 40.3 | 40.3 | 40.3 |
| | Thickness (mm) | | 1.6 | — | 0.8 | 0.8 | 0.8 | 0.8 | 0.8 | 0.8 | 0.8 |
| Second intermediate layer | Intermediate layer composition No. | | a | a | a | a | a | a | a | a | a |
| | Slab hardness Hm2 (Shore D) | | 65 | 65 | 65 | 65 | 65 | 65 | 65 | 65 | 65 |
| | Diameter (mm) | | 41.9 | 41.9 | 41.9 | 41.9 | 41.9 | 41.9 | 41.9 | 41.9 | 41.9 |
| | Thickness (mm) | | 1.6 | 1.6 | 0.8 | 0.8 | 0.8 | 0.8 | 0.8 | 0.8 | 0.8 |
| Cover | Cover composition No. | | A | A | A | A | A | A | A | A | A |
| | Slab hardness Hc (Shore D) | | 29 | 29 | 29 | 29 | 29 | 29 | 29 | 29 | 29 |
| | Thickness (mm) | | 0.4 | 0.4 | 0.4 | 0.4 | 0.4 | 0.4 | 0.4 | 0.4 | 0.4 |
| Ball properties | Hardness difference Hm2 − Hm1 (Shore D) | | 18 | | 18 | 18 | 18 | 18 | 18 | 18 | 18 |
| | Hardness difference Hm2 − Hc (Shore D) | | 36 | 36 | 36 | 36 | 36 | 36 | 36 | 36 | 36 |
| | Compression deformation amount (mm) | | 2.3 | 2.4 | 2.4 | 2.4 | 2.5 | 2.4 | 2.5 | 2.4 | 2.4 |
| | Coefficient of Restitution | | 100.7 | 101.2 | 101.3 | 100.7 | 100.4 | 101.2 | 101.2 | 101.0 | 101.4 |
| | Driver: spin rate (rpm) | | 2950 | 2800 | 3000 | 2800 | 2750 | 2900 | 2850 | 2800 | 2900 |
| | Driver flying distance (m) | | 244 | 250 | 245 | 245 | 243 | 248 | 249 | 249 | 249 |
| | Approach: spin rate (rpm) | | 6500 | 6300 | 6650 | 6550 | 6550 | 6600 | 6600 | 6550 | 6600 |
| | Durability | | 116 | 85 | 114 | 108 | 105 | 121 | 118 | 116 | 122 |

As apparent from the results of tables 6 to 8, the golf balls where a hardness difference (Hs1−Ho) is 5 or less in JIS-C hardness; the outer core layer is such that $R^2$ of a linear approximation curve is 0.95 or higher, the intermediate layer has a slab hardness (Hm) which is higher than a slab hardness (Hc) of the cover each have a great flight distance (241 m or more) on driver shots, high spin rate (6000 rpm or more) on approach shots and excellent durability.

The golf balls No. 1, 2 and 7 are the cases where the outer core layer is such that $R^2$ of a linear approximation curve is less than 0.95. Although the spin rate on approach shots was high, the flight distance on driver shots was short. The golf ball No. 17 is the case where the slab hardness (Hm) of the intermediate layer is lower than the slab hardness (Hc) of the cover. Although the flight distance on driver shots was great, the spin rate on approach shots was low. The golf ball No. 18 is the case where the hardness difference (Hs1−Ho) is as large as 10 in JIS-C hardness. Although the spin rate on approach shots was high, the flight distance on driver shots was short.

As apparent from the results of tables 9 to 11, the golf balls where a hardness difference (Hs1−Ho) is 5 or less in JIS-C hardness; the outer core layer is such that $R^2$ of a linear approximation curve is 0.95 or higher, the first intermediate layer has a slab hardness (Hm1) which is lower than the slab hardness (Hm2) of the second intermediate layer, and the second intermediate layer has a slab hardness (Hm2) which is higher than a slab hardness (Hc) of the cover each have a great flight distance on driver shots, high spin rate on approach shots and excellent durability.

The golf balls No. 28, 29 and 34 are the cases where the outer core layer is such that $R^2$ of a linear approximation curve is less than 0.95. Although the spin rates on approach shots were high, the flight distances on driver shots were short. The golf ball No. 44 is the case where the slab hardness (Hm) of the intermediate layer is lower than the slab hardness (Hc) of the cover. Although the flight distance on driver shots was great, the spin rate on approach shots was low. The golf ball No. 45 is the case where the first intermediate layer has the slab hardness (Hm1) which is higher than the slab hardness (Hm2) of the second intermediate layer. Although the spin rate on approach shots was high, the flight distance was short due to the high spin rate on driver shots. The golf ball No. 46 is the case where the hardness difference (Hs1−Ho) is as large as 10 in JIS-C hardness. Although the spin rate on approach shots was high, the flight distance on driver shots was short. The golf ball No. 59 traveled a great distance on driver shots and produced a high spin rate on approach shots. However, if compared with the golf ball having the intermediate layer composed of two or more layers, the durability was lowered.

The golf ball of the present invention travels a great flight distance, and has an excellent approach performance and durability. This application is based on Japanese Patent applications Nos. 2012-126599 and 2012-126600 filed on Jun. 1, 2012, the contents of which are hereby incorporated by reference.

The invention claimed is:

1. A golf ball comprising a spherical core composed of a spherical inner core layer and an outer core layer, an intermediate layer disposed outside the spherical core, and a cover disposed outside the intermediate layer, wherein the inner core layer has a diameter from 12.0 mm to 25.0 mm, the spherical core has a diameter from 36.0 mm to 40.6 mm, a hardness difference (Hs1−Ho) between a center hardness (Ho) of the spherical inner core layer and a surface hardness (Hs1) thereof is 2 or less in JIS-C hardness;

a hardness difference (Hs2−Hb) between a hardness (Hb) at the innermost point of the outer core layer and a surface hardness (Hs2) of the spherical core is 26 or more in JIS-C hardness;

the outer core layer has a hardness distribution such that if JIS-C hardness values are measured at nine points obtained by dividing the outer core layer thickness into equal parts having 12.5% intervals in a radius direction of the spherical core including the innermost point and surface of the outer core layer, and these hardness values are plotted against distance (%) from the innermost point of the outer core layer, then $R^2$ of a linear approximation curve obtained from a least square method is 0.95 or higher; and the intermediate layer has a slab hardness (Hm) which is higher than a slab hardness (Hc) of the cover.

2. The golf ball according to claim 1, wherein the spherical core has the center hardness (Ho) ranging from 40 to 80 in JIS-C hardness and a surface hardness (Hs2) ranging from 80 to 96 in JIS-C hardness.

3. The golf ball according to claim 1, wherein the spherical core has a hardness difference (Hs2−Ho) of 20 or more in JIS-C hardness between a surface hardness (Hs2) thereof and the center hardness (Ho) thereof.

4. The golf ball according to claim 1, wherein a hardness difference (Hm−Hc) between the slab hardness (Hm) of the intermediate layer and the slab hardness (Hc) of the cover is 30 or more in JIS-C hardness.

5. The golf ball according to claim 1, wherein the intermediate layer has a thickness ranging from 0.5 mm to 1.6 mm, and the cover has a thickness of 0.8 mm or less.

6. The golf ball according to claim 1, wherein the intermediate layer has a first intermediate layer disposed outside the spherical core, and a second intermediate layer disposed outside the first intermediate layer, and the first intermediate layer has a slab hardness (Hm1) which is lower than a slab hardness (Hm2) of the second intermediate layer, the second intermediate layer has the slab hardness (Hm2) which is higher than the slab hardness (Hc) of the cover.

7. The golf ball according to claim 6, wherein a hardness difference (Hm2−Hm1) between the slab hardness (Hm1) of the first intermediate layer and the slab hardness (Hm2) of the second intermediate layer is 8 or more in Shore D hardness, and a hardness difference (Hm2−Hc) between the slab hardness (Hm2) of the second intermediate layer and the slab hardness (Hc) of the cover is 30 or more in Shore D hardness.

8. The golf ball according to claim 6, wherein a total thickness of the intermediate layers ranges from 1.0 mm to 3.0 mm and the cover has a thickness of 0.8 mm or less.

9. The golf ball according to claim 1, wherein the outer core layer is formed from a rubber composition containing:

(a) a base rubber, (b1) an α,β-unsaturated carboxylic acid having 3 to 8 carbon atoms and/or (b2) a metal salt of the α,β-unsaturated carboxylic acid having 3 to 8 carbon atoms as (b) a co-crosslinking agent, (c) a crosslinking initiator, and (d) an acid and/or a salt thereof excluding the (b) co-crosslinking agent.

10. The golf ball according to claim 9, wherein (d) the acid and/or the salt thereof is a carboxylic acid and/or a salt thereof.

11. The golf ball according to claim 10, wherein (d) the carboxylic acid and/or the salt thereof is a fatty acid and/or a salt thereof.

12. The golf ball according to claim 11, wherein (d) carboxylic acid and/or the salt thereof has a fatty acid component having 1 to 30 carbon atoms.

13. The golf ball according to claim 9, wherein the rubber composition contains (d) the acid and/or the salt thereof in an amount of 1 part by mass or more and less than 40 parts by mass with respect to 100 parts by mass of (a) the base rubber.

14. The golf ball according to claim 9, wherein the rubber composition further contains (e) an organic sulfur compound.

15. The golf ball according to claim 14, wherein (e) the organic sulfur compound includes at least one compound selected from the group consisting of thiophenols, diphenylsulfides, thionaphthols, thiuramdisulfides, or metal salts thereof.

16. The golf ball according to claim 14, wherein (d) the organic sulfur compound includes 2-thionaphthol.

17. The golf ball according to claim 14, wherein the rubber composition contains (e) the organic sulfur compound in an amount ranging from 0.05 part by mass to 5 parts by mass with respect to 100 parts by mass of (a) the base rubber.

18. The golf ball according to claim 9, wherein the rubber composition contains (b1) the α,β-unsaturated carboxylic acid having 3 to 8 carbon atoms and (f) a metal compound.

19. The golf ball according to claim 9, wherein the rubber composition contains (b2) the metal salt of the α,β-unsaturated carboxylic acid having 3 to 8 carbon atoms.

20. The golf ball according to claim 9, wherein the rubber composition contains (b) the co-crosslinking agent in an amount ranging from 15 parts by mass to 50 parts by mass with respect to 100 parts by mass of (a) the base rubber.

21. The golf ball according to claim 1, wherein the rubber composition contains (c) the crosslinking initiator in an amount ranging from 0.2 part by mass to 5 parts by mass with respect 100 parts by mass of (a) the base rubber.

22. The golf ball according to claim 1, further comprising a reinforcing layer disposed between the intermediate layer and the cover.

23. The golf ball according to claim 10, wherein (d) the carboxylic acid and/or the salt thereof has a fatty acid component having 1 to 17 carbon atoms, and wherein the rubber composition contains (d) the carboxylic acid and/or the salt thereof in an amount of 1.0 part by mass or more and 40 parts by mass or less with respect to 100 parts by mass of (a) the base rubber.

24. The golf ball according to claim 10, wherein (d) the carboxylic acid and/or the salt thereof has a fatty acid component having 18 to 30 carbon atoms, and wherein the rubber composition contains (d) the carboxylic acid and/or the salt thereof in an amount of 6 parts by mass or more and less than 40 parts by mass with respect to 100 parts by mass of (a) the base rubber.

* * * * *